US006558885B1

(12) United States Patent
Sakai et al.

(10) Patent No.: US 6,558,885 B1
(45) Date of Patent: May 6, 2003

(54) SILVER HALIDE COLOR PHOTOGRAPHIC LIGHT-SENSITIVE MATERIAL AND IMAGE-FORMING METHOD

(75) Inventors: Hidekazu Sakai, Minami-ashigara (JP); Tatsuya Ishizaka, Minami-ashigara (JP); Katsuyuki Takada, Minami-ashigara (JP)

(73) Assignee: Fuji Photo Film Co., Ltd., Kanagawa-Ken (JP)

( * ) Notice: Subject to any disclaimer, the term of this patent is extended or adjusted under 35 U.S.C. 154(b) by 0 days.

(21) Appl. No.: 09/721,660

(22) Filed: Nov. 27, 2000

(30) Foreign Application Priority Data

Nov. 25, 1999 (JP) ..... 11-334982
Mar. 29, 2000 (JP) ..... 2000-92148

(51) Int. Cl.[7] ..... G03C 1/46

(52) U.S. Cl. ..... 430/505; 430/558; 430/510; 430/517; 430/522; 430/567

(58) Field of Search ..... 430/505, 543, 430/558, 510, 517, 522, 567

(56) References Cited

U.S. PATENT DOCUMENTS

| | | | | |
|---|---|---|---|---|
| 4,840,878 A | | 6/1989 | Hirose et al. | |
| 4,940,654 A | * | 7/1990 | Diehl et al. | 430/522 |
| 4,988,611 A | * | 1/1991 | Anderson et al. | 430/517 |
| 5,256,526 A | | 10/1993 | Suzuki et al. | |
| 5,709,983 A | * | 1/1998 | Brick et al. | 430/517 |
| 5,723,272 A | * | 3/1998 | Barber et al. | 430/522 |
| 6,143,485 A | * | 11/2000 | Tang et al. | 430/558 |

FOREIGN PATENT DOCUMENTS

| | | |
|---|---|---|
| EP | 0 545 300 A1 | 6/1993 |
| JP | 11-095371 | 4/1999 |
| JP | 11-282106 | 10/1999 |

* cited by examiner

*Primary Examiner*—Geraldine Letscher
(74) *Attorney, Agent, or Firm*—Sughrue Mion, PLLC

(57) ABSTRACT

Disclosed is a silver halide color photographic light-sensitive material that comprises at least one magenta emulsion layer containing at least one specific pyrazolotriazole magenta dye-forming coupler, in which a silver halide emulsion in the magenta emulsion layer containing the magenta dye-forming coupler comprises a high silver chloride emulsion whose silver chloride content is 98 mol % or more, at least one light-insensitive hydrophilic colloidal layer contains a solid fine-particle dispersion of a dye that has 1 to 7 dissociable hydrogen or group having a dissociable hydrogen, and the magenta emulsion layer containing the magenta dye-forming coupler is a light-sensitive silver halide emulsion layer most apart from the light-insensitive hydrophilic colloidal layer containing the solid fine-particle dispersion of the dye, among all the light-sensitive silver halide emulsion layers. Further, there is disclosed a silver halide color photographic light-sensitive material for cinema, in which light-sensitive silver halide particles in each of a yellow color-forming light-sensitive silver halide emulsion layer, a magenta color-forming light-sensitive silver halide emulsion layer, and a cyan color-forming light-sensitive silver halide emulsion layer, has silver chloride content of 95 mol % or more, the total coated amount of silver is 1.7 g/m$^2$ or less, the thickness of the film on the support on the side of layers containing the light-sensitive silver halide is 12.0 $\mu$m or less, and the swelling rate to water is 200% or less. Further, an image-forming method utilizing the silver halide color photographic light-sensitive material for cinema is also disclosed.

12 Claims, No Drawings

SILVER HALIDE COLOR PHOTOGRAPHIC LIGHT-SENSITIVE MATERIAL AND IMAGE-FORMING METHOD

FIELD OF THE INVENTION

The present invention relates to a silver halide color photographic light-sensitive material improved in color reproduction and processing stability, and particularly to a silver halide color photographic light-sensitive material for cinema.

The present invention particularly relates to a color photographic light-sensitive material for cinema, with the light-sensitive material having high image quality and rapid processing suitability (especially, reduction in processing time in each processing step, such as color-development processing time), and to an image-forming method.

BACKGROUND OF THE INVENTION

In cinema that is an application of silver halide photography, is applied a method in which 24 precise static images are projected, one by one, in one second, to obtain a dynamic image having outstandingly higher image quality than other methods reproducing dynamic images. However, recent rapid developments in electronic technologies and information processing technologies have resulted in a proposal of means, e.g., a projector using a DMD device manufactured by Texas Instruments, and an ILA projector manufactured by Huse-JVC, giving an image quality close to that of cinema and reproducing dynamic images more simply. Accordingly, the photographic material for cinema is also required to have simplicity, particularly to enable development processing in a simple and short-time processing.

Reducing development processing time for a silver halide photographic light-sensitive material has been taken up as an important object, and, many studies concerning silver halide emulsions having high developing rates, couplers having high coupling activity, and processing agents enabling rapid-development, have been carried out. To show an example of these studies, a color photographic light-sensitive material using a silver halide emulsion having a high silver chloride content is disclosed in U.S. Pat. No. 4,840,878.

Also, the cinema film is projected by expanding it when it is projected on a screen, and hence fine graininess (granularity) and high sharpness are required for a light-sensitive material used in each of photographing (shooting), editing, and projecting stages.

As means for improving sharpness, it is generally effective to prevent halation, and irradiation and colorants, such as dyes, are used for these purposes. The colorants used for these purposes must fulfill the following performances:

(1) The colorant has no chemically adverse effect on a silver halide emulsion layer in a light-sensitive material; for example, the colorant does not cause a change in sensitivity and the generation of fog.

(2) The colorant is completely decolored in a photographic process or tends to elute from a photographic light-sensitive material, to leave no unacceptable color on the photographic light-sensitive material.

(3) The colorant has a proper spectral absorption corresponding to the purpose of use.

Methods known as coloring means for the prevention of halation include a method in which a specific non-light-sensitive hydrophilic colloidal layer is made to contain fine-particle colloidal silver, a method in which a support having a hydrophilic resin layer, in which carbon fine particles are dispersed, is used, and a method in which a specific non-light-sensitive hydrophilic colloidal layer is made to contain a solid, fine-particle dispersion of a dye removable in a developing process. In particular, the method using a solid, fine-particle dispersion of a dye removable in a developing process, makes it possible to control the hue (color tone) of a colored layer, and to improve both the sharpness of a dye image of the object and sensitivity, and this is a superior method adaptable to a positive film for movies, which film uses silver generated by developing to form a sound track. In this method, a step of removing a resin layer can be omitted in a developing step. This method is therefore superior in view of simplicity of the aforementioned developing process.

There is a coloring method using a water-soluble dye to prevent irradiation. Examples of the dye may include oxonol dyes and other azo dyes, anthraquinone dyes, allylidene dyes, styryl dyes, triarylmethane dyes, merocyanine dyes, and cyanine dyes, as described in U.S. Pat. No. 4,078,933.

However, in the case of adding a dye in an amount required to improve sharpness when a solid dispersion of a dye is introduced to prevent halation and a water-soluble dye is used to prevent irradiation, a reduction in the rate of elution of the dye in the photographic processing is unavoidable. It is therefore difficult to attain compatibility of the property important to image quality, such as sharpness, and the reduction in coloring given to a white ground.

It is commonly known that these problems can be improved by measures in which a hydrophilic colloidal layer, formed by application on a support, is itself made thinner. Namely, the formation of a thin layer leads to the result that the dye is easily eluted in the process, and the same irradiation-preventing effect can be expected by using a smaller amount of an irradiation-preventive dye.

Meanwhile, recent progress in projection techniques has allowed the use of a stable and bright light source when a film is projected. It is therefore required for a color positive film for projecting to have a wider dynamic range, which is higher in color density. In order to attain higher color density, much of a silver halide emulsion and a coupler must be introduced into a hydrophilic colloidal layer, which requires a design contrary to the formation of a thin layer. For this reason, a coupler capable of forming a dye having a high molecular extinction coefficient is eagerly desired, to obtain high color density by using it in a smaller amount. In particular, a projecting positive film is demanded to reproduce more vivid color, to thereby show a special effect, obtained by the use of computer graphics in recent years, more effectively.

It is well known that, in a silver halide color photographic light-sensitive material, an aromatic primary amine-series color-developing agent, oxidized using the exposed silver halide as an oxidizing agent, is reacted with a coupler, to produce a dye of indophenol, indoaniline, indamine, azomethine, phenoxazine, phenazine, and the like, thereby forming an image. In this photographic system, a subtractive color process is used, and a color image is formed by yellow, magenta, and cyan dyes.

In order to form a magenta dye image among these dye images, pyrazolone-series couplers have been used so far. However, because a dye produced from these couplers exhibits unacceptable absorption in the yellow region, only low vividness and only a relatively low molecular extinction coefficient are obtained. It is therefore necessary to use a large amount of the coupler, to obtain a necessary density, which is contrary to the aforementioned requirement for the formation of a thin layer. For this reason, a coupler by which these problems are solved has been eagerly desired.

As couplers that overcome these problems, pyrazolotriazole couplers are proposed, as described in U.S. Pat. No. 5,256,526 and European Patent No. 0545300, and their practical use has been started in silver halide color photographic light-sensitive materials, such as color print paper. These couplers have high coupling activity and are preferable also in view of shortening development processing time.

The inventors of the present invention, having conducted various studies, have found that a silver halide color photographic light-sensitive material for cinema which uses a pyrazolotriazole coupler as a magenta coupler, and into which a high silver chloride emulsion is introduced, is preferable to solve these problems. However, from further investigations on a silver halide color photographic light-sensitive material for cinema, which uses a pyrazolotriazole coupler, and into which a high silver chloride emulsion is introduced, it has been found that the stability against development processing is impaired, and particularly, the photographic characteristics largely fluctuate in the processing using a developer after the continuous processing.

In the meantime, with regard to light-sensitive materials used for cinema, because the cine film is projected by expanding it when it is projected on a screen, and hence very fine graininess and high sharpness are required for a light-sensitive material used in each of photographing, editing, and projecting stages. On the other hand, in the process steps for cinema, two informations, consisting of image information formed by a color-forming agent, and sound information formed primarily by a silver image, are incorporated into one cine film, and development, fixing and washing steps are independently performed for each information. The conventional process is performed in over 15 steps, excluding a drying step, and also, the process time of each step is long. Therefore, there has been a strong request to decrease the number of process steps and to attain simplification of the process steps and reduction in the process time, in view of lightening environmental burdens.

In response to these demands, in view of decreasing the number of processing steps, JP-A-11-95371 ("JP-A" means unexamined published Japanese patent application) discloses a technique in which, using solid, fine-particle dispersion removable in a process in succession to color-development bath, a step of removing a resin backing layer, that is, a black antihalation layer, containing carbon fine particles, can be omitted. Also, JP-A-11-282106 discloses a technique in which, in addition to the omission of a step of removing a resin backing layer containing carbon fine particles, an infrared absorbable dye reduced in remaining color is formed in a color-developing process, to make soundtrack information, whereby a conventional soundtrack developing step can be omitted. These techniques are excellent technologies to reduce the number of process steps.

However, even if the number of process steps can be decreased in this manner, there is a strong demand for a process in a larger amount than the conventional process, namely, a further rapid process. Particularly, not only reduction in the number of steps but also reduction in the process time in each process step, specifically, reduction in the process time by accelerating the process speed in each step, has become desired.

SUMMARY OF THE INVENTION

A task of the present invention is to solve the aforementioned conventional problems, and to attain the following objects.

Specifically, a first object of the present invention is to provide a silver halide color photographic light-sensitive material having a high-quality image, particularly a silver halide color photographic light-sensitive material for cinema.

A second object of the present invention is to provide a silver halide color photographic light-sensitive material having reproduction of more-vivid color and excellent processing stability, particularly a silver halide color photographic light-sensitive material for cinema.

A third object of the present invention is to provide a silver halide color photographic light-sensitive material providing sufficient color density and color reproduction and excellent processing stability in continuous processing, particularly a silver halide color photographic light-sensitive material for cinema.

A forth object of the present invention is to provide a silver halide color photographic light-sensitive material that is provided rapid processing suitability, particularly a silver halide color photographic light-sensitive material for cinema.

A fifth object of the present invention is to provide a silver halide color light-sensitive material for cinema that has high sensitivity, that is free from remaining color after being processed, and that can be processed rapidly, and also to provide an image-forming method.

A sixth object of the present invention to provide a silver halide color light-sensitive material for cinema that exhibits high image quality, particularly high graininess and high sharpness, and that can be processed rapidly, and also to provide an image-forming method.

A seventh object of the present invention to provide a silver halide color light-sensitive material for cinema that, in addition to the above features, is high in reciprocity performance and development progress characteristics, and also to provide an image-forming method.

Other and further objects, features, and advantages of the invention will appear more fully from the following description.

DETAILED DESCRIPTION OF THE INVENTION

The means for the solution of the aforementioned problems are as follows.

<1> A silver halide color photographic light-sensitive material comprising at least one yellow color-forming light-sensitive silver halide emulsion layer, at least one cyan color-forming light-sensitive silver halide emulsion layer and at least one magenta color-forming light-sensitive silver halide emulsion layer, and at least one non-light-sensitive hydrophilic colloidal layer, on a support, wherein at least one layer of said magenta color-forming silver halide emulsion layer contains at least one magenta dye-forming coupler selected from compounds represented by the following formula (M-I), a silver halide emulsion in the magenta color-forming silver halide emulsion layer containing the compound represented by the formula (M-I) comprises a high silver chloride emulsion having a 98 mol % or more of silver chloride content, and, wherein at least one layer of said non-light-sensitive hydrophilic colloidal layer contains a solid fine-particle dispersion of a dye represented by the following formula (I), and the magenta color-forming silver halide emulsion layer containing the compound represented by formula (M-I) is a light-sensitive silver halide emulsion layer most apart from the non-light-sensitive hydrophilic colloidal layer containing the solid fine-particle dispersion of the dye represented by formula (I), among all the light-sensitive silver halide emulsion layers;

formula (M-I)

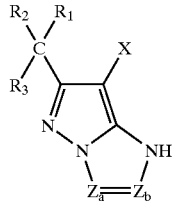

wherein, in formula (M-I), $z_a$ and $z_b$ each represent $=C(R_4)-$ or $=N-$, $R_1$, $R_2$, $R_3$ and $R_4$ each represent a hydrogen atom or a substituent, X represents a hydrogen atom or a group capable of being split-off upon a coupling reaction with an oxidized product of a color-developing agent $$D\text{-}(X)_y \qquad \text{formula (I)}$$

wherein, in formula (I), D represents a group to give a compound having a chromophore, X represents a dissociable hydrogen or a group having a dissociable hydrogen, and y is an integer from 1 to 7.

<2> The silver halide color photographic light-sensitive material according to the above <1>, wherein the dye is a dye represented by the following formula (II) or (III);

$$A^1{=}L^1{-}(L^2{=}L^3)_m{-}Q \qquad \text{formula (II)}$$

wherein, in formula (II), $A^1$ represents an acidic nucleus, Q represents an aryl group or a heterocyclic group, $L^1$, $L^2$ and $L^3$ each represent a methine group, and m is 0, 1 or 2, provided that the compound represented by formula (II) possesses 1 to 7 groups selected from the group consisting of a carboxylic acid group, a sulfonamido group, a sulfamoyl group, a sulfonylcarbonyl group, an acylsulfamoyl group and a phenolic hydroxyl group as the group having a dissociable hydrogen in its molecule, and an enol group of an oxonol dye as a dissociable hydrogen;

$$A^1{=}L^1{-}(L^2{=}L^3)_n{-}A^2 \qquad \text{formula (III)}$$

wherein, in formula (III), $A^1$ and $A^2$ each represent an acidic nucleus, $L^1$, $L^2$ and $L^3$ each represent a methine group, and n is 1 or 2, provided that the compound represented by formula (III) possesses 1 to 7 groups selected from the group consisting of a carboxylic acid group, a sulfonamido group, a sulfamoyl group, a sulfonylcarbonyl group, an acylsulfamoyl group and a phenolic hydroxyl group as the group having a dissociable hydrogen in its molecule, and an enol group of an oxonol dye as a dissociable hydrogen;

<3> The silver halide color photographic light-sensitive material according to the above <1> or <2>, wherein the solid fine-particle dispersion of the dye is prepared through a heat treating step carried out at 40° C. or higher.

<4> The silver halide color photographic light-sensitive material according to any one of the above <1> to <3>, wherein the magenta color-forming silver halide emulsion layer containing at least one magenta dye-forming coupler selected from the compounds represented by formula (M-I) contains a high-boiling point organic solvent and a coupler and the content of the high-boiling point organic solvent in the magenta color-forming silver halide emulsion layer is 1.5 or less in terms of mass ratio to the total amount of the coupler.

<5> The silver halide color photographic light-sensitive material according to any one of the above <1> to <4>, wherein the content of said dye in the non-color-forming hydrophilic colloidal layer containing the solid fine-particle dispersion of the dye is 35 mass % or less, to the hydrophilic colloid.

Hereinafter, the silver halide color photographic light-sensitive materials described in the above <1> to <5> are referred to as the first embodiment of the present invention.

<6> A silver halide color photographic light-sensitive material for cinema comprising at least one yellow color-forming light-sensitive silver halide emulsion layer, at least one magenta color-forming light-sensitive silver halide emulsion layer, at least one cyan color-forming light-sensitive silver halide emulsion layer, and at least one non-light-sensitive non-color-forming hydrophilic colloidal layer, on a support, wherein the content of silver chloride of light-sensitive silver halide particles contained in said yellow color-forming light-sensitive silver halide emulsion layer, magenta color-forming light-sensitive silver halide emulsion layer and cyan color-forming light-sensitive silver halide emulsion layer is 95 mol % or more, the total amount of silver to be applied is 1.7 g/m$^2$ or less, the thickness of a film on the side provided with a layer containing the light-sensitive silver halide on the support is 12.0 $\mu$m or less, and the swelling rate to water is 200% or less.

<7> The silver halide color photographic light-sensitive material for cinema according to the above <6>, wherein the light-sensitive silver halide particles each contain an iridium compound in an amount of $1.0\times10^{-8}$ mol/silver-mol or more and $5.0\times10^{-6}$ mol/silver-mol or less.

<8> The silver halide color photographic light-sensitive material for cinema according to the above <6> or <7>, wherein at least one of the light-sensitive silver halide emulsion layers contains tabular light-sensitive silver halide particles each having a {100} plane as its principal plane and an aspect ratio of 2 or more.

<9> The silver halide color photographic light-sensitive material for cinema according to the above <8>, wherein the layer containing tabular light-sensitive silver halide particles having a {100} plane as its principal plane and an aspect ratio of 2 or more, is the yellow color-forming light-sensitive silver halide emulsion layer.

<10> The silver halide color photographic light-sensitive material for cinema according to the above <6>, <7>, <8> or <9>, wherein at least one of the non-light-sensitive hydrophilic colloidal layers contains a solid fine-particle dispersion of a dye represented by the above-described formula (I).

<11> The silver halide color photographic light-sensitive material for cinema according to the above <6>, <7>, <8>, <9> or <10>, wherein the maximum density of neutral gray consisting of yellow color density, magenta color density and cyan color density, obtained after a development process, is 3.3 or more.

<12> A method of forming an image with a silver halide color photographic light-sensitive material for cinema, the method comprising exposing the silver halide color photographic light-sensitive material for cinema according to any one of the above <6>to <11>, and subjecting the exposed light-sensitive material to development processing with a color development time of 2 minutes and 30 seconds or less.

Hereinbelow, the silver halide color photographic light-sensitive materials for cinema described in the above <6> to <11>, and the image-forming method with the silver halide color photographic light-sensitive material for cinema described in the above <12> are collectively referred to as the second embodiment of the present invention.

Herein, the present invention means to include both the first embodiment and the second embodiment, unless otherwise specified.

The present invention will be hereinafter explained in detail.

In one aspect, the present invention relates to techniques to attain rapid processing suitability.

In the ECP-2 process, concerning a process of processing color light-sensitive materials for movies, especially positive films, which is published from Eastman Kodak, the following procedures are recommended: development: 3 minutes at 36.7° C., first fixing: 40 seconds at 27° C., the successive water washing step: 40 seconds at 27° C., water washing time after sound development: 1 minute at 27° C., and drying: 3 to 5 minutes at 57° C.

In regard to the recommended value in the development step, development temperature has been frequently raised by a certain degrees of Celsius to shorten processing time. However, the rise in temperature produces such an adverse effect as to accelerate the deterioration of a developing solution. In the present invention which relates to a technique to accelerate the development progress very much as will be mentioned later, the development processing time can be reduced, with little raising of development temperature and hence without inducing deterioration of the developing solution. Process time in each of the fixing step and the drying step can be likewise reduced.

Especially, the second embodiment of the present invention provides excellent characteristics such as high image quality, excellent graininess, high sharpness and rapid processing suitability.

The silver halide color photographic light-sensitive material of the present invention will be hereinafter explained in detail.

First, the compound represented by the above formula (M-I) will be explained in detail.

$R_1$, $R_2$, $R_3$ and $R_4$ in the above formula (M-I) represent a hydrogen atom or a substituent. Examples of the substituent include a halogen atom, aliphatic group, aryl group, heterocyclic group, cyano group, hydroxy group, nitro group, carboxy group, sulfo group, amino group, alkoxy group, aryloxy group, acylamino group, alkylamino group, anilino group, ureido group, sulfamoylamino group, alkylthio group, arylthio group, alkoxycarbonylamino group, sulfonamido group, carbamoyl group, sulfamoyl group, sulfonyl group, alkoxycarbonyl group, heterocyclic oxy group, azo group, acyloxy group, carbamoyloxy group, silyloxy group, aryloxycarbonylamino group, imido group, heterocyclic thio group, sulfinyl group, phosphonyl group, aryloxycarbonyl group, acyl group and azolyl group. Among these groups, a group which may have a further substituent may be substituted with the above substituent.

To state in more detail, specific examples of the substituent include a halogen atom (e.g., a chlorine atom and bromine atom), an aliphatic group (e.g., straight chain or branched alkyl groups, aralkyl groups, alkenyl groups, alkinyl groups, cycloalkyl groups and cycloalkenyl groups having 1 to 32 carbon atoms, more concretely, a methyl group, ethyl group, propyl group, isopropyl group, tert-butyl group, tridecyl group, 2-methanesulfonylethyl group, 3-(3-pentadecylphenoxy)propyl group, 3-{4-{2-[4-(4-hydroxyphenylsulfonyl)phenoxy]dodecanamido}phenyl}-propyl group, 2-ethoxytridecyl group, trifluoromethyl group, cyclopentyl group, 3-(2,4-di-tert-amylphenoxy) propyl group), an aryl group (e.g., a phenyl group, 4-tert-butylphenyl group, 2,4-di-tert-amylphenyl group, 2,4,6-trimethylphenyl group, 3-tridecaneamido-2,4,6-trimethylphenyl group, 4-tetradecaneamidophenyl group and tetrafluorophenyl group), a heterocyclic group (e.g., 2-furyl group, 2-thienyl group, 2-pyrimidinyl group and 2-benzothiazolyl group), a cyano group, a hydroxy group, a nitro group, a carboxy group, a sulfo group, an amino group, an alkoxy group (e.g., a methoxy group, ethoxy group, 2-methoxyethoxy group, 2-dodecylethoxy group and 2-methanesulfonylethoxy group), an aryloxy group (e.g., a phenoxy group, 2-methylphenoxy group, 4-tert-butylphenoxy group, 3-nitrophenoxy group, 3-tert-butoxycarbamoylphenoxy group and 3-methoxycarbamoylphenoxy group), an acylamino group (e.g., an acetamido group, benzamido group, tetradecanamido group, 2-(2,4-di-tert-amylphenoxy)butanamido group, 4-(3-tert-butyl-4-hydroxyphenoxy)butanamido group and 2-[4-(4-hydroxyphenylsulfonyl)phenoxy]decanamido group), an alkylamino group (e.g., a methylamino group, butylamino group, dodecylamino group, diethylamino group and methylbutylamino group), an anilino group (e.g., a phenylamino group, 2-chloroanilino group, 2-chloro-5-tetradecanaminoanilino group, 2-chloro-5-dodecyloxycarbonylanilino group, N-acetylanilino group and 2-chloro-5-[2-(3-tert-butyl-4-hydroxyphenoxy) dodecanamido]anilino group), a carbamoylamino group (e.g., an N-phenylcarbamoylamino group, N-methylcarbamoylamino group and N,N-dibutylcarbamoylamino group), a sulfamoylamino group (e.g., an N,N-dipropylsulfamoylamino group and N-methyl-N-decylsulfamoylamino group), an alkylthio group (e.g., a methylthio group, octylthio group, tetradecylthio group, 2-phenoxyethylthio group, 3-phenoxypropylthio group and 3-(4-tert-butylphenoxy)propylthio group), an arylthio group (e.g., a phenylthio group, 2-butoxy-5-tert-octylphenylthio group, 3-pentadecylphenylthio group, 2-carboxyphenylthio group and 4-tetradecanamidophenylthio group), an alkoxycarbonylamino group (e.g., a methoxycarbonylamino group and tetradecyloxycarbonylamino group), a sulfonamido group (e.g., a methanesulfonamido group, hexadecanesulfonamido group, benzenesulfonamido group, p-toluenesulfonamido group, octadecanesulfonamido group and 2-methoxy-5-tert-butylbenzenesulfonamido group), a carbamoyl group (e.g., an N-ethylcarbamoyl group, N,N-dibutylcarbamoyl group, N-(2-dodecyloxyethyl)carbamoyl group, N-methyl-N-dodecylcarbamoyl group and N-[3-(2,4-di-tert-amylphenoxy)propyl]carbamoyl group), a sulfamoyl group (e.g., an N-ethylsulfamoyl group, N,N-dipropylsulfamoyl group, N-(2-dodecyloxyethyl)sulfamoyl group, N-ethyl-N-dodecylsulfamoyl group and N,N-diethylsulfamoyl group), a sulfonyl group (e.g., a methanesulfonyl group, octanesulfonyl group, benzenesulfonyl group and toluenesulfonyl group), an alkoxycarbonyl group (e.g., a methoxycarbonyl group, butoxycarbonyl group, dodecyloxycarbonyl group and octadecyloxycarbonyl group), a heterocyclic oxy group (e.g., a 1-phenyltetrazole-5-oxy group and 2-tetrahydropyranyloxy group), an azo group (e.g., a phenylazo group, 4-methoxyphenylazo group, 4-pivaloylaminophenylazo group, and 2-hydroxy-4-propanoylphenylazo group), an acyloxy group (e.g., an acetoxy group), a carbamoyloxy group (e.g., an N-methylcarbamoyloxy group and N-phenylcarbamoyloxy group), a silyloxy group (e.g., a trimethylsilyloxy group and dibutylmethylsilyloxy group), an aryloxycarbonylamino group (e.g., a phenoxycarbonylamino group), an imido group (e.g., an N-succinimido group, N-phthalimido group and 3-octadecenylsuccinimido group), a heterocyclic thio group (e.g., a 2-benzothiazolylthio group, 2,4-di-phenoxy-1,3,5-triazole-6-thio group and 2-pyridylthio group), a sulfinyl group (e.g., a dodecanesulfinyl group, 3-pentadecylphenylsulfinyl group and 3-phenoxypropylsulfinyl group), a phosphonyl group (e.g., a phenoxyphosphonyl group, octylphosphonyl group and phenylphosphonyl group), an aryloxycarbonyl group (e.g., a phenoxycarbonyl group), an acyl group (e.g., an acetyl group, 3-phenylpropanoyl group, benzoyl group and 4-dodecyloxybenzoyl group), an azolyl group (an imidazolyl group, pyrazolyl group, 3-chloro-pyrazole-1-yl group and triazolyl group).

Examples of preferable substituent among these substituents may include alkyl groups, cycloalkyl groups, aryl groups, alkoxy groups, aryloxy groups, alkylthio groups, carbamoylamino groups, aryloxycarbonylamino groups, alkoxycarbonylamino groups, alkylacylamino groups and arylacylamino groups.

X represents a hydrogen atom or a group capable of being split-off upon a reaction with an oxidized product of an aromatic primary amine color-developing agent. To mention the group capable of being split-off in detail, examples of the group may include a halogen atom, alkoxy group, aryloxy group, acyloxy group, alkyl- or aryl-sulfonyloxy group, acylamino group, alkyl- or aryl-sulfonamido group, alkoxycarbonyloxy group, aryloxycarbonyloxy group, alkyl-, aryl- or heterocyclic-thio group, carbamoylamino group, five- or six-membered nitrogen-containing heterocyclic group, imido group and arylazo group. These groups may further be substituted with a group permitted as the substituent of $R_1$ to $R_4$.

Specific examples of X may include a halogen atom (e.g., a fluorine atom, chlorine atom and bromine atom), an alkoxy group (e.g., an ethoxy group, dodecyloxy group, methoxyethylcarbamoylmethoxy group, carboxypropyloxy group, methylsulfonylethoxy group and ethoxycarbonylmethoxy group), an aryloxy group (e.g., a 4-methylphenoxy group, 4-chlorophenoxy group, 4-methoxyphenoxy group, 4-carboxyphenoxy group, 3-ethoxycarboxyphenoxy group, 4-methoxycarbonylphenoxy group, 3-acetylaminophenoxy group and 2-carboxyphenoxy group), an acyloxy group (e.g., an acetoxy group, tetradecanoyloxy group and benzoyloxy group), an alkyl- or arylsulfonyloxy group (e.g., a methanesulfonyloxy group and toluenesulfonyloxy group), an acylamino group (e.g., a dichloroacetylamido group and heptafluorobutyrylamino group), an alkyl- or arylsulfonamido group (e.g., a methanesulfonamino group, trifluoromethanesulfonamino group and p-toluenesulfonylamino group), an alkoxycarbonyloxy group (e.g., an ethoxycarbonyloxy group and benzyloxycarbonyloxy group), an aryloxycarbonyloxy group (e.g., a phenoxycarbonyloxy group), an alkyl-, aryl- or heterocyclic-thio group (e.g., a dodecylthio group, 1-carboxydodecylthio group, phenylthio group, 2-butoxy-5-tert-octylphenylthio group, 2-benzyloxycarbonylaminophenylthio group and tetrazolylthio group), a carbamoylamino group (e.g., an N-methylcarbamoylamino group and N-phenylcarbamoylamino group), a five- or six-membered nitrogen-containing heterocyclic group (e.g., a 1-imidazolyl group, 1-pyrazolyl group, 1,2,4-triazole-1-yl group, tetrazolyl group, 3,5-dimethyl-1-pyrazolyl group, 4-cyano-1-pyrazolyl group, 4-methoxycarbonyl-1-pyrazolyl group, 4-acetylamino-1-pyrazolyl group and 1,2-dihydro-2-oxo-1-pyridyl group), an imido group (e.g., a succinimido group and hydantoinyl group), and an arylazo group (e.g., a phenylazo group and 4-methoxyphenylazo group). Preferable examples of X include halogen atoms, alkoxy groups, aryloxy groups, alkyl- or aryl-thio group, five- or six-membered nitrogen-containing heterocyclic groups bonded to a coupling active site by a nitrogen atom. Particularly preferable examples are halogen atoms, substituted aryloxy groups, substituted arylthio groups or substituted 1-pyrazolyl group.

Given as examples of preferable magenta couplers among the compounds represented by the aforementioned formula (M-I) are compounds represented by the following formula (M-II) or (M-III), with the compounds represented by the formula (M-II) being particularly preferable.

formula (M-II)

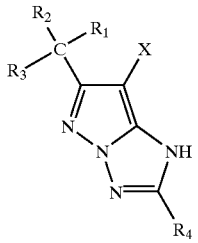

formula (M-III)

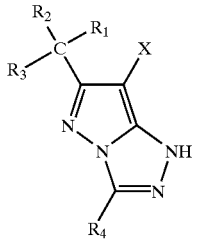

In the formulae (M-II) and (M-III), $R_1$, $R_2$, $R_3$ and $R_4$ have the same meanings as described in the above.

Preferable examples as the groups in the above formulae (M-II) and (M-III) are as follows.

Given as preferable groups as X are halogen atoms, alkoxy groups and aryloxy groups. Among these groups, a chlorine atom is desirable.

As preferable examples of the substituents as $R_1$ to $R_4$, alkyl groups, aryl groups, anilino groups and alkoxy groups are given. Among these groups, alkyl groups and aryl groups are preferable. Further, groups having a branched alkyl portion or a 1,2-cyclohexylene group in a partial structure of each of $R_1$ to $R_4$ are preferable. In the present invention, it is preferable that $R_1$, $R_2$ and $R_3$ respectively be a methyl group and $R_4$ be alkyl group or an aryl group. As $R_4$, an alkyl group or aryl group having a branched alkyl portion or a 1,2-cyclohexylene group as a part of the substituent or in a partial structure is more preferable. The most preferable examples of $R_4$ are an aryl group (more preferable is an aryl group having the aforementioned substituent or partial structure) in the above formula (M-II), and an alkyl group in the above formula (M-III). As the alkyl group of $R_4$ in the formula (M-III), a secondary or tertiary alkyl is preferable in consideration of the fastness and color-forming property of the resulting dye, and a tertiary alkyl is more preferable. Moreover, a 1,1,2-tri-substituted- or 1,1,2,2-tetra-substituted ethylene group is preferable.

The magenta coupler for use in the present invention is used in an amount ranging generally between 0.001 and 1 mol, and preferably 0.002 and 0.4 mols, to one mol of a light sensitive silver halide in the same layer. The molecular weight of the coupler is preferably 600 or less.

Specific examples (M-1 to M-66) of the magenta coupler represented by the above formula (M-I) will be shown below, which, however, are not intended to be limiting of the present invention.

(M-1)
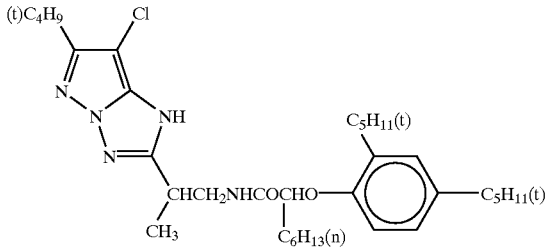
(M-2)
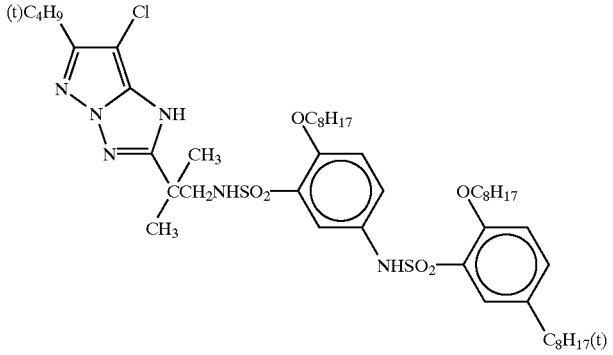
(M-3)
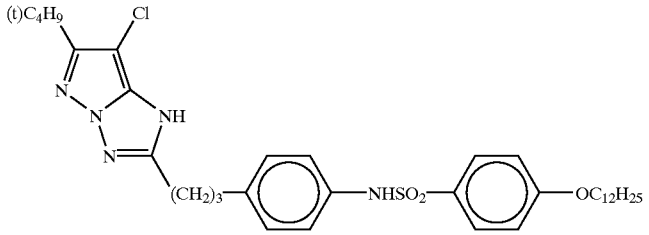
(M-4)
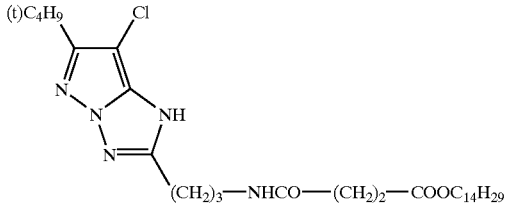
(M-5)
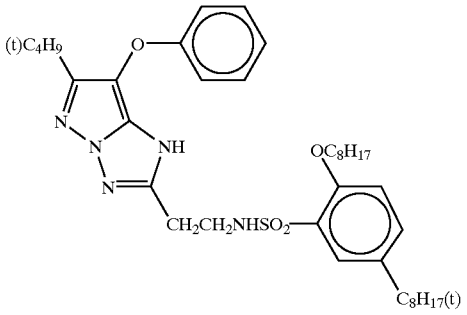
(M-6)
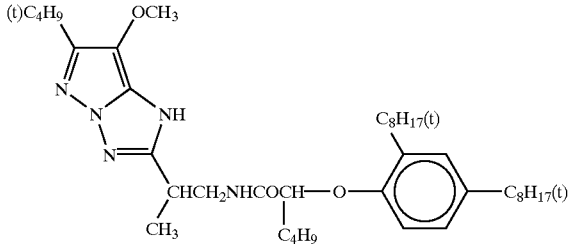

-continued
(M-7)
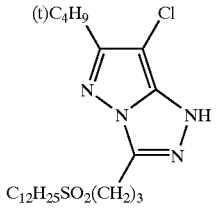
(M-8)
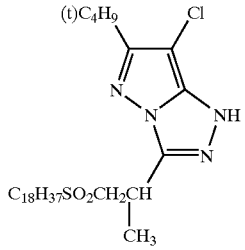
(M-9)
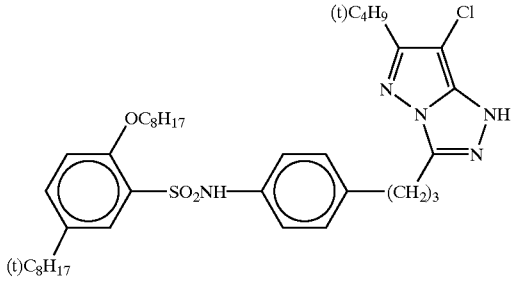
(M-10)
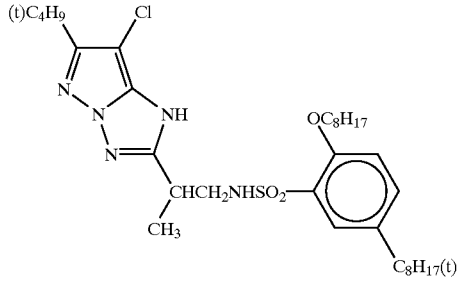
(M-11)
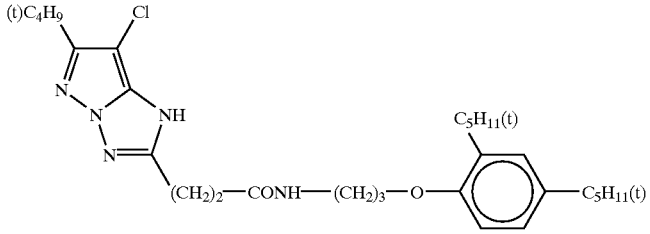
(M-12)
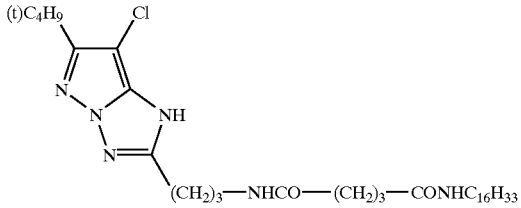
(M-13)
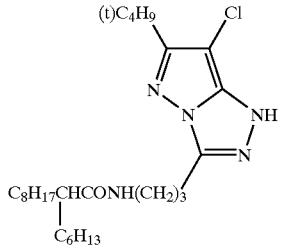
(M-14)
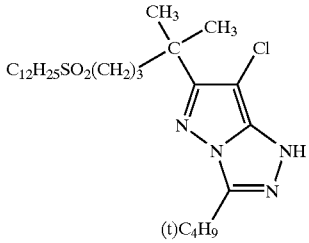
(M-15)
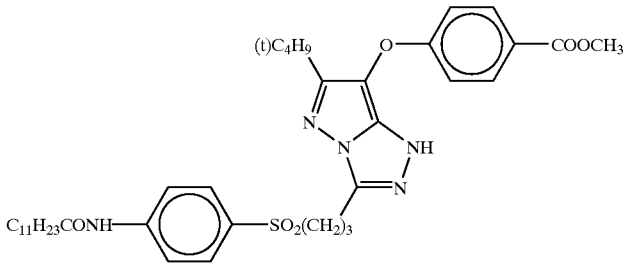

-continued
(M-16)
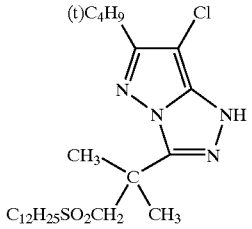
(M-17)
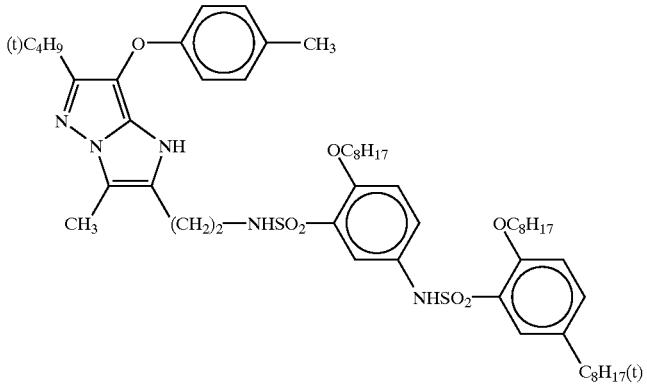
(M-18)
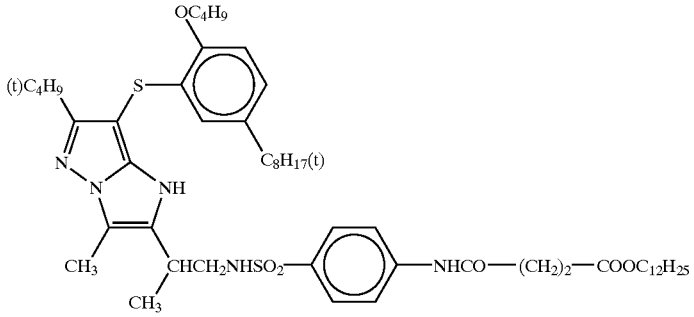
(M-19)
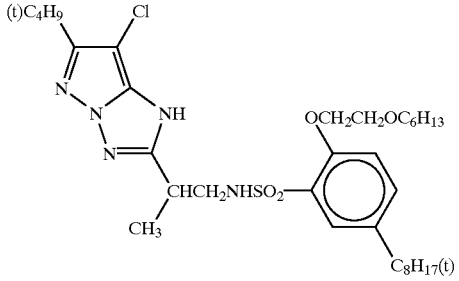
(M-20)
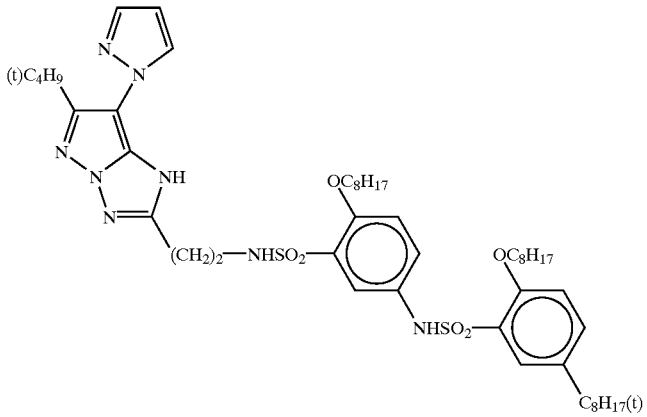

-continued
(M-21)
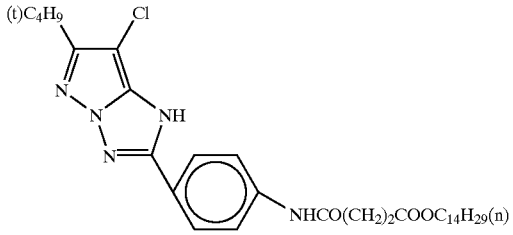
(M-22)
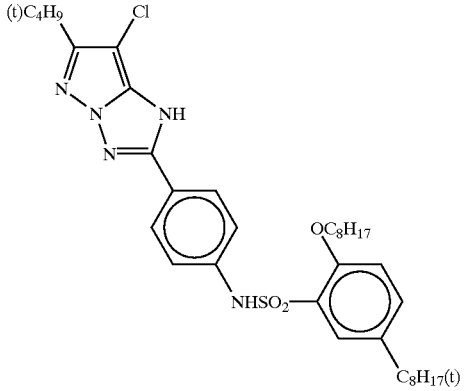
(M-23)
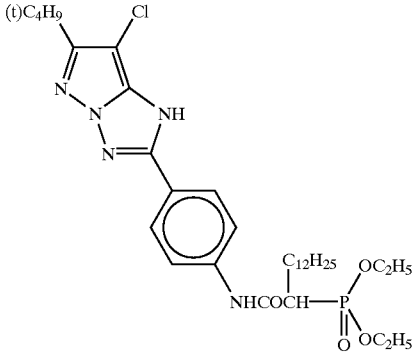
(M-24)
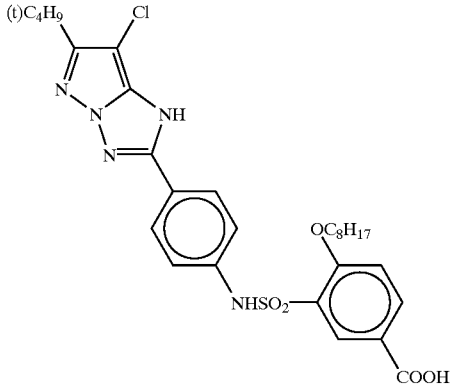
(M-25)
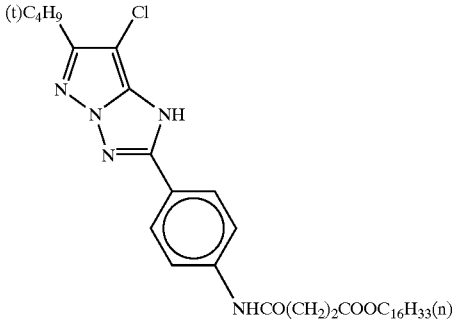
(M-26)
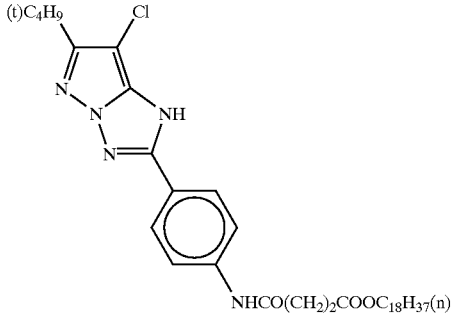

-continued
(M-27)
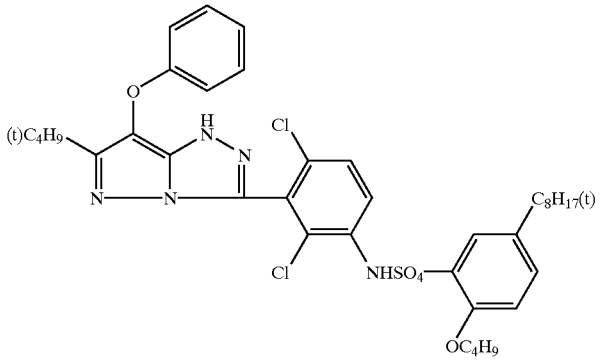
(M-28)
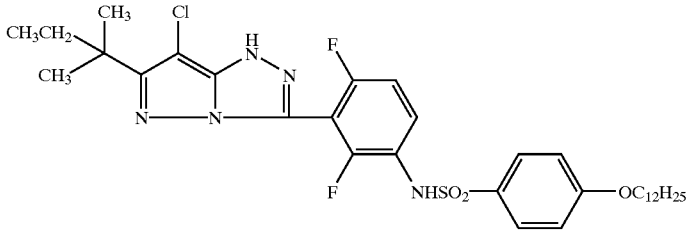
(M-29)
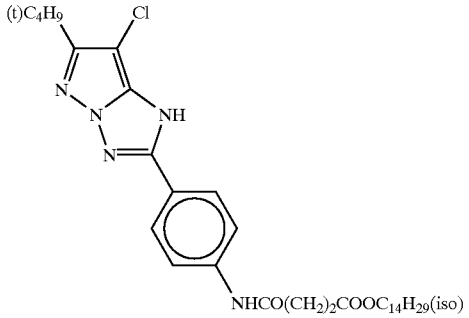
(M-30)
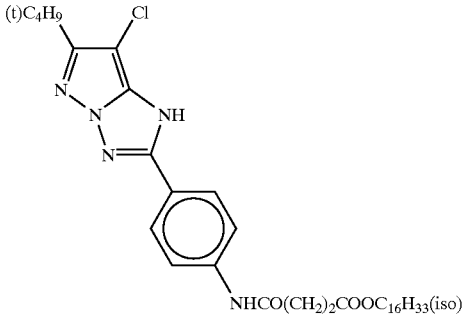
(M-31)
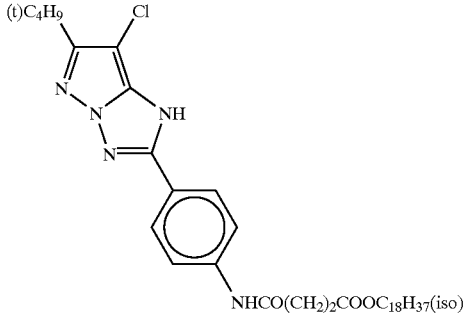
(M-32)
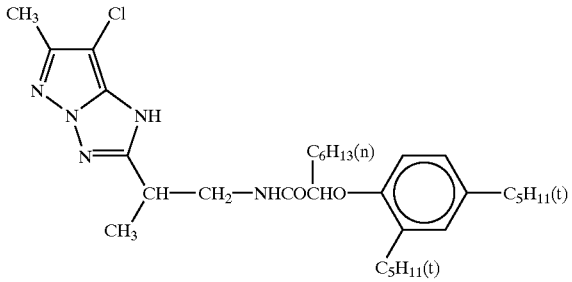

-continued
(M-33)
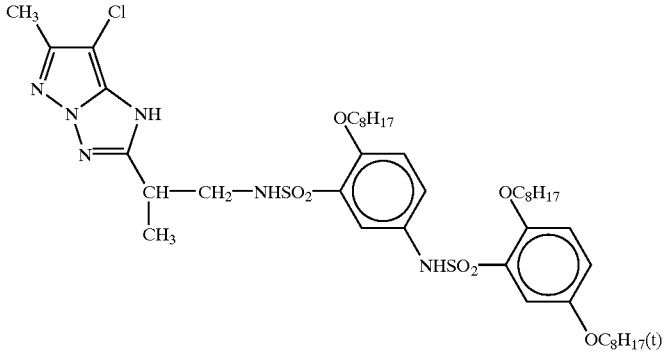
(M-34)
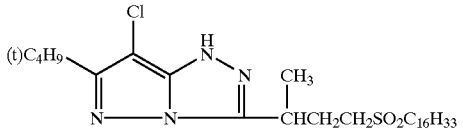
(M-35)
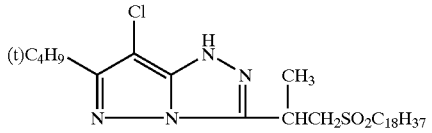
(M-36)
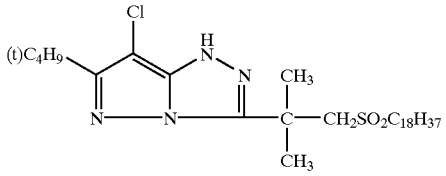
(M-37)
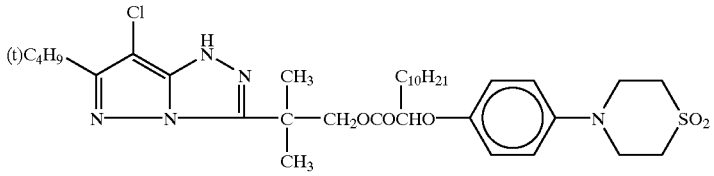
(M-38)
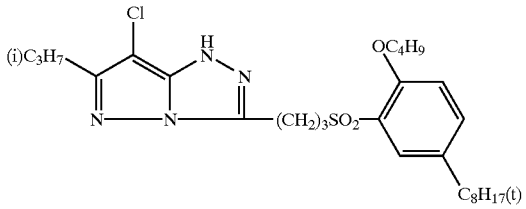
(M-39)
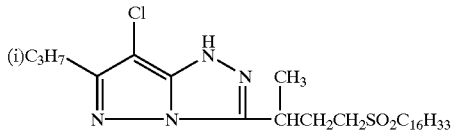
(M-40)
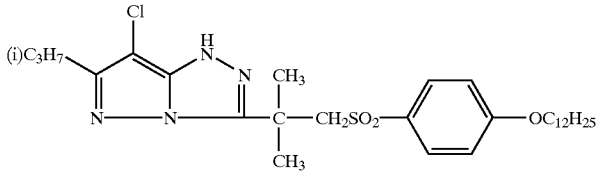
(M-41)
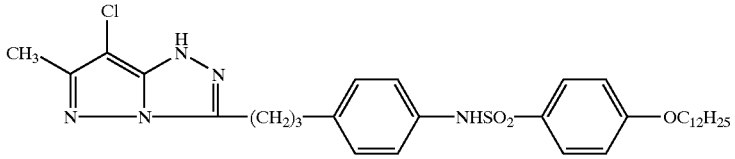

-continued
(M-42)
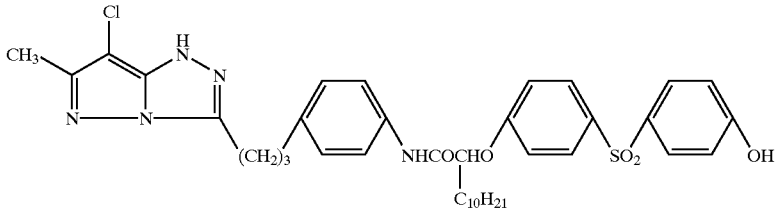
(M-43)
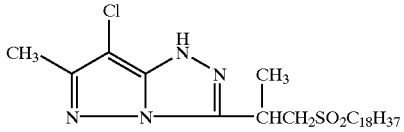
(M-44)
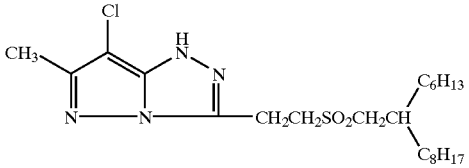
(M-45)
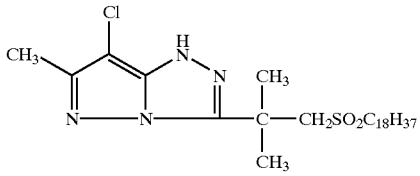
(M-46)
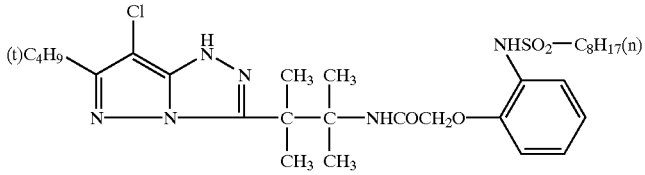
(M-47)
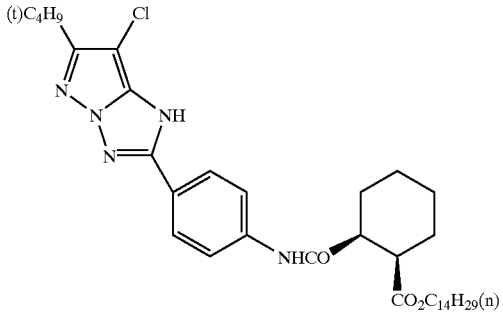
(M-48)
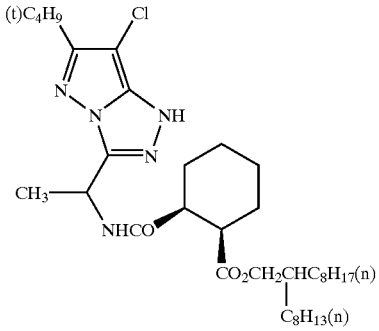
(M-49)
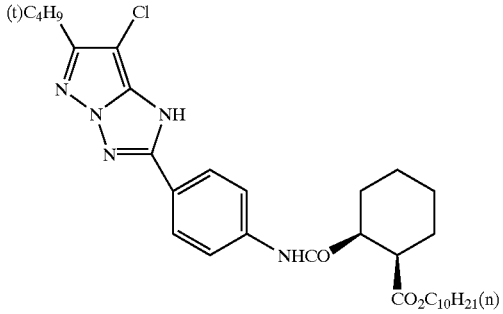

-continued
(M-50)
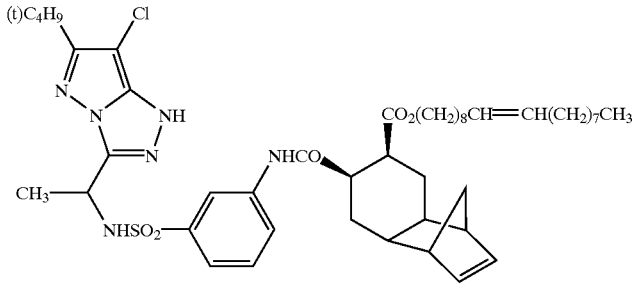
(M-51)
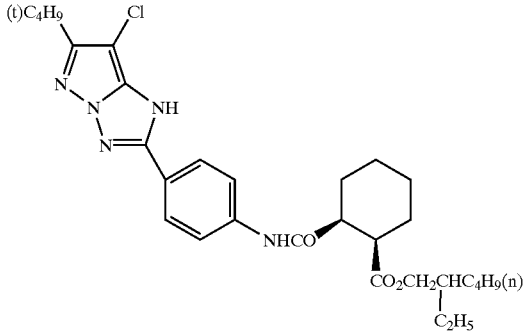
(M-52)
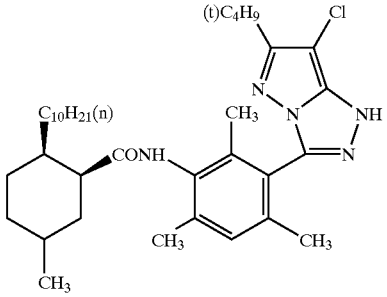
(M-53)
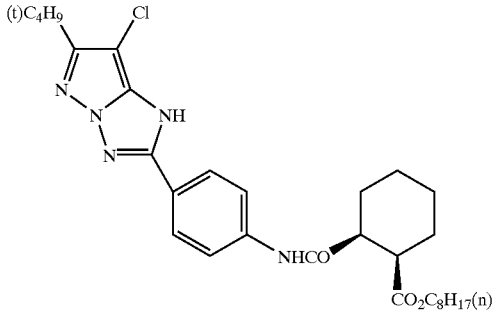
(M-54)
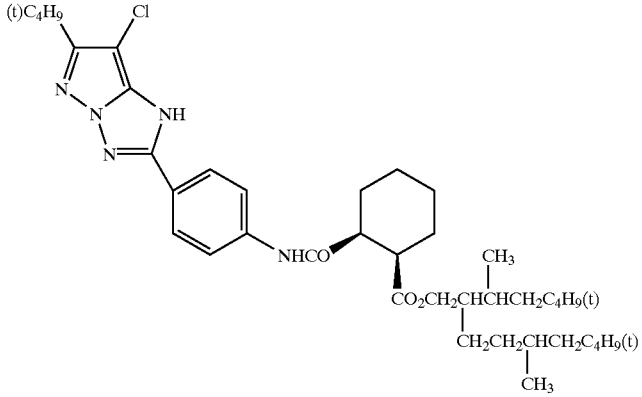

-continued
(M-55)
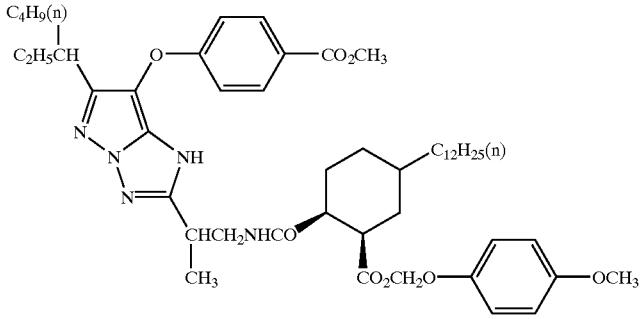
(M-56)
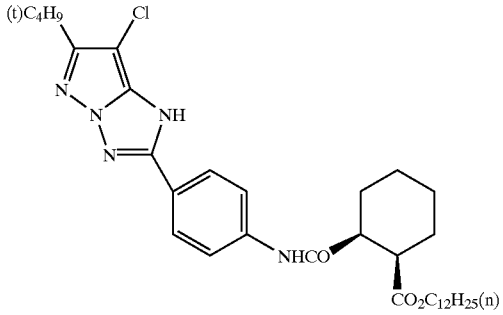
(M-57)
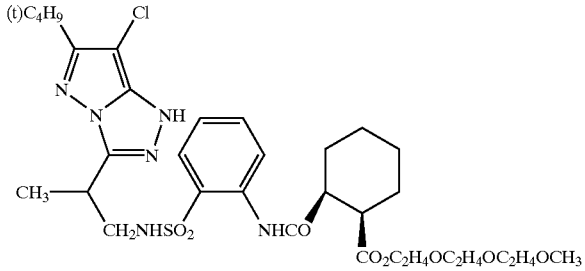
(M-58)
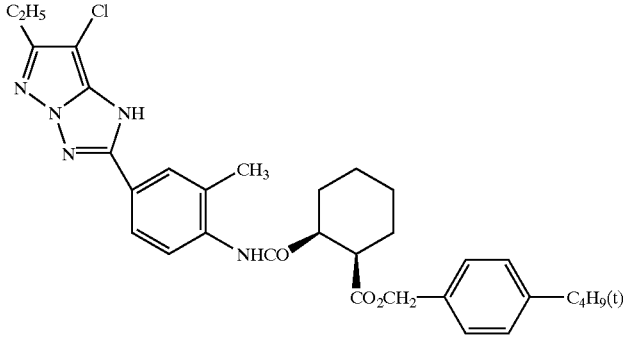
(M-59)
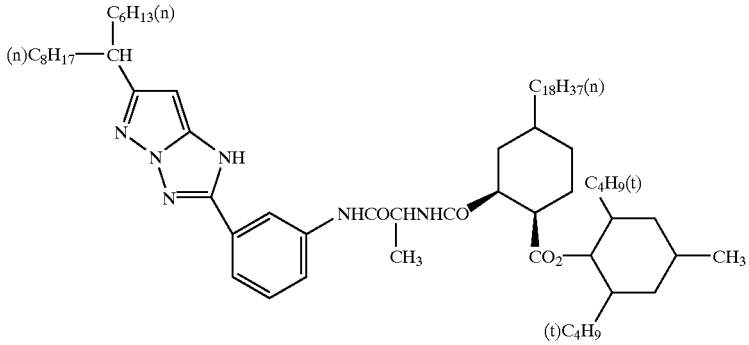

-continued
(M-60)
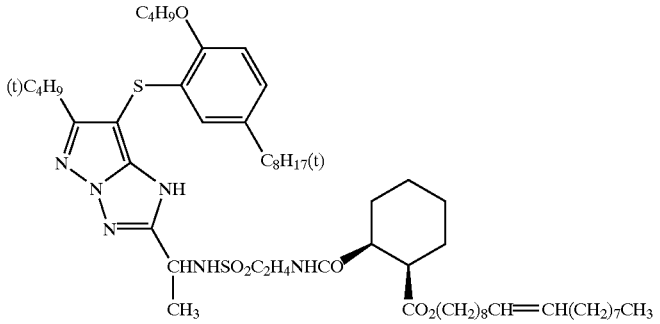
(M-61)
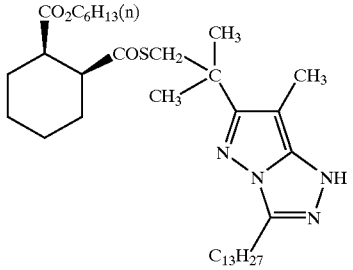
(M-62)
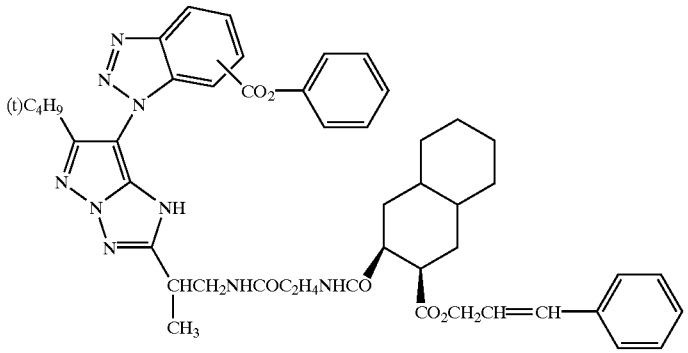
(M-63)
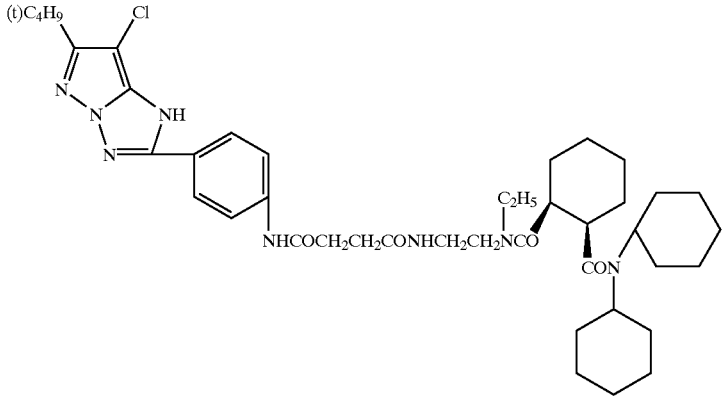

-continued (M-64)

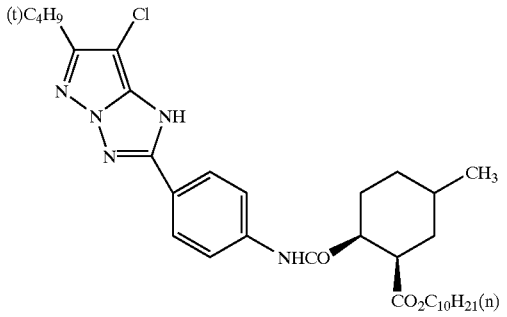

(M-65)

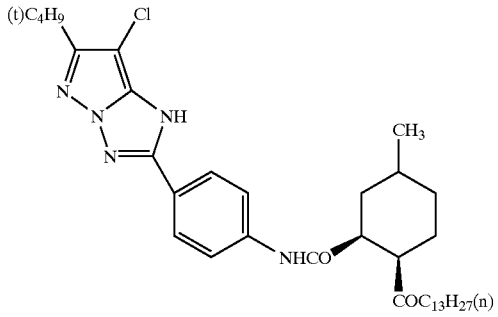

(M-66)

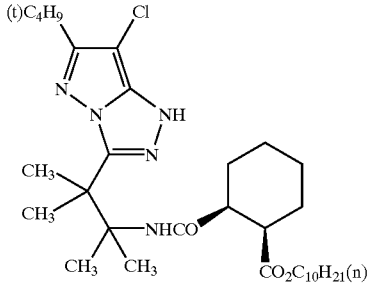

In the present invention, the high-boiling-point organic solvent means those which have a boiling point of 175° C. or higher at normal pressure and are used in an oil droplet-in-water dispersion method and the like. As specific examples of the organic solvent, the compounds represented by one of the formulae (A) to (E) and exemplified compounds (P-1) to (P-96) of these compounds which are described in JP-A-62-215272, from page 137, left lower column, line 9, to page 144, right upper column, the last line, are preferable. The above range of the description in JP-A-62-215272 is incorporated herein as a part of the specification of the present invention.

In light of the effect of the present invention, the amount of the high-boiling point organic solvent used in the emulsion layer containing the coupler represented by the formula (M-I) is generally 1.5 or less, preferably 1.5 to 0.0, more preferably 1.3 to 0.1, and still more preferably 1.2 to 0.15, in terms of mass ratio to the total amount of the coupler contained in the emulsion layer.

Solid fine-particle dispersions of the dye represented by the formula (I) tend to stay in the hydrophilic colloid layer and also tend to elute during processing, and hence enables compatibility of the improvement in sharpness with a reduction in coloring to a white ground and have high stability with the lapse of time in the hydrophilic colloidal layer.

Next, the dye represented by the formula (I) will be explained.

In the formula (I), D represents a group to give a compound having a chromophore, X represents a dissociable hydrogen or a group having a dissociable hydrogen, and y denotes an integer from 1 to 7. The dye represented by the above formula (I) is characterized by the point that it has a dissociable hydrogen in its molecular structure.

The group to give a compound having a chromophore (D) may be selected from many well-known dyes.

Examples of the compound include oxonol dyes, merocyanine dyes, cyanine dyes, allylidene dyes, azomethine dyes, triphenylmethane dyes, azo dyes, anthraquinone dyes and indoaniline dyes.

X represents a dissociable hydrogen or a group having a dissociable hydrogen which is bonded to D directly or through a divalent linking group.

The divalent linking group disposed between X and D is a divalent group including an alkylene group, allylene group, heterocyclic residue, —CO—, —$SO_n$— (n=0, 1 or 2), —NR— (R represents a hydrogen atom, an alkyl group or an aryl group) and —O— and combinations of these linking groups. Further, these groups may have a substituent, such as an alkyl group, aryl group, alkoxy group, amino group, acylamino group, halogen atom, hydroxyl group, carboxy group, sulfamoyl group, carbamoyl group or sulfonamido group. Given as preferable examples of the divalent connecting group are —$(CH_2)_n$— (n=1, 2 or 3), —$CH_2CH(CH_3)CH_2$—, 1,2-phenylene, 5-carboxy-1,3-phenylene, 1,4-phenylene, 6-methoxy-1,3-phenylene and —$CONHC_6H_4$—.

The dissociable hydrogen or the group having a dissociable hydrogen represented by X is non-dissociable and has such characteristics that it makes the dye represented by the formula (I) substantially water-insoluble, in such a condition that the dye represented by the above formula (I) is added in the silver halide photographic light-sensitive material of the present invention. In a step of developing the light-sensitive material, the hydrogen or group represented by X has also such characteristics that it dissociates and makes the dye represented by the formula (I) substantially water-soluble. Given as examples of the group having a dissociable hydrogen represented by X are groups having a carboxylic acid group, sulfonamido group, sulfamoyl group, sulfonylcarbamoyl group, acylsulfamoyl group or phenolic hydroxyl group. Examples of dissociable hydrogen represented by X include hydrogen of an enol group of an oxonol dye.

A preferable range of y is from 1 to 5 and particularly preferably from 1 to 3.

Preferable examples among the compounds represented by the above formula (I) are those in which the group X having a dissociable hydrogen has a carboxylic acid group. Particularly, compounds having an aryl group substituted with a carboxyl group are preferred.

A more preferable one among the dyes represented by the above formula (I) is a compound represented by the following formula (II) or (III).

Formula (II)

$$A^1{=}L^1{-}(L^2{=}L^3)_m{-}Q$$

In the formula (II), $A^1$ represents an acidic nucleus, Q represents an aryl group or a heterocyclic group, $L^1$, $L^2$ and $L^3$ respectively represent a methine group, m denotes 0, 1 or 2, provided that the compound represented by the formula (II) has, in its molecule, 1 to 7 groups (preferably carboxylic acid groups) selected from the group consisting of a carboxylic acid group, sulfonamido group, sulfamoyl group, sulfonylcarbamoyl group, acylsulfamoyl group or phenolic hydroxyl group, as the group having a dissociable hydrogen, and an enol group of an oxonol dye, as a dissociable hydrogen.

Formula (III)

$$A^1{=}L^1{-}(L^2{=}L^3)_n{-}A^2$$

In the formula (III), $A^1$ and $A^2$ respectively represent an acidic nucleus, $L^1$, $L^2$ and $L^3$ respectively represent a methine group, n denotes 0, 1, 2 or 3, provided that the compound represented by the formula (III) has, in its molecule, 1 to 7 groups (preferably carboxylic acid groups) selected from the group consisting of a carboxylic acid group, sulfonamido group, sulfamoyl group, sulfonylcarbamoyl group, acylsulfamoyl group or phenolic hydroxyl group, as the group having a dissociable hydrogen, and an enol group of an oxonol dye, as a dissociable hydrogen.

The above formulae (II) and (III) will be hereinafter explained in detail.

The acidic nuclei represented by $A^1$ and $A^2$ are preferably those derived from cyclic ketomethylene compounds or compounds having a methylene group sandwiched between electron attractive groups.

Examples of the above cyclic ketomethylene compound may include 2-pyrazoline-5-one, rhodanine, hydantoin, thiohydantoin, 2,4-oxazolidinedione, isooxazolone, barbituric acid, thiobarbituric acid, indandione, dioxopyrazolopyridine, hydroxypyridone, pyrazolidinedione and 2,5-dihydrofuran. These compounds may have a substituent.

The compounds having a methylene group sandwiched by electron attractive groups may be represented by $Z^1CH_2Z^2$. Here, $Z^1$ and $Z^2$ respectively represent —CN, $—SO_2R^{11}$, $—COR^{11}$, $—COOR^{12}$, $—CONHR^{12}$, $—SO_2NHR^{12}$ or $—C[{=}C(CN)_2]R^{11}$. $R^{11}$ represents an alkyl group, an aryl group or a heterocyclic group, or $R^{12}$ represents a hydrogen atom or a group represented by $R^{11}$. These groups each may have a further substituent.

Examples of the aryl group represented by Q include a phenyl group and naphthyl group, which may respectively have a substituent. Examples of the heterocyclic group represented by Q may include pyrrole, indole, furan, thiophene, imidazole, pyrazole, indolizine, quinoline, carbazole, phenothiazine, phenoxazine, indoline, thiazole, pyridine, pyridazine, thiadiazine, pyran, thiopyran, oxodiazole, benzoquinoline, thiadiazole, pyrrolothiazole, pyrrolopyridazine, tetrazole, oxazole, coumarin and coumarone. These each may have a substituent.

The methine group represented by $L^1$, $L^2$ and $L^3$ may have a substituent and these substituents may be connected to each other to form a five- or six-membered ring (e.g., cyclopentene or cyclohexene).

No particular limitation is imposed on the substituent which each of the aforementioned groups may have as far as it does not substantially dissolve the compound represented by any of the above formulae (I) to (III) in water having a pH of 5 to 7. For example, the following substituents are exemplified.

Specifically, examples of the substituent include a carboxylic acid group, a sulfonamido group having 1 to 10 carbon atoms (e.g., a methanesulfonamido group, benzenesulfonamido group, butanesulfonamido group and n-octanesulfonamido group), an unsubstituted, or alkyl- or aryl-substituted sulfamoyl group having 0 to 10 carbon atoms (e.g., an unsubstituted sulfamoyl group, methylsulfamoyl group, phenylsulfamoyl group, naphthylsulfamoyl group and butylsulfamoyl group), a sulfonylcarbamoyl group having 2 to 10 carbon atoms (e.g., a methanesulfonylcarbamoyl group, propanesulfonylcarbamoyl group and benzenesulfonylcarbamoyl group), an acylsulfamoyl group having 1 to 10 carbon atoms (e.g., an acetylsulfamoyl group, propionylsulfamoyl group, pivaloylsulfamoyl group and benzoylsulfamoyl group), a chain or cyclic alkyl group having 1 to 8 carbon atoms (e.g., a methyl group, ethyl group, isopropyl group, butyl group, hexyl group, cyclopropyl group, cyclopentyl group, cyclohexyl group, 2-hydroxyethyl group, 4-carboxybutyl group, 2-methoxyethyl group, benzyl group, pheninetyl group, 4-carboxybenzyl group, and 2-diethylaminoethyl group), an alkenyl group having 2 to 8 carbon atoms (e.g., a vinyl group and allyl group), an alkoxy group having 1 to 8 carbon atoms (e.g., a methoxy group, ethoxy group and butoxy group), a halogen atom (e.g., F, Cl and Br), an amino group having 0 to 10 carbon atoms (e.g., an unsubstituted amino group, dimethylamino group, diethylamino group and carboxyethylamino group), an ester group having 2 to 10 carbon atoms (e.g., a methoxycarbonyl group), an amido group having 1 to 10 carbon atoms (e.g., an acetylamino group and benzamido group), a carbamoyl group having 1 to 10 carbon atoms (e.g., an unsubstituted carbamoyl group, methylcarbamoyl group and ethylcarbamoyl group), an aryl group having 6 to 10 carbon atoms (e.g., a phenyl group, naphthyl group, hydroxyphenyl group, 4-carboxyphenyl group, 3-carboxyphenyl group, 3,5-dicarboxyphenyl group, 4-methanesulfonamidophenyl group and 4-butanesulfonamidophenyl group), an aryloxy group having 6 to 10 carbon atoms (e.g., a phenoxy group, 4-carboxyphenoxy group, 3-methylphenoxy group and naphthoxy group), an alkylthio group having 1 to 8 carbon atoms (e.g., a methylthio group, ethylthio group and octylthio group), an arylthio group having 6 to 10 carbon atoms (e.g., a phenylthio group and naphthylthio group), an acyl group having 1 to 10 carbon atoms (e.g., an acetyl group, benzoyl group and propanoyl group), a sulfonyl group having 1 to 10 carbon atoms (e.g., a methanesulfonyl group and benzenesulfonyl group), a ureide group having 1 to 10 carbon atoms (e.g., a ureide group and methylureide group), a urethane group having 2 to 10 carbon atoms (e.g., a methoxycarbonylamino group and ethoxycarbonylamino group), a cyano group, a hydroxyl group, a nitro group, a heterocyclic group (e.g., 5-carboxybenzooxazole ring, pyridine ring, sulfolane ring, pyrrole ring, pyrrolidine ring, morpholine ring, piperazine ring, pyrimidine ring and furan ring).

More preferable examples among the compounds represented by the above formula (III) are compounds represented by the following formula (IV). The compound represented by the formula (IV) has hydrogen of an enol group as a dissociable hydrogen.

formula (IV)

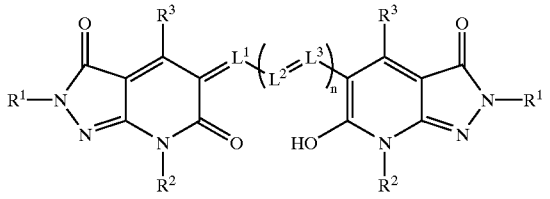

In the formula (IV), $R^1$ represents a hydrogen atom, an alkyl group, an aryl group or a heterocyclic group, $R^2$ represents a hydrogen atom, an alkyl group, an aryl group, a heterocyclic group, —$COR^4$ or $SO_2R^4$, $R^3$ represents a hydrogen atom, a cyano group, a hydroxyl group, a carboxyl group, an alkyl group, an aryl group, —$CO_2R^4$, —$OR^4$, —$NR^5R^6$, —$CONR^5R^6$, —$NR^5COR^4$, —$NR^5SO_2R^4$ or —$NR^5CONR^5R^6$ (in which $R^4$ represents an alkyl group or an aryl group and $R^5$ and $R^6$ respectively represent a hydrogen atom, an alkyl group or an aryl group), $L^1$, $L^2$ and $L^3$ respectively represent a methine group, and n denotes 1 or 2.

In the above formula (IV), examples of the alkyl group as $R^1$ include an alkyl group having 1 to 4 carbon atoms, 2-cyanoethyl group, 2-hydroxyethyl group and carboxybenzyl group. Examples of the aryl group include a phenyl group, 2-methylphenyl group, 2-carboxyphenyl group, 3-carboxyphenyl group, 4-carboxyphenyl group, 3,6-dicarboxyphenyl group, 2-hydroxyphenyl group, 3-hydroxyphenyl group, 4-hydroxyphenyl group, 2-chloro-4-carboxyphenyl group and 4-methylsulfamoylphenyl group. Examples of the heterocyclic group include 5-carboxybenzooxazole-2-yl group.

Examples of the alkyl group as $R^2$ include an alkyl group having 1 to 4 carbon atoms, carboxymethyl group, 2-hydroxyethyl group and 2-methoxyethyl group. Examples of the aryl group include a 2-carboxyphenyl group, 3-carboxyphenyl group, 4-carboxyphenyl group and 3,6-dicarboxyphenyl group. Examples of the heterocyclic group include a pyridyl group. Examples of —$COR^4$ include an acetyl group, and examples of —$SO_2R^4$ include a methanesulfonyl group.

Given as examples of the alkyl group as $R^3$, $R^4$, $R^5$ or $R^6$ are alkyl groups having 1 to 4 carbon atoms. Given as examples of the aryl group as $R^3$, $R^4$, $R^5$ or $R^6$ are a phenyl group and methylphenyl group.

In the present invention, $R^1$ is preferably a phenyl group substituted with a carboxyl group (e.g., a 2-carboxyphenyl group, 3-carboxyphenyl group, 4-carboxyphenyl group and 3,6-dicarboxyphenyl group).

Specific examples of the compounds (I-1 to I-14, II-1 to II-24, III-1 to III-24, and IV-1 to IV-51) represented by any one of the above formulae (I) to (IV) are shown below, which, however, are not intended to be limiting of the present invention.

(I-1)

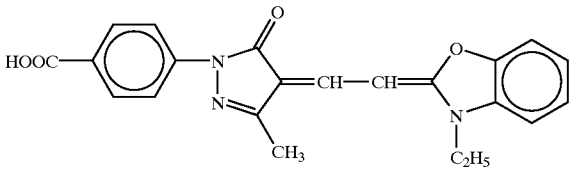

(I-2)

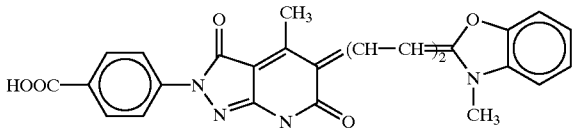

(I-3)

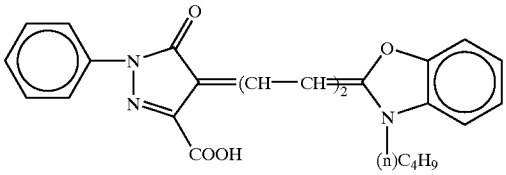

(I-4)

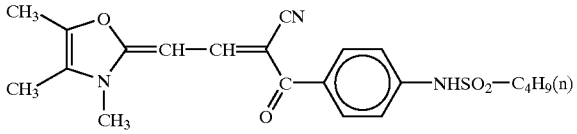

(I-5)

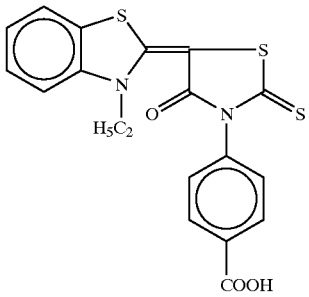

(I-6)

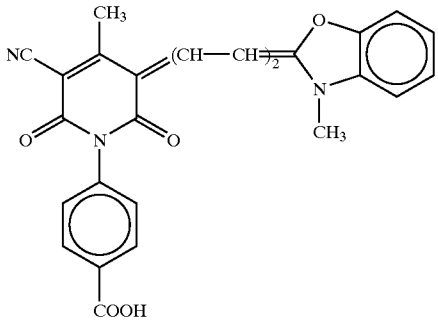

(I-7)

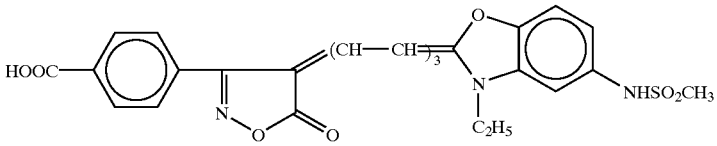

-continued
(I-8)
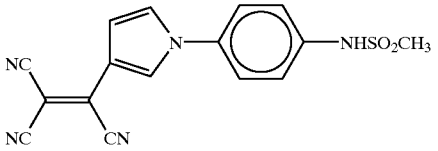
(I-9)
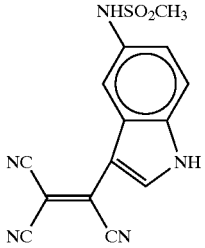
(I-10)
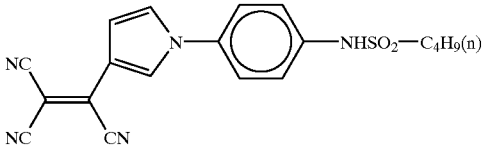
(I-11)
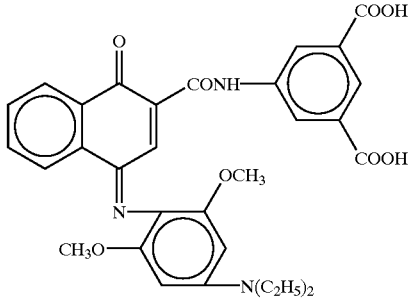
(I-12)
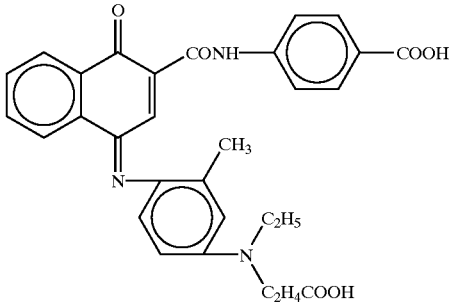
(I-13)
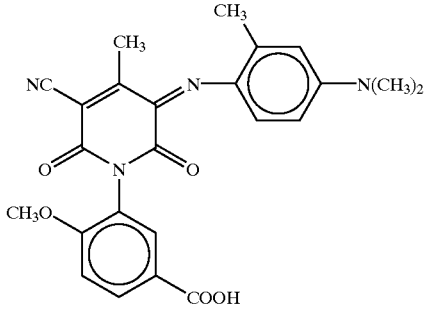
(I-14)
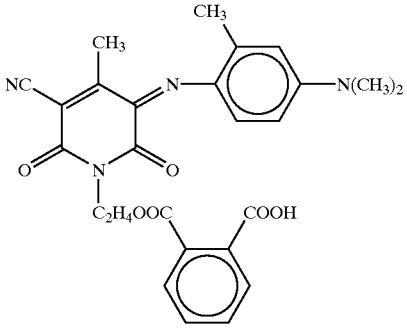
(II-1)
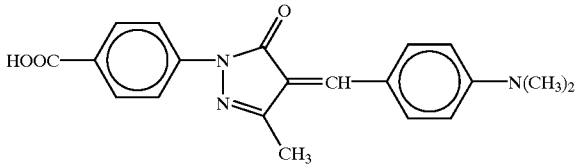
(II-2)
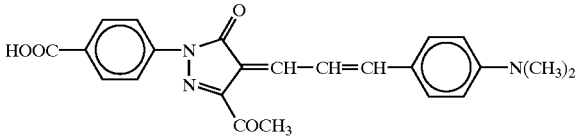
(II-3)
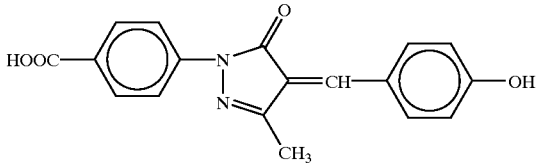

-continued
(II-4)
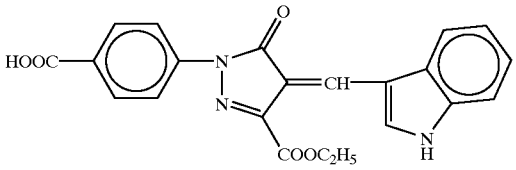
(II-5)
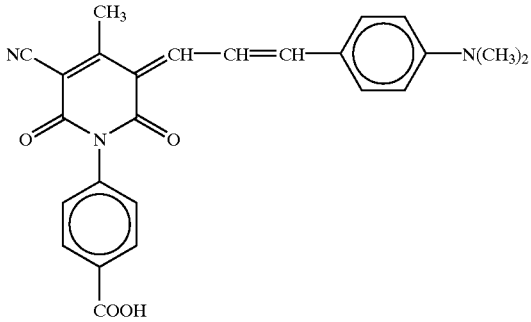
(II-6)
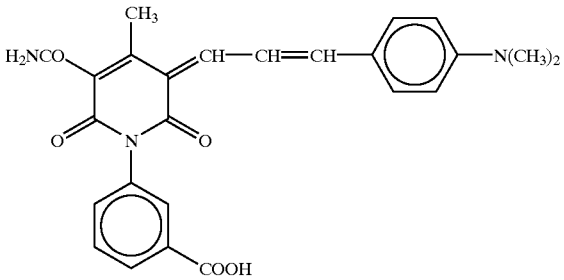
(II-7)
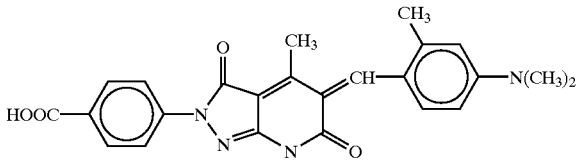
(II-8)
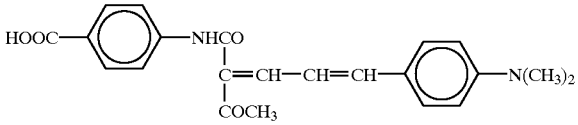
(II-9)
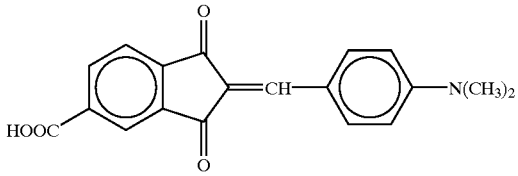
(II-10)
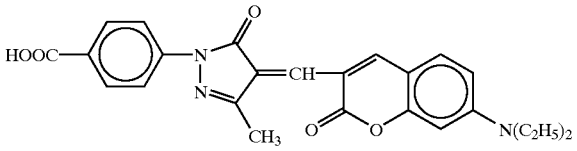
(II-11)
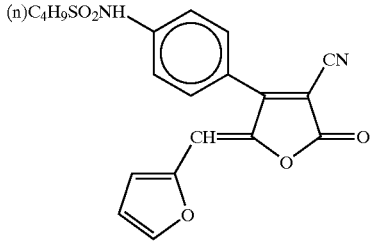
(II-12)
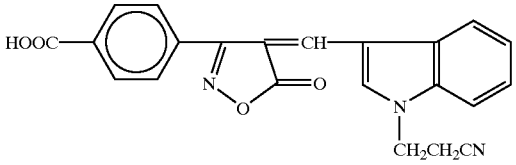
(II-13)
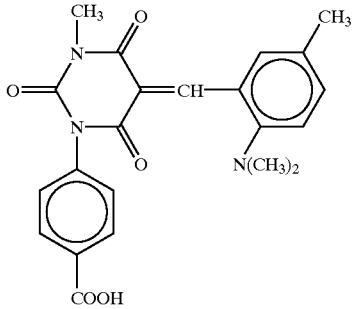
(II-14)
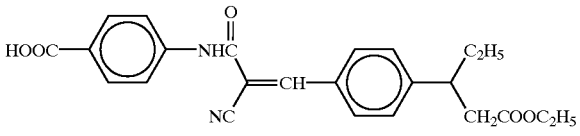
(II-15)
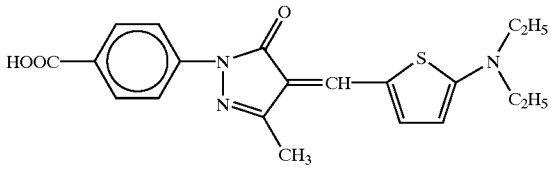

-continued
(II-16)
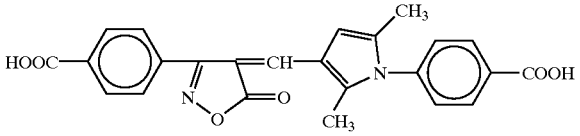
(II-17)
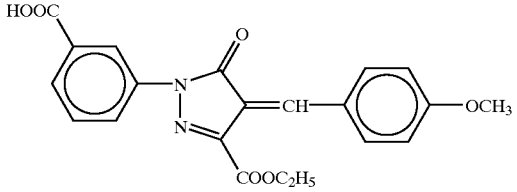
(II-18)
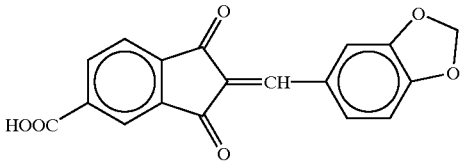
(II-19)
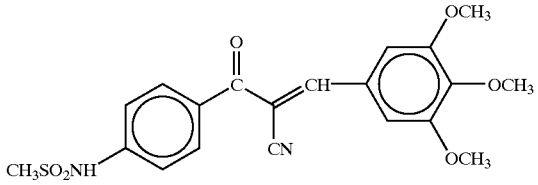
(II-20)
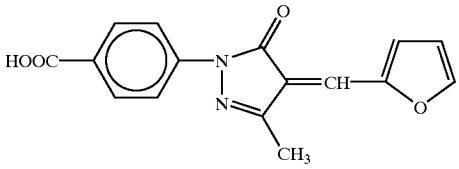
(II-21)
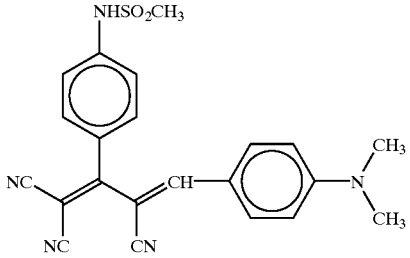
(II-22)
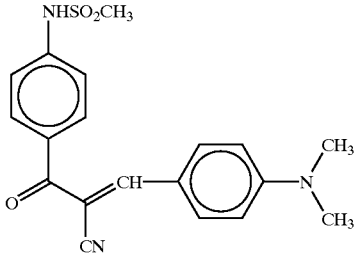
(II-23)
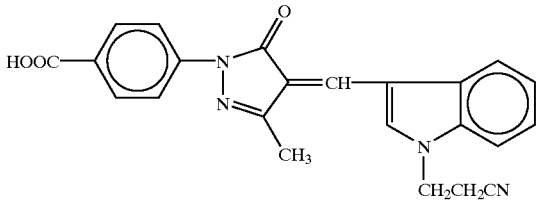
(II-24)
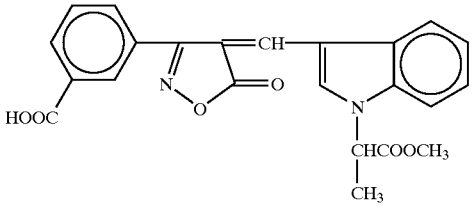
(III-1)
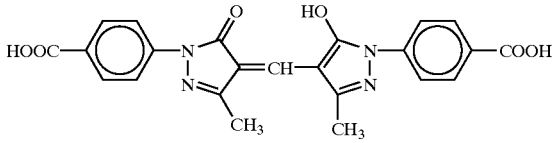
(III-2)
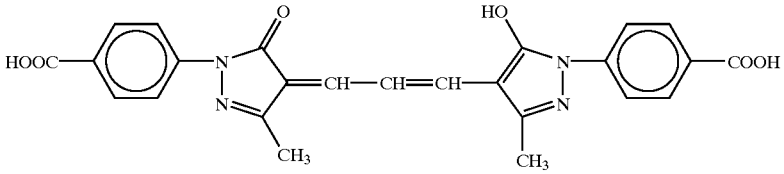
(III-3)
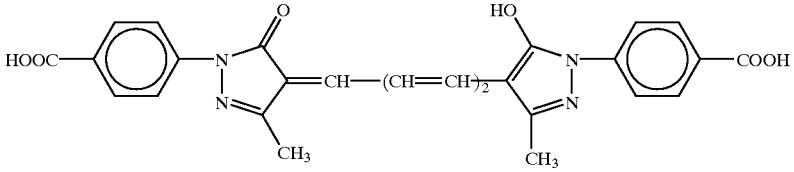

-continued
(III-4)
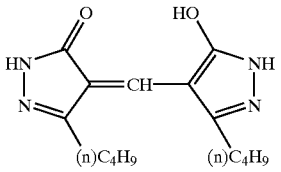
(III-5)
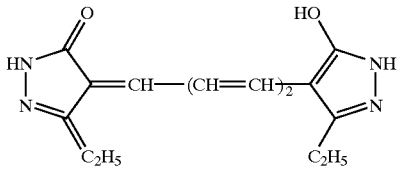
(III-6)
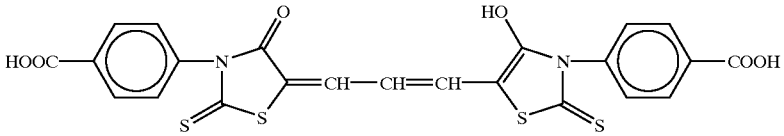
(III-7)
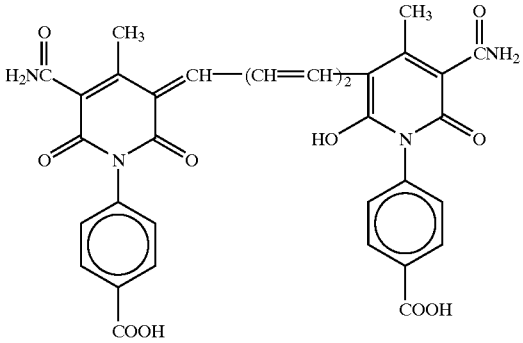
(III-8)
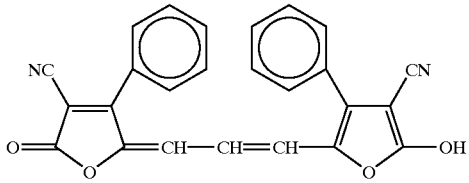
(III-9)
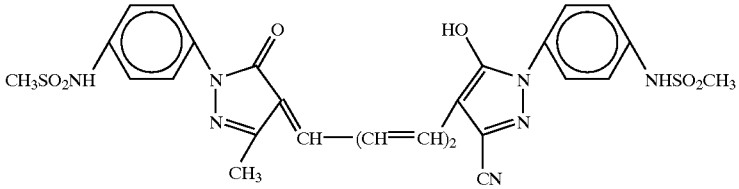
(III-10)
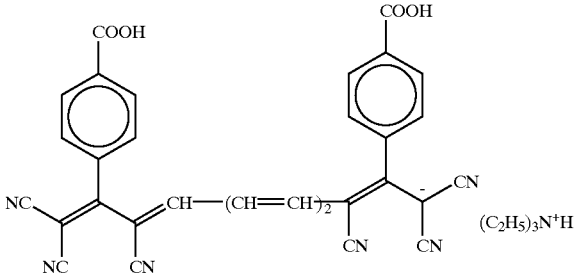
(III-11)
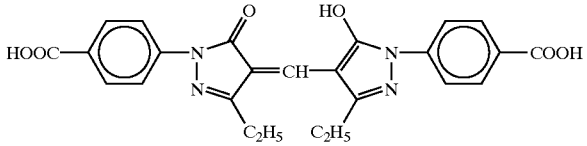
(III-12)
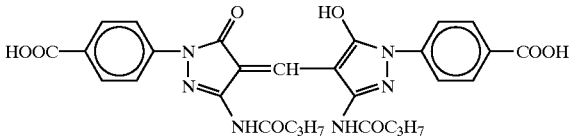
(III-13)
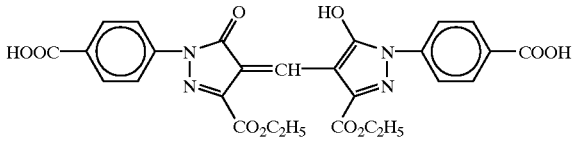

-continued
(III-14)
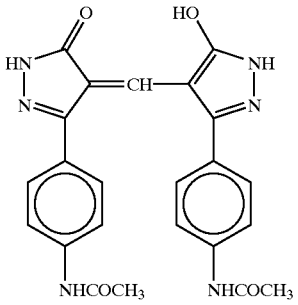
(III-15)
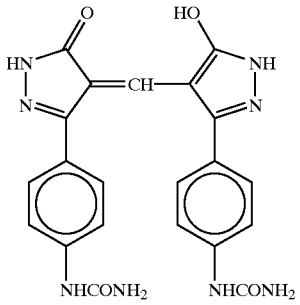
(III-16)
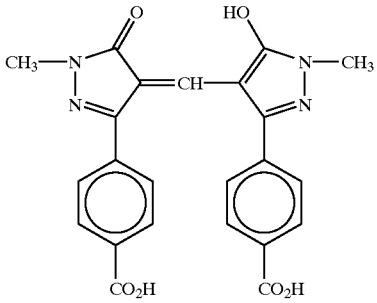
(III-17)
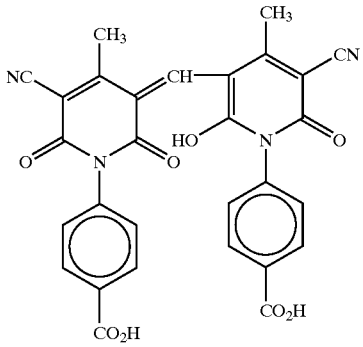
(III-18)
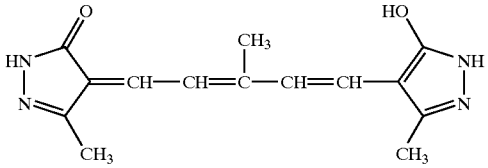
(III-19)
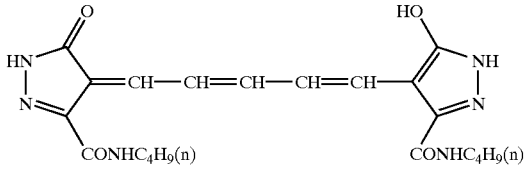
(III-20)
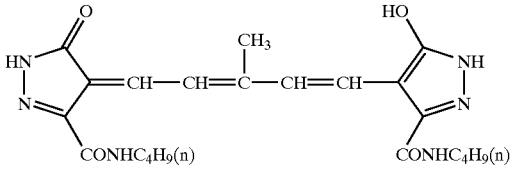
(III-21)
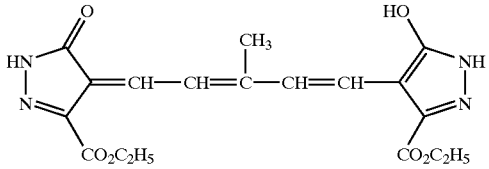
(III-22)
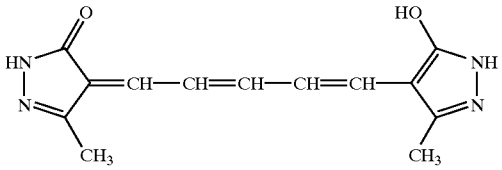
(III-23)
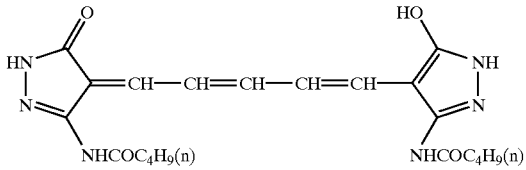
(III-24)
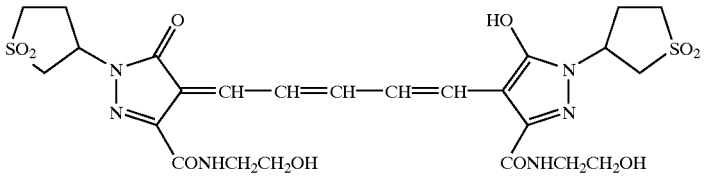

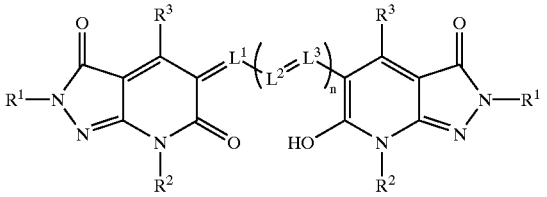
| | $R^1$ | $R^2$ | $R^3$ | $=L^1—(L^2=L^3)_n—$ |
|---|---|---|---|---|
| IV-1 | 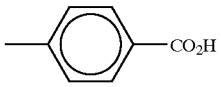 | —H | —$CH_3$ | =CH—CH=CH— |
| IV-2 | 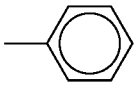 | —H | —$CH_3$ | =CH—CH=CH— |
| IV-3 | —$CH_3$ | —H | —$CH_3$ | =CH—CH=CH— |
| IV-4 | 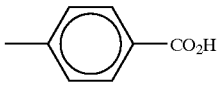 | —$CH_3$ | —$CH_3$ | =CH—CH=CH— |
| IV-5 | 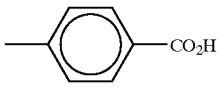 | 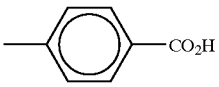 | —$CH_3$ | =CH—CH=CH— |
| IV-6 | 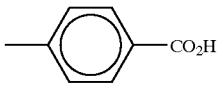 | —$CH_3$ | —$CO_2C_2H_5$ | =CH—CH=CH— |
| IV-7 | 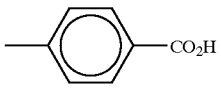 | —$CH_3$ | —$CO_2H$ | =CH—CH=CH— |
| IV-8 | —$CH_3$ | 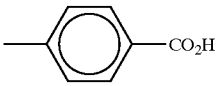 | —$CH_3$ | =CH—CH=CH— |
| IV-9 | —$CH_3$ | 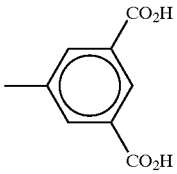 | —$CH_3$ | =CH—CH=CH— |
| IV-10 | —$CH_3$ | —$CH_3$ | —$CH_3$ | =CH—CH=CH— |
| IV-11 | 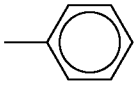 | 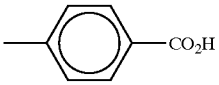 | —$CH_3$ | =CH—CH=CH— |
| IV-12 | 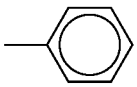 | 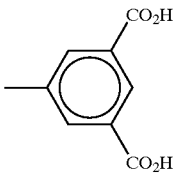 | —$CH_3$ | =CH—CH=CH— |

-continued
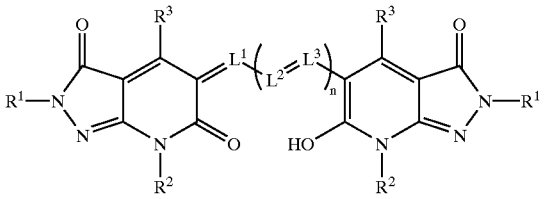
| | $R^1$ | $R^2$ | $R^3$ | $=L^1-(L^2=L^3)_n-$ |
|---|---|---|---|---|
| IV-13 | 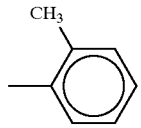 | 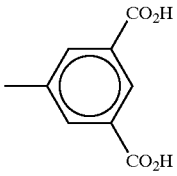 | $-CH_3$ | $=CH-CH=CH-$ |
| IV-14 | 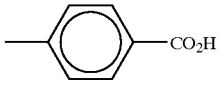 | $-H$ | $-CH_3$ | 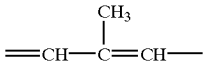 |
| IV-15 | 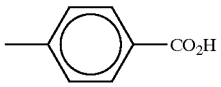 | $-H$ | $-CO_2C_2H_5$ | $=CH-CH=CH-$ |
| IV-16 | 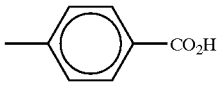 | $-H$ | $-CO_2H$ | $=CH-CH=CH-$ |
| IV-17 | 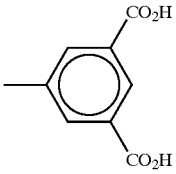 | $-H$ | $-CH_3$ | $=CH-CH=CH-$ |
| IV-18 | 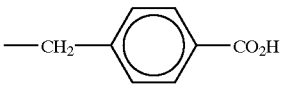 | $-H$ | $-CH_3$ | 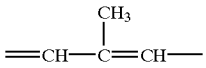 |
| IV-19 | 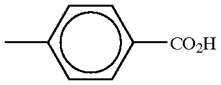 | $-CH_2CH_2OH$ | $-H$ | $=CH-CH=CH-$ |
| IV-20 | 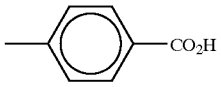 | $-CH_2CO_2H$ | $-CH_3$ | 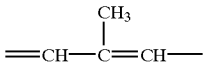 |
| IV-21 | 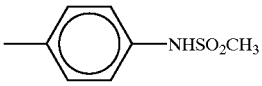 | $-H$ | $-CH_3$ | $=CH-CH=CH-$ |
| IV-22 | 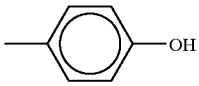 | $-H$ | $-CH_3$ | $=CH-CH=CH-$ |
| IV-23 | $-CH_2CH_2OH$ | $-H$ | $-CH_3$ | $=CH-CH=CH-$ |
| IV-24 | $-CH_3$ | $-CH_2CH_2OH$ | $-CH_3$ | $=CH-CH=CH-$ |
| IV-25 | $-H$ | 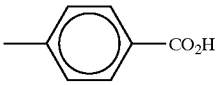 | $-CH_3$ | $=CH-CH=CH-$ |

-continued
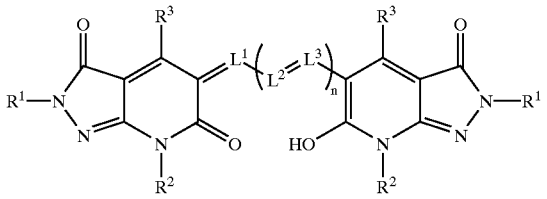
| | $R^1$ | $R^2$ | $R^3$ | $=L^1-(L^2=L^3)_n-$ |
|---|---|---|---|---|
| IV-26 | —H | —H | $-CO_2H$ | =CH—CH=CH— |
| IV-27 | 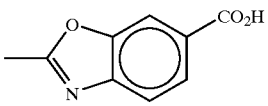 | —H | $-C_2H_5$ | =CH—CH=CH— |
| IV-28 | 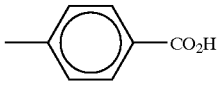 | $-SO_2CH_3$ | $-CO_2CH_3$ | 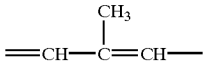 |
| IV-29 | 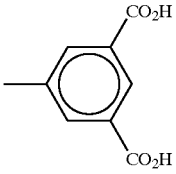 | $-COCH_3$ | $-CH_3$ | =CH—CH=CH— |
| IV-30 | —H | 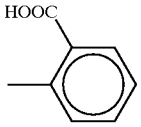 | $-CH_3$ | =CH—CH=CH— |
| IV-31 | 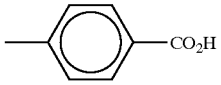 | 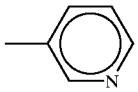 | $-CH_3$ | 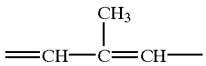 |
| IV-32 | 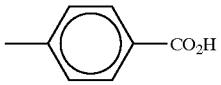 | $-CH_3$ | —CN | =CH—CH=CH— |
| IV-33 | 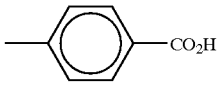 | —H | —H | =CH—CH=CH— |
| IV-34 | 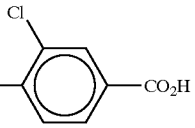 | —H | $-OC_2H_5$ | =CH—CH=CH— |
| IV-35 | 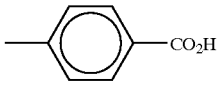 | —H | $(n)C_4H_9-$ | =CH—CH=CH— |
| IV-36 | 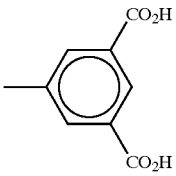 | $-CH_3$ | $-NHCH_3$ | =CH—CH=CH— |

-continued
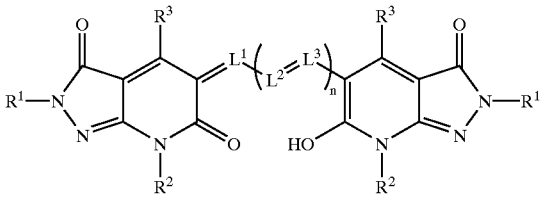
| | $R^1$ | $R^2$ | $R^3$ | $=L^1-(L^2=L^3)_n-$ |
|---|---|---|---|---|
| IV-37 | 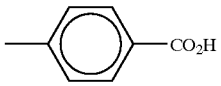 | $-COCH_3$ | $-NHCOCH_3$ | $=CH-CH=CH-$ |
| IV-38 | 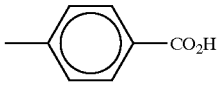 | $-CO_2CH_3$ | $-NHSO_2CH_3$ | $=CH-CH=CH-$ |
| IV-39 | 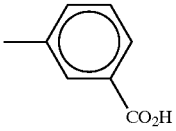 | $-CH_2CH_2OH$ | $-CH_3$ | $=CH-CH=CH-$ |
| IV-40 | $-CH_2CH_2CN$ | $-H$ | $-CH_3$ | $=CH-CH=CH-$ |
| IV-41 | 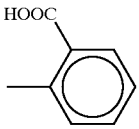 | $-H$ | $-CH_3$ | $=CH-CH=CH-$ |
| IV-42 | 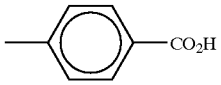 | $-H$ | $-C_2H_5$ | $=CH-CH=CH-$ |
| IV-43 | 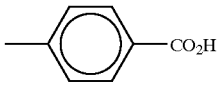 | $-CH_2CH_2OCH_3$ | $-CH_3$ | 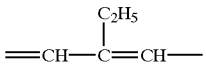 |
| IV-44 | 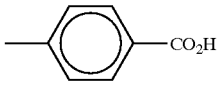 | $-H$ | $-CH_3$ | 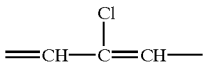 |
| IV-45 | 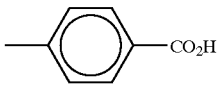 | $-H$ | $-CO_2H$ | 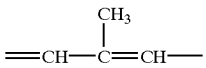 |
| IV-46 | 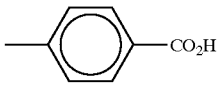 | $-H$ | $-CO_2H$ | 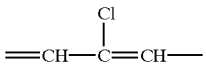 |
| IV-47 | $-CH_2CH_2CN$ | 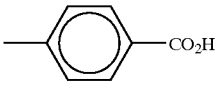 | $-CH_3$ | $=CH-CH=CH-$ |
| IV-48 | $-CH_2CH_2CN$ | 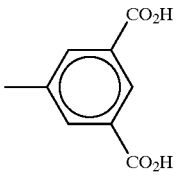 | $-CH_3$ | $=CH-CH=CH-$ |

-continued

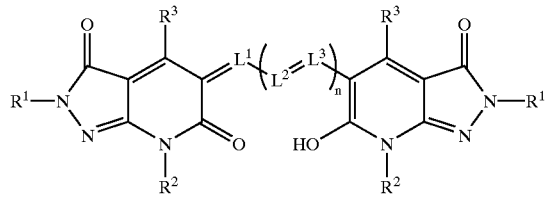

| | $R^1$ | $R^2$ | $R^3$ | $=L^1-(L^2=L^3)_n-$ |
|---|---|---|---|---|
| IV-49 | 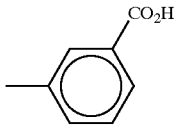 | —H | $-CH_3$ | =CH—CH=CH— |
| IV-50 | 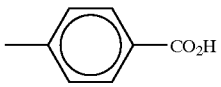 | —H | $-CH_3$ | =CH—CH=CH—CH=CH— |
| IV-51 | $-CH_3$ | 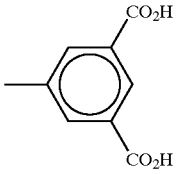 | $-CH_3$ | =CH—CH=CH—CH=CH— |

The dye for use in the present invention may be synthesized by or according to the methods described in WO88/04794, European Patent Applications Laid-open No. 274,723A1, No. 276,566 and No. 299,435, JP-A-52-92716, JP-A-55-155350, JP-A-55-155351, JP-A-61-205934, JP-A-48-68623, U.S. Pat. Nos. 2,527,583, 3,486,897, 3,746,539, 3,933,798, 4,130,429 and 4,040,841, JP-A-3-282244, JP-A-3-7931 and JP-A-3-167546.

The solid fine-particle dispersion of the aforementioned dye that can be used in the present invention may be prepared by a known method. The details of the production method are described in "Functional Pigment Applied Technologies (published by CMC, 1991) or the like.

Dispersion using media is one of general methods. In this method, a dye powder or a dye (a so-called wet cake) wetted by water or an organic solvent is made into an aqueous slurry, and the resulting slurry is mechanically crushed in the presence of dispersing media (e.g., steel balls, ceramic balls, glass beads, alumina beads, zirconia silicate beads, zirconia beads or Ottawa sand) by using a known crusher (e.g., a ball mill, vibrating ball mill, planetary ball mill, vertical type sand mill, roller mill, pin mill, coball mill, caddy mill, horizontal sand mill or attritor). The average diameter of beads to be used among these media is preferably 2 mm to 0.3 mm, more preferably 1 mm to 0.3 mm and still more preferably 0.5 mm to 0.3 mm. In addition to the above methods, methods of crushing using a jet mill, roll mill, homogenizer, colloid mill or a desolver, or crushing methods using a ultrasonic dispersion machine may be used.

Also, a method in which a dye is dissolved in a uniform solution and thereafter a poor solvent is added to the solution to precipitate solid fine particles, as disclosed in U.S. Pat. No. 2,870,012, or a method in which a dye is dissolved in an alkali solution and thereafter the pH of the solution is dropped to precipitate solid fine particles, as disclosed in JP-A-3-182743, may be used.

When the solid fine-particle dispersion is prepared, a dispersing aid is preferably made to be present. Examples of dispersing aids which have been disclosed include anionic dispersants, such as an alkylphenoxyethoxy sulfonate, alkylbenzene sulfonate, alkylnaphthalene sulfonate, alkylsulfate ester/salt, alkyl sulfosuccinate, sodium oleylmethyl tauride, formaldehyde condensation polymer of naphthalenesulfonic acid, polyacrylic acid, polymethacrylic acid, maleic acid/acrylic acid copolymer, carboxymethyl cellulose and cellulose sulfate; nonionic dispersants, such as a polyoxyethylene alkyl ether, sorbitan fatty acid ester, and polyoxyethylene-sorbitan fatty acid ester; cationic dispersants and betaine type dispersants. Particularly, a polyalkylene oxide represented by the following formula (V-a) or (V-b) is preferably used as the dispersing aid.

formula (V-a)

$$HO-(CH_2CH_2O)_a-(CH_2\underset{\underset{CH_3}{|}}{C}HO)_b-(CH_2CH_2O)_a-H$$

formula (V-b)

$$HO-(CH_2\underset{\underset{CH_3}{|}}{C}HO)_b-(CH_2CH_2O)_a-(CH_2\underset{\underset{CH_3}{|}}{C}HO)_b-H$$

In the above formulae (V-a) and (V-b), a and b respectively denotes a value of 5 to 500. a and b respectively are preferably 10 to 200 and more preferably 50 to 150. When a and b are in the above range, this is preferable with the view of improving the uniformity of the applied surface.

In the above dispersing aid, the ratio in terms of mass ratio of the polyethylene oxide part is preferably 0.3 to 0.9, more preferably 0.7 to 0.9 and still more preferably 0.8 to 0.9. Also, the average molecular weight of the above dispersing aid is preferably 1,000 to 30,000, more preferably 5,000 to 40,000 and still more preferably 8,000 to 20,000. Further, the HLB (hydrophilicity/lipophilicity balance) of the above dispersing aid is preferably 7 to 30, more preferably 12 to 30 and still more preferably 18 to 30. When the HLB value is in the above range, this is preferable with the view of improving the uniformity of the applied surface.

These compounds are commercially available, for example, as Pluronic, trade name, manufactured by BASF.

Specific examples of the compound represented by the above formulae (V-a) and (V-b) will be hereinafter explained.

| No. | Weight ratio of polyethylene oxide | Average molecular weight | HLB |
|---|---|---|---|
| | | | Formula (V-a) |
| $HO—(CH_2CH_2O)_a—(CH_2\underset{\underset{CH_3}{\vert}}{C}HO)_b—(CH_2CH_2O)_a—H$ | | | |
| V-1 | 0.5 | 1900 | ≧18 |
| V-2 | 0.8 | 4700 | ≧20 |
| V-3 | 0.3 | 1850 | 7~12 |
| V-4 | 0.4 | 2200 | 12~18 |
| V-5 | 0.4 | 2900 | 12~18 |
| V-6 | 0.5 | 3400 | 12~18 |
| V-7 | 0.8 | 8400 | ≧20 |
| V-8 | 0.7 | 6600 | ≧20 |
| V-9 | 0.4 | 4200 | 12~18 |
| V-10 | 0.5 | 4600 | 12~18 |
| V-11 | 0.7 | 7700 | ≧20 |
| V-12 | 0.8 | 11400 | ≧20 |
| V-13 | 0.8 | 13000 | ≧20 |
| V-14 | 0.3 | 4950 | 7~12 |
| V-15 | 0.4 | 5900 | 12~18 |
| V-16 | 0.5 | 6500 | 12~18 |
| V-17 | 0.8 | 14600 | ≧20 |
| V-18 | 0.3 | 5750 | 7~12 |
| V-19 | 0.7 | 12600 | ≧18 |
| | | | Formula (V-b) |
| $HO—(CH_2\underset{\underset{CH_3}{\vert}}{C}HO)_b—(CH_2CH_2O)_a—(CH_2\underset{\underset{CH_3}{\vert}}{C}HO)_b—H$ | | | |
| V-20 | 0.5 | 1950 | 12~18 |
| V-21 | 0.4 | 2650 | 7~12 |
| V-22 | 0.4 | 3600 | 7~12 |
| V-23 | 0.8 | 8600 | 12~18 |

In the present invention, the amount of the above dispersing aid to be used is preferably 0.05 to 0.5 and more preferably 0.1 to 0.3 in terms of mass ratio to the above dye. When the amount of the dispersing aid to be used is in the above range, this is preferable with the view of improving the uniformity of the applied surface.

Also, when the solid fine particle dispersion is prepared, a polyvinyl alcohol, polyvinylpyrrolidone, polyethylene glycol, polysaccharides, or hydrophilic colloid, such as a gelatin, is allowed to coexist for the purpose of stabilizing the dispersion and decreasing the viscosity of the dispersion. In the present invention, it is particularly preferable to allow the compound of the formula (VI) explained later to coexist. Among these, in the present invention, it is particularly preferable to allow the compound represented by formula (V) shown in JP-A-11-282106, paragraphs [0130] to [0167] to coexist. The said parts of the JP-A-11-282106 are incorporated herein as a part of the present specification by reference.

The solid fine particle dispersion of the above dye is preferably those treated under heat before, during or after dispersion, by such a method as described in JP-A-5-216166.

The above dye is preferably treated under heat at 40° C. or more, before it is incorporated into the light-sensitive material. Examples of the heat treatment method include a method in which the heat treatment is performed prior to a step of micro-dispersing solid-wise, for example, by heating a dye powder in a solvent; a method in which a dye is dispersed without cooling the dye or by heating the dye, when the dye is dispersed in water or other solvents, in the presence of a dispersant; and a method in which a solution after dispersion of the dye or an coating solution is treated under heat. It is particularly preferable to carry out the heat treatment after the dye is dispersed.

When plural kinds of the solid fine particle dispersion containing the dye represented by the formula (I) is used in a specific layer, at least one dispersion may be heat-treated.

The pH during heat treatment during or after dispersion of the dye may be in a range required for the dispersion to exist stably, and it is preferably in a range of 2.0 to 8.0, more preferably 2.0 to 6.5, and still more preferably 2.5 or more but less than 4.5. The pH during heat treatment that is in the above range is preferable, in view of an improvement in the film strength of the coated material.

For the adjustment of the pH of the dispersion, for example, sulfuric acid, hydrochloric acid, acetic acid, citric acid, phosphoric acid, oxalic acid, carbonic acid, sodium bicarbonate, sodium carbonate, sodium hydroxide, potassium hydroxide or a buffer comprising thereof may be used.

The temperature in the above heat treatment may be arbitrary, as far as it is in a range that is 40° C. or more and is a temperature at which the dye is not decomposed, although it is not determined in an wholesale manner because it differs depending upon the step at which heat treatment is conducted, the size and shape of a powder or particle, heat treating condition, the type of solvent, and the like. In the case of heat-treating a powder, an appropriate temperature is generally 40 to 200° C., and preferably 90 to 150° C. In the case of heat-treating in a solvent, an appropriate temperature is generally 40 to 150° C., and preferably 90 to 150° C. In the case of heat-treating during dispersion, an appropriate temperature is generally 40 to 90° C., and preferably 50 to 90° C. In the case of heat-treating the dispersion solution after a dispersing step is finished, an appropriate temperature is generally 40 to 100° C., and preferably 50 to 95° C. When the temperature at heat treatment is too low, only a poor effect is obtained.

When the heat-treatment is carried out in a solvent, there is no limitation to the type of solvent as far as it does not substantially dissolve the dye. Examples of the solvent include water, alcohols (e.g., methanol, ethanol, isopropyl alcohol, butanol, isoamyl alcohol, octanol, ethylene glycol, diethylene glycol, and ethyl cellosolve), ketones (e.g., acetone, and methyl ethyl ketone), esters (e.g., ethyl acetate and butyl acetate), alkylcarboxylic acids (e.g., acetic acid and propionic acid), nitrites (e.g., acetonitrile), ethers (e.g., dimethoxyethane, dioxane and tetrahydrofuran), amides (e.g., dimethylformamide), and the like.

Even if the dye dissolves when each of these solvents is used singly, such solvents can be used if the dye is not substantially dissolved to a solution obtained by mixing the solvent with water or other solvents or by adjusting the pH.

The time required for heat treatment is not also determined in a wholesale manner. When the temperature is low, a long time is required, whereas when the temperature is high, only a short time is required. The heat-treating time is preferably one hour to 4 days in general, although it is determined optionally so as to attain the heat treatment within the range free from an adverse effect on the production process.

The fine particles prepared in this manner are dispersed in an appropriate binder to prepare a solid dispersion of almost uniform particles, which is then applied to a desired support, to form a layer containing the fine particles of the dye on the photographic light-sensitive material.

As the above binder, a gelatin, or a synthetic polymer, such as a polyvinyl alcohol or polyacryl amide, is usually used, although no particular limitation is imposed on the binder as far as it is a hydrophilic colloid, which can be used for light-sensitive emulsion layers or light-insensitive layers.

The fine particles in the solid dispersion have an average particle diameter of generally 0.005 to 10 $\mu$m, preferably 0.01 to 1 $\mu$m, and more preferably 0.01 to 0.7 $\mu$m. The particle diameter falling in this range is preferable in view of resistance to coagulation of the fine particles and light-absorbing efficiency.

The solid fine particle dispersion of the dye represented by the above formula (I) may be used singly or in combination with a plural solid fine particle dispersions.

Moreover, the number of the hydrophilic colloidal layers to which the solid fine particle is to be added may be either one or plural. Examples of these cases include a case where a single solid fine particle dispersion is added to only one layer, a case where a single solid fine particle dispersion is added to plural layers in lots, a case where plural solid fine particle dispersions are added to only one layer simultaneously, and a case where plural solid fine particle dispersions are respectively added to separate layers. These cases, however, are not intended to be limiting of the present invention.

Further, the solid fine particle dispersion may be incorporated as an anti-halation layer in a necessary amount and added to the light-sensitive silver halide emulsion layer in a necessary amount for the prevention of irradiation.

The hydrophilic colloidal layer containing the solid fine particle dispersion of the dye represented by the formula (I) is disposed between the support and a silver halide emulsion layer closest to the support. A light-insensitive hydrophilic colloidal layer other than the hydrophilic colloidal layer containing the solid fine particle dispersion may be disposed between the support and a silver halide emulsion layer closest to the support.

The solid fine particle dispersion of the aforementioned dye is contained in the light-insensitive hydrophilic colloidal layer according to the hue of the dye, in the silver halide photographic light-sensitive material. In a light-sensitive material according to an embodiment provided with a plurality of light-insensitive layers, the solid fine particle dispersion may be added to the plurality of layers.

The concentration of the dye in the above solid fine particle dispersion is generally 0.1 to 50 mass %, preferably 2 to 35 mass %, and more preferably 2 to 30 mass %. The concentration of the dye that falls in the above range is preferable, in view of the viscosity of the dispersion. Further, the amount of the solid fine particle dye to be applied is preferably about 0.05 to 0.5 g/m$^2$.

In the present invention, a compound represented by the following formula (VI) is preferably contained together with the above solid fine-particle dispersion, in the same photographic constitutional layer.

Formula (VI)

$$P—((S)^m—R)_n$$

In the formula (VI), R represents a hydrogen atom, a hydrophobic group or a hydrophobic polymer, P represents a polymer containing at least one of the following units A, B and C, and having a polymerization degree of 10 or more and 3500 or less, n denotes 1 or 2, and m denotes 1 or 0;

A:

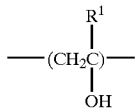

B:

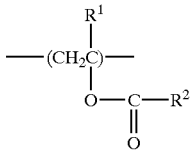

C:

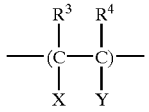

wherein $R^1$ represents —H or an alkyl group having 1 to 6 carbon atoms, $R^2$ represents —H or an alkyl group having 1 to 10 carbon atoms, $R^3$ represents —H or —$CH_3$, $R^4$ represents H, —$CH_3$, —$CH_2COOH$ (including an ammonium salt or a metal salt) or —CN, X represents —H, —COOH (including an ammonium salt or a metal salt) or —$CONH_2$, Y represents —COOH (including an ammonium salt or a metal salt), —$SO_3H$ (including an ammonium salt or a metal salt), —$OSO_3H$ (including an ammonium salt or a metal salt), —$CH_2SO_3H$ (including an ammonium salt or a metal salt), —$CONHC(CH_3)_2CH_2SO_3H$ (including an ammonium salt or a metal salt) or —$CONHCH_2CH_2CH_2N^+(CH_3)_3Cl^-$.

The details (e.g., concrete explanations, limitations of preferable ranges, exemplified compounds, the amount to be used, and synthetic methods) of the compound represented by the above formula (VI) are described in JP-A-11-95371, from page 24, column 46, line 27 to page 33, column 63, line 2 (Paragraphs 0090 to 0128), and the corresponding parts of the publication are incorporated herein as a part of the specification of the present application.

The silver halide color photographic light-sensitive material of the present invention is processed by developing treatment which is usually used.

Particularly, in the processing of a silver halide color photographic light-sensitive material for cinema, a positive light-sensitive material for cinema can be processed in a conventionally used processing steps. Further, in the case of the positive light-sensitive material for cinema according to the present invention, each of (1) a pre-bath step, and (2) a wash bath step, for removing a resin backing layer can be omitted. Such a shortened processing step is particularly preferable to simplify the process.

Also, particularly in the second embodiment, when the soundtrack is formed by a dye image, each step of (6) First fixing bath, (7) Washing bath, (11) Sound development and (12) Washing can be omitted, leading to an excellently preferable embodiment in view of simplification of the process.

The light-sensitive material of the present invention can exhibit excellent properties in such a simple processing step.

Conventional standard processing steps for a positive light-sensitive material for cinema (except for a drying process)

(1) Pre-bath
(2) Wash bath
(3) Color developing bath
(4) Stop bath
(5) Wash bath
(6) First fixing bath
(7) Wash bath
(8) Bleaching accelerating bath
(9) Bleaching bath
(10) Wash bath
(11) Sound development (coating development)
(12) Washing
(13) Second fixing bath
(14) Wash bath
(15) Stabilizing bath In the present invention, when color developing time (the above step (3)) is 2 minutes and 30 seconds or less (the lower limit is preferably 6 seconds or more, more preferably 10 seconds or more, further more preferably 20 seconds or more, and most preferably 30 seconds or more), and more preferably 2 minutes or less, the effects of the present invention are remarkable, and therefore such a developing time is preferable.

Also, the first fixing step is performed in preferably 20 seconds or more but 40 seconds or less, more preferably 23 seconds or more but less than 40 seconds, and still more preferably 25 seconds or more and 35 seconds or less.

Next, the photographic layer and the like of the silver halide color photographic light-sensitive material of the present invention will be described.

The silver halide color photographic light-sensitive material of the present invention may be applied to color light-sensitive materials for common uses and movies, such as color negative films, color negative films for movies, color positive films, positive films for movies, and the like.

A typical example of the silver halide color light-sensitive material of the present invention is a silver halide color photographic light-sensitive material, which has at least one light-sensitive layer comprising a plurality of silver halide emulsion layers differing substantially in color sensitivity, on a transparent support.

In the present invention, the light-sensitive silver halide emulsion layers that form each of yellow, cyan, or magenta colors may be one light-sensitive silver halide emulsion layer or a plurality of silver halide emulsion layers having the same color sensitivity but differing in sensitivity.

In the first embodiment of the present invention, it is necessary that the magenta color-forming light-sensitive silver halide emulsion layer containing a coupler represented by formula (M-I) and a prescribed high-silver chloride emulsion is placed most apart from the light-insensitive hydrophilic colloidal layer containing the solid fine-particle dispersion of the aforementioned dye represented by formula (I), among all the light-sensitive silver halide emulsion layers. No particular limitation, except for the above limitation, is imposed on the number of layers and the order of layers, with respect to the light-sensitive silver halide emulsion layers and the light-insensitive hydrophilic colloidal layers. Also, when there are a plurality of magenta color-forming light-sensitive silver halide emulsion layers, at least one of them is the aforementioned magenta color forming light-sensitive silver halide emulsion layer containing a coupler represented by formula (M-I) and a prescribed high-silver chloride emulsion, and it is only required for this specific magenta color-forming layer to be placed at a place most apart from the light-insensitive hydrophilic colloidal layer containing the solid fine particle dispersion containing the dye represented by formula (I), among all the light-sensitive silver halide emulsion layers. The remainder magenta color forming light-sensitive silver halide emulsion layers may be arbitrary positioned.

On the other hand, in the second embodiment of the present invention, the magenta color-forming light-sensitive silver halide emulsion layer is preferably disposed most apart from the support among all light-sensitive silver halide emulsion layers. There are no particular limitations, except for the above preferable mode, to the number of other light-sensitive silver halide emulsion layers and the light-insensitive hydrophilic colloidal layers, and to the order of these layers. Also, when there are a plurality of magenta color-forming light-sensitive silver halide emulsion layers, at least one of the magenta color-forming light-sensitive silver halide emulsion layers is preferably placed most apart from the support, among all the light-sensitive silver halide emulsion layers.

In the present invention, although the cyan color-forming light-sensitive silver halide emulsion layer and the yellow color-forming light-sensitive silver halide emulsion layer may be disposed either in this order or in the reverse order, from the support, it is preferable to dispose the yellow color-forming light-sensitive silver halide emulsion layer, and the cyan color-forming light-sensitive silver halide emulsion layer, in this order from the support.

There is also no particular limitation to the relation between the color-forming ability and color sensitivity of each of the color-forming light-sensitive silver halide emulsion layers. For example, one color-forming light-sensitive silver halide emulsion layer may have color sensitivity in the infrared region.

A typical example of the order of layers is as follows: an order, from the support, a light-insensitive hydrophilic colloidal layer (preferably a light-insensitive hydrophilic colloidal layer that comprises the solid fine particle dispersion of the dye represented by the formula (I), which dye is preferably used in the present invention), a yellow color-forming light-sensitive silver halide emulsion layer, a light-insensitive hydrophilic colloidal layer (color-mixing prevention layer), a cyan color-forming light-sensitive silver halide emulsion layer, a light-insensitive hydrophilic colloidal layer (color-mixing prevention layer), a magenta color-forming light-sensitive silver halide emulsion layer, and a light-insensitive hydrophilic colloidal layer (protective layer). However, the aforementioned arranging order may be changed and the numbers of the light-sensitive silver halide emulsion layers and the light-insensitive hydrophilic colloidal layers may be increased or decreased according to the object.

In the following, the silver halide emulsion used in the present invention is explained.

The silver halide emulsion used in the first embodiment of present invention includes, silver chloride, silver chlorobromide, silver chloroiodide, and silver chloroiodobromide, having 98 mol % or more of silver chloride. The silver halide particle in the emulsion may be those comprising regular crystals having, for example, a cubic, octahedron, or tetradecahedron form, those comprising irregular crystals having, for example, a spherical or plate form, those having crystal defects such as a twin plane, or complex systems of these crystals. Also, the use of a tabular particle having a (111) plane or a (100) plane as its principal plane, is preferable in view of achieving rapid color development processing and decreasing color contamination in the processing. The tabular high-silver chloride emulsion particle having a (111) plane or a (100) plane as its principal plane may be prepared by the methods disclosed in JP-A-6-138619, U.S. Pat. Nos. 4,399,215, 5,061,617, 5,320,938, 5,264,337, 5,292,632, 5,314,798, and No. 5,413,904, WO94/22051, and the like.

As a silver halide emulsion, which can be used in combination with the above emulsions in the first embodiment of the present invention, any silver halide emulsion having an arbitrary halogen composition may be used. However, in view of rapid processability, silver (iodo)chloride and silver chloro(iodo)bromide, having 95 mol % or more of silver chloride are preferable, and further, a silver halide emulsion having 98 mol % or more of silver chloride in the same manner as the emulsion according to the first embodiment of the present invention is preferable.

A silver halide particle in the photographic emulsion may be as in the same to those emulsion in the first embodiment, those having a regular crystal form such as a cubic, octahedron or tetradecahedron form, those having crystal defects such as a twin plane, or complex thereof.

As to the particle diameter of the silver halide, either fine particles having a particle diameter of about 0.2 $\mu$m or less, or large-sized particles whose projected area diameter is up to about 10 $\mu$m, may be adopted singly or in combination, and a polydisperse emulsion and/or a monodisperse emulsion may be used.

The silver halide photographic emulsions that can be used in the first embodiment of the present invention may be prepared, for example, by the methods described in Research Disclosure (hereinafter abbraviated to as RD) No. 17643 (December 1978), pp. 22–23, "I. Emulsion preparation and types", and ibid. No. 18716 (November 1979), p. 648, and ibid. No. 307105 (November, 1989), pp. 863–865; the methods described by P. Glafkides, in Chemie et Phisique Photographique, Paul Montel (1967), by G. F. Duffin, in Photographic Emulsion Chemistry, Focal Press (1966), and by V. L. Zelikman et al., in Making and Coating of Photographic Emulsion, Focal Press (1964).

Monodispersed emulsions described in U.S. Pat. Nos. 3,574,628, and 3,655,394, and U.K. Patent No. 1,413,748 are also preferable.

Tabular particles having an aspect ratio of about 3 or more can also be used, in the first embodiment of the present invention. The tablar particles may be prepared easily, according to the methods described by Gutoff, in Photographic Science and Engineering, Vol. 14, pp.248–257 (1970); U.S. Pat. Nos. 4,434,226, 4,414,310, 4,433,048, and 4,439,520, and U.K. Patent No. 2,112,157.

As to the crystal structure, a uniform structure, a structure in which the internal part and the external part have different halogen compositions, and a layered structure may be acceptable. Silver halides differing in composition may be joined with each other by epitaxial junction, and, for example, a silver halide may be joined with a compound other than silver halides, such as, silver rhodanate and lead oxide. Also, a mixture of particles having various crystal forms may be used.

Although the aforementioned emulsion may be any one of a surface latent image-type that forms a latent image primarily on the particle surface, an internal latent image-type that forms a latent image inside of a particle, and another type of emulsion that forms a latent image both on the surface and inside of the particle; but it must be a negative type emulsion in any case. Among the internal latent image type emulsions, an emulsion of a core/shell type internal latent image type emulsion, as described in JP-A-63-264740 may be used, and the preparation method of this emulsion is described in JP-A-59-133542. The thickness of the shell of this emulsion is preferably 3 to 40 nm, and particularly preferably 5 to 20 nm, though it differs depending on developing process.

As the silver halide emulsion, generally, those provided with physical ripening, chemical ripening, and spectral sensitization are used. Additives in these steps are described in RD Nos. 17643, 18716, and 307105. Its relevant parts are listed in a table described later.

In the light-sensitive material of the present invention (both the first embodiment and the second embodiment), two or more types of emulsions differing in at least one feature among the particle size, the distribution of particle size, halogen composition, the shape of the particle, and the sensitivity of the light-sensitive silver halide emulsion, may be mixed and used in one layer.

The amount of silver to be applied in the silver halide color photographic light-sensitive material of the first embodiment of the present invention is preferably 6.0 g/m$^2$ or less, and most preferably 4.5 g/m$^2$ or less.

Next, the silver halide emulsion used in the second embodiment of the present invention will be explained.

The halogen composition of a silver halide particle used in the second embodiment of the present invention is characterized by the inclusion of a silver halide containing a high content of silver chloride, which is both high in processing speed and fixing speed. Specifically, a silver halide (i.e., silver chloride, silver chlorobromide, silver chloroiodide, or silver chloroiodobromide), in which the content of silver chloride in all silver halide particles is preferably 95 mol % or more, more preferably 96 mol % or more, and still more preferably 97 mol % or more but 100 mol % or less, is preferable. Light-sensitive layers used for the silver halide color photographic light-sensitive material includes a cyan color-forming layer, magenta color-forming layer, and yellow color-forming layer. In the case where the total content of silver halides is in the above range, not all these color-forming layers are necessarily required to have silver chloride in a content falling in the above preferable range. However, it is more preferable that the content of silver chloride in the silver halide in each light-sensitive layer falls in the above preferable range. Moreover, at least two types of silver halide particles, which differ in the size of a silver halide particle or light absorbance (sensitivity), are frequently contained in each color-forming layer, with the intention of obtaining a desirable gradation. It is unnecessary that the silver halide content of all of the silver halide particles, which differ in particle size or light absorbance (sensitivity), contained in the same color-forming layer, fall in the above range. However, it is more preferable that the silver chloride content of all silver halide particles having the same particle sizes or the same light absorbances (sensitivity) in the same color-forming layer fall in the above range.

As the halogen composition of the light-sensitive silver halide particle used in the second embodiment of the present invention, silver chloride is preferable as aforementioned. However, silver chlorobromide, silver chloroiodide, or silver chloroiodobromide is acceptable insofar as its halogen composition falls in the range defined in the second embodiment of the present invention. No particular limitation is imposed on the use of halides other than silver chloride. Such halides may be used during formation of silver halide particles, to obtain silver halide particles having so-called core/shell structure, and thus-obtained silver halide particles may be used. Also, such halides may be used during sedimentation coagulation, a dispersing step, or a chemical sensitization step, or during a period after completion of chemical sensitization but before an application step, to cause halogen conversion due to a difference in solubility product, whereby a phase having different halogen composition can be formed on the surface of the particle.

Examples of the shape of the silver halide particle may include a cubic, octahedron, tabular, sphere, bar-like form, potato-like form, and the like. In the second embodiment of the present invention, a cubic particle and a tabular particle are preferable, and particularly, a tabular particle is preferably used with the intention of imparting properties of high sensitivity and excellent graininess.

In the second embodiment of the present invention, the tabular particle means a particle having an aspect ratio (diameter/thickness) of 1 or more, and the average aspect ratio means an average of the aspect ratio of each tabular particle. The diameter means a diameter of a circle having the same area as the projected area of a tabular particle, and the thickness means a distance between two principal planes. It is to be noted that the principal plane means the surface having a maximum area in a tabular particle.

In the second embodiment of the present invention, the tabular silver halide particle occupies at least 50% or more, preferably 60% or more, more preferably 80% or more, still more preferably 90% or more, and most preferably 95% or more but 100% or less of the projected area of all silver halide particles contained in the same silver halide emulsion layer. Also, the tabular silver halide particle is preferably contained in all silver halide emulsion layers.

In the second embodiment of the present invention, in the case of using the tabular silver halide particle, the average aspect ratio is preferably 2 or more but 100 or less, and more preferably 3 or more but 50 or less. Also, a silver halide particle having rounded corners is preferably used.

There is no particular limitation to the plane indices (Miller indices) of a surface of the light-sensitive silver halide particle, but it is preferable that the ratio of the portion occupied by a {100} plane, which has a high spectral sensitizing efficiency when a spectral sensitizing dye adsorbs, is high. The ratio is preferably 50% or more, more preferably 65% or more, and still more preferably 80% or more but 100% or less. The ratio of Miller indices can be measured by a method described in T. Tani; Imaging Sci., 29, 165 (1985), which utilizes the adsorption dependency of a sensitizing dye on a {111} plane and a {100} plane, in the adsorption of a sensitizing dye.

The tabular particle usable in the second embodiment of the present invention is preferably a tabular particle having, as its principal plane, a {100} plane that exhibits a high spectral sensitizing efficiency. Examples of the shape of the tabular particle containing a {100} plane as its principal plane include a right-angled parallerogram, a 3- to 5-cornered shape formed by cutting off one of the corners of the right-angled parallerogram (the shape of the cut portion is a right-angled triangle formed of the corner as its vertex and sides forming the corner), or a 4- to 8-cornered shape, in which the cut portions present accounts for two or more and but four or less. If a right-angled parallerogram formed by compensating the cut portions is called a supplemented tetragon, the ratio of the neighboring sides (i.e. length of long side/length of short side) of the said parallerogram and the said supplemented tetragon is generally 1 to 6, preferably 1 to 4, and more preferably 1 to 2.

The tabular silver halide emulsion particle having the {100} principal plane is used particularly preferably in the yellow color-forming light-sensitive silver halide emulsion layer, though it may be used in any emulsion layer. It is also preferable to use the tabular silver halide emulsion particle having the {100} principal plane in all light-sensitive silver halide emulsion layers, including the yellow color-forming light-sensitive silver halide emulsion layer.

In a method of forming the tabular silver halide emulsion particle having the {100} principal plane, an aqueous silver salt solution and an aqueous halide solution are added to and mixed with a dispersion medium, such as an aqueous gelatin solution, with stirring. During the formation, a method is disclosed, in which a silver iodide or iodide ion, or a silver bromide or bromide ion, is allowed to be present, to cause a strain in nuclei by a difference in the size of the crystal lattice with that of silver chloride, thereby introducing crystal defects imparting anisotropic growth characteristics, such as screw dislocation, in JP-A-6-301129, JP-A-6-347929, JP-A-9-34045, and JP-A-9-96881. When the screw dislocation is introduced to a plane, the formation of two-dimensional nuclei on the plane is no longer a rate-determining step in a low supersaturation condition, and hence crystallization on this plane progresses to form a tabular particle. Thus, the tabular particle is formed as a result of the introduction of the screw dislocation. Here, the low supersaturation condition shows a condition that above silver halide or halide ion is added in an amount of preferably 35% or less and more preferably 2 to 20% of the critical amount. Although the crystal defect have not been identified as the screw dislocation, it is considered that there is a high possibility that the crystal defect is the screw dislocation, in consideration of the direction in which the dislocation is introduced and the fact that anisotropic growth characteristics is imparted to the particle. The retention of the introduced dislocation is preferable to make the tabular particle thinner, as disclosed in JP-A-8-122954 and JP-A-9-189977.

There are also methods of forming the tabular particles having the {100} principal plane by adding a {100} plane-forming accelerator using, for example, imidazoles or 3,5-diaminotriazoles (as disclosed in JP-A-6-347928) or polyvinyl alcohols (as disclosed in JP-A-8-339044). Moreover, the tabular particles having the {100} principal plane can be prepared using the methods disclosed, for example, in U.S. Pat. Nos. 5,320,935, 5,264,337, 5,292,632, 5,314,798 and 5,413,904 and WO94/22051. However, these methods are not intended to be limiting of the present invention.

The particle according to the second embodiment of the present invention may have the so-called core/shell structure comprising a core portion and a shell portion surrounding the core portion. When the particle has the core/shell structure, the core portion preferably contains 90 mol % or more of silver chloride. The core portion may comprise two or more portions different in halogen composition. The shell portion preferably occupies 50% or less and particularly preferably 20% or less of the entire volume of an individual particle. The shell portion preferably comprises silver chloroiodide or silver chlorobromide. The shell portion contains silver bromide in an amount of preferably 0.5 mol % to 10 mol % and particularly preferably 1 mol % to 5 mol %. The content of silver bromide in all particles is preferably 5 mol % or less and particularly preferably 3 mol % or less.

Although the light-sensitive silver halide may be a fine particle having a particle size of 0.2 $\mu$m or less, or a large-sized particle having a diameter of its projected area up to 10 $\mu$m or more, it is preferably a fine particle to obtain better graininess. The silver halide particles of the second embodiment of the present invention is preferably monodispersion for the purpose of accelerating the development progress. A coefficient of variation in the particle size of each silver halide particle is preferably 0.3 or less (more preferably 0.3 to 0.05) and more preferably 0.25 or less (more preferably 0.25 to 0.05). The coefficient of variation so-called here is expressed by the ratio (s/d) of the value (s) of statistical standard deviation to the average particle size (d).

In the second embodiment of the present invention, an iridium compound, specifically, an iridium complex or an iridium ion-containing compound can be preferably used. The iridium ion-containing compound is a trivalent or tetravalent salt or complex salt, and it is particularly preferably a complex salt. Preferable examples of the iridium compound include halogens, amines and oxalate complex salts of such as iridous (III) chloride, iridous (III) bromide, iridic (IV) chloride, sodium hexachloroiridate (III), potassium hexachloroiridate (IV), hexaanmineiridate (IV), trioxalatoiridate (III) and trioxalatoiridate (IV). The amount of the iridium complex or the iridium ion-containing compound to be used is preferably $1.0\times10^{-8}$ mol/mol-silver or more and $5.0\times10^{-6}$ mol/mol-silver or less, and more preferably $2.0\times10^{-8}$ mol/mol-silver or more and $2.5\times10^{-6}$ mol/mol-silver or less, to the amount of silver halide.

The iridium complex or the iridium ion-containing compound may be contained in the core portion or the shell portion or may be contained uniformly, in a silver halide particle. Also, a portion differing in halogen composition may be grown in the corner portion by means of heterojunction, thereby containing the iridium complex or the iridium ion-containing compound selectively in said portion, but the present invention is not particularly limited to these.

The light-sensitive silver halide particle of the second embodiment of the present invention may contain at least one complex of a metal selected from rhodium, rhenium, ruthenium, osmium, cobalt, mercury and iron, in addition to the iridium complex or the iridium ion-containing compound. These metal complexes may be used singly or in combinations of two or more of the same or different metal types. A preferable content of the metal is in a range from preferably $1\times10^{-9}$ mol/mol silver to $1\times10^{-3}$ mol/mol silver, and more preferably $1\times10^{-9}$ mol/mol silver to $1\times10^{-4}$ mol/mol silver. As a specific structure of the metal complex, for example, metal complexes having a structure described in JP-A-7-225449 may be used. For complexes of cobalt or iron, 6-cyano metal complexes can be preferably used.

It is preferable that the light-sensitive silver halide particle according to the second embodiment of the present invention be chemically sensitized. As preferable chemical sensitization method, well-known in the art, a sensitization method using a chalcogen compound (a sulfur compound, a selenium compound, or a tellurium compound), a sensitization method using a noble metal, such as a gold compound, platinum, palladium or an iridium compound, and a reduction sensitization method may be used. Further, spectral sensitization may be used. As additives used in this step, compounds described in RD No. 17643, RD No. 18716 and RD No. 307105 may be preferably used.

The amount of silver to be applied in the silver halide color light-sensitive material for movies according to the second embodiment of the present invention is preferably as small as possible, for the purpose of decreasing developing and/or fixing loads, specifically, it is preferably 1.7 g/m$^2$ or less, more preferably 1.65 g/m$^2$ or less and still more preferably 1.6 g/m$^2$ or less. Although there is no particular limitation to the lower limit as far as a desired maximum density and graininess can be obtained, 1.2 g/m$^2$ or more is preferable.

In the present invention, 1-aryl-5-mercaptotetrazole compound, in an amount of preferably $1.0\times10^{-5}$ to $5.0\times10^{-2}$ mols and more preferably $1.0\times10^{-4}$ to $1.0\times10^{-2}$ mols per one mol of the silver halide is preferably added to any one layer and preferably a silver halide emulsion layer, in photographic structural layers composed of the light-sensitive silver halide emulsion layers and light-insensitive hydrophilic colloidal layers (intermediate layers and protective layers) disposed on the support. The addition of this compound in an amount falling in the above range enables a more reduction in contamination to the surface of the processed color photograph after the continuous process.

As such a 1-aryl-5-mercaptotetrazole compound, those in which the aryl group at the 1-position is an unsubstituted or substituted phenyl group. Preferable specific examples of the substituent include an acylamino group (e.g., an acetylamino group and —$NHCOC_5H_{11}$(n)), a ureido group (e.g., a methylureido group), an alkoxy group (e.g., a methoxy group), a carboxylic acid group, an amino group and a sulfamoyl group. Each of these groups may be bonded in the plural (2 to 3 groups) with the phenyl group. Also, the position of the substituent is preferably the metha or para position.

Specific examples of the compound include 1-(m-methylureidophenyl)-5-mercaptotetrazole and 1-(m-acetylaminophenyl)-5-mercaptotetrazole.

The photographic additives that can be used in the present invention are described in the above following Research Disclosure(RD), whose particular parts are given below in a table.

| Kind of Additive | RD 17643 | RD 18716 | RD 307105 |
|---|---|---|---|
| 1 Chemical sensitizers | p.23 | p.648 (right column) | p.866 |
| 2 Sensitivity-enhancing agents | | p.648 (right column) | |
| 3 Spectral sensitizers and Supersensitizers | pp. 23–24 | pp.648 (right column)–649 (right column) | pp.866–868 |
| 4 Brightening agents | p.24 | pp.647 (right column) | p.868 |
| 5 Light absorbers, Filter dyes, and UV Absorbers | pp. 25–26 | pp.649 (right column)–650 (left column) | p.873 |
| 6 Binders | p.26 | p.651 (left column) | pp.873–874 |
| 7 Plasticizers and Lubricants | p.27 | p.650 (right column) | p.876 |
| 8 Coating aids and Surfactants | pp. 26–27 | p.650 (right column) | pp.875–876 |
| 9 Antistatic agents | p.27 | p.650 (right column) | pp.876–877 |
| 10 Matting agents | | | pp.878–879 |

In the silver halide color photographic light-sensitive material of the present invention, the following couplers are particularly preferably used, though various dye-forming couplers may be used:

Yellow couplers: couplers represented by the formula (I) or (II) in EP 502,424A; couplers represented by the formula (1) or (2) in EP513,496A (particularly, Y-28 on page 18); couplers represented by the formula (I) in claim 1 in JP-A-5-307248; couplers represented by the formula (I) in U.S. Pat. No. 5,066,576, column 1, line 45 to line 55; couplers represented by the formula (I) in JP-A-4-274425, Paragraph 0008; couplers described in claim 1 in EP 498, 381A1, page 40 (particularly, D-35 on page 18); couplers represented by the formula (Y) in EP 447,969A1, page 4

(particularly Y-1 (page 17) and Y-54 (page 41)); and couplers represented by one of the formulae (II) to (IV) in U.S. Pat. No. 4,476,219, column 7, line 36 to line 58 (particularly, II-17 and -19(column 17) and II-24 (column 19)).

Magenta couplers (couplers which can be used in combination with the magenta coupler of the formula (M-I), in the first embodiment of the present invention); JP-A-3-39737 (L-57 (page 11, the lower right), L-68 (page 12, the lower right), L-77 (page 13, the lower right)); A-4 to A-63 (page 134), A-4 to A-73 and A-75 (page 139) in EP 456,257; M-4, M-6 (page 26) and M-7 (page 27) in EP 486,965; M-45 in JP-A-6-43611, Paragraph 0024; M-1 in JP-A-5-204106, Paragraph 0036; M-22 in JP-A-4-362631, Paragraph 0237.

Cyan couplers: couplers represented by CX-1, 3, 4, 5, 11, 12, 14 and 15 (page 14 to page 16) in JP-A-4-204843; C-7, 10 (page 35), 34, 35 (page 37), (I-1), (I-17) (page 42 to page 43) in JP-A-4-43345; and couplers represented by the formula (Ia) or (Ib) in claim 1 in JP-A-6-67385.

Polymer couplers; P-1 and P-5 (page 11) in JP-A-2-44345.

Sound track-forming infrared couplers; couplers described in JP-A-63-143546 and the Patents referred to therein.

As couplers allowing the color developed dye to have moderate diffusibility, those described in U.S. Pat. No. 4,366,237, GB 2,125,570, EP 96,873B and DE 3,234,533 are preferable.

As couplers for compensating the unnecessary absorption of the color developed dye, yellow-colored cyan couplers represented by the formula (CI), (CII), (CIII) or (CIV) described on page 5 in EP 456,257A1 (particularly YC-86, on page 84), yellow-colored magenta couplers ExM-7 (page 202), EX-1 (page 249) and Ex-7(page 251) described in the same EP, magenta-colored cyan couplers CC-9 (column 8) and CC-13 (column 10) described in U.S. Pat. No. 4,833,069, and uncolored masking couplers represented by the formula [C-1] described in claim 1 in WO92/11575 (particularly, the exemplified compounds on page 36 to page 45) and (2) (on column 8) of U.S. Pat. No. 4,837,136, are preferable.

As examples of the compound (including a coupler) which reacts with an oxidized product of a developing agent to release a photographically useful compound residue, the following compounds are given. Developing restrainer-releasing compounds: compounds represented by the formula (I), (II), (III) or (IV) described in EP 378,236A1, page 11 (particularly T-101 (page 30), T-104 (page 31), T-113 (page 36), T-131 (page 45), T-144 (page 51) and T-158 (page 58)), compounds represented by the formula (I) in EP 436,938A2, page 7 (particularly, D-49 (page 51)), compounds represented by the formula (1) in JP-A-5-307248 (particularly, (23) in Paragraph 0027)) and compounds represented by the formula (I), (II) or (III) in EP 440,195A2, page 5 to page 6 (particularly, I-(1) on page 29)); bleaching-accelerator-releasing compounds: compounds represented by the formula (I) or (I') described in EP 310,125A2, page 5 (particularly (60) and (61) on page 61)) and compounds represented by the formula (I) in claim 1 in JP-A-6-59411 (particularly, (7) in Paragraph 0022); ligand-releasing compounds: the compounds represented by the formula LIG-X described in claim 1 in U.S. Pat. No. 4,555,478 (particularly, compounds described in column 12, line 21 to line 41); leuco dye-releasing compounds: the compounds 1 to 6 in U.S. Pat. No. 4,749,641, columns 3 to 8; fluorescent dye-releasing compounds: compounds represented by COUP-DYE in claim 1 in U.S. Pat. No. 4,774,181 (particularly compounds 1 to 11 in columns 7 to 10); development-accelerator- or fogging agent-releasing compounds: compounds represented by the formula (1), (2) or (3) in U.S. Pat. No. 4,656,123, column 3 (particularly, (I-22) in column 25) and ExZK-2 in EP 450,637A2, page 75, line 36 to line 38; compounds releasing a group which becomes a dye for the first time when it is spilt-off: compounds represented by the formula (I) in claim 1 in U.S. Pat. No. 4,857,447 (particularly, Y-1 to Y-19 in ones 25 to 36).

As additives other than the coupler, the following ones are preferable.

Dispersion media for an oil-soluble organic compound: P-3, 5, 16, 19, 25, 30, 42, 49, 54, 55, 66, 81, 85, 86 and 93 (page 140 to page 144) in JP-A-62-215272; latex for impregnation with the oil-soluble organic compound: latex described in U.S. Pat. No. 4,199,363; scavengers for an oxidized product of a developing agent: compounds represented by the formula (I) in U.S. Pat. No. 4,978,606, column 2, line 54 to line 62 (particularly I-, (1), (2), (6), (12) (columns 4 to 5)) and compounds represented by the formula in U.S. Pat. No. 4,923,787, column 2, line 5 to line 10 (particularly Compound 1 (column 3); stain preventive agents: compounds represented by one of the formulae (I) to (III) in EP 298321A, page 4, line 30 to line 33 (particularly, I-47, 72, III-1, 27 (page 24 to page 48)); anti-fading agents: A-6, 7, 20, 21, 23, 24, 25, 26, 30, 37, 40, 42, 48, 63, 90, 92, 94 and 164 (page 69 to page 118) in EP 298321A, and II-1 to III-23 in U.S. Pat. No. 5,122,444, columns 25 to 38 (particularly, III-10), I-1 to III-4 in EP 471347A, page 8 to page 12 (particularly, II-2), and A-1 to 48 in U.S. Pat. No. 5,139,931, columns 32 to 40 (particularly A-39 and 42); materials reducing the amount of a color development-enchancing agent or a color contamination preventive agent to be used: I-1 to II-15 in EP 411324A, page 5 to page 24 (particularly, I-46); formalin scavengers: SCV-1 to 28 in EP 477932A, page 24 to page 29 (particularly SCV-8); hardener: H-1, 4, 6, 8 and 14 in JP-A-1-214845 in page 17, compounds (H-1 to H-54) represented by one of the formulae (VII) to (XII) in U.S. Pat. No. 4,618,573, columns 13 to 23, compounds (H-1 to 76) represented by the formula (6) in JP-A-2-214852, page 8, the lower right (particularly, H-14) and compounds described in claim 1 in U.S. Pat. No. 3,325,287; precursors of developing restrainers: P-24, 37, 39 (page 6 to page 7) in JP-A-62-168139 and compounds described in claim 1 of U.S. Pat. No. 5,019,492 (particularly 28 to 29 in column 7); antiseptics and mildew-proofing agents: I-1 to III-43 in U.S. Pat. No. 4,923,790, columns 3 to 15 (particularly II-1, 9, 10 and 18 and III-25), stabilizers and antifoggants: I-1 to (14) in U.S. Pat. No. 4,923,793, columns 6 to 16 (particularly, I-1, 60, (2) and (13) and compounds 1 to 65 in U.S. Pat. No. 4,952,483, columns 25 to 32 (particularly, 36); chemical sensitizers: triphenylphosphine selenide and compound 50 in JP-A-5-40324; dyes: a-1 to b-20 in JP-A-3-156450, page 15 to page 18 (particularly, a-1, 12, 18, 27, 35, 36, b-5 and V-1 to 23 on pages 27 to 29, particularly, V-1), F-I-1 to F-II-43 in EP 445627A, page 33 to page 55 (particularly F-I-11 and F-II-8, III-1 to 36 in EP 457153A, page 17 to page 28 (particularly III-1 and 3), microcrystal dispersions represented by Dye-1 to 124 in WO88/04794, 8 to 26, compounds 1 to 22 in EP319999A, page 6 to page 11 (particularly, compound 1), compounds D-1 to 87 (page 3 to page 28) represented by one of the formulae (1) to (3) in EP 519306A, compounds 1 to 22 (columns 3 to 10) represented by the formula (I) in U.S. Pat. No. 4,268,622, compounds (1) to (31) (columns 2 to 9) represented by the formula (I) in U.S. Pat. No. 4,923,788; UV absorbers: compound (18b) to (18r) and 101 to 427 (page 6 to page 9) represented by the formula (1) in JP-A-46-3335, compounds (3) to (66) (page 10 to page 44) represented by the formula (I), compounds HBT-1 to HBT-10 (page 14) represented by the formula (III) in EP 520938A and compounds (1) to (31) (columns 2 to 9) represented by the formula (1) in EP 521823A.

Hereinbelow, the film thickness and swelling rate of the silver halide color photographic light-sensitive material of the present invention are explained.

In the silver halide color photographic light-sensitive material of the first embodiment of the present invention, the sum of the film thicknesses of all hydrophilic colloidal layers on the side provided with the emulsion layer is preferably 28 μm or less, more preferably 23 μm or less, still more preferably 18 μm or less and particularly preferably 16 μm or less.

The film swelling rate $T_{1/2}$ is preferably 60 seconds or less and more preferably 30 seconds or less. $T_{1/2}$ is defined as the time required until the film thickness reaches ½ the saturated film thickness which is 90% of the maximum swelled film thickness attained when the film is processed with a color-developer at 35° C. for 3 minutes. The film thickness means a film thickness measured at 25° C. and a relative humidity of 55% under controlled humid condition (2 days). $T_{1/2}$ can be measured using a swellometer of the type described by A. Green et al. in Photogr. Sci. Eng, Vol 19, 2, page 124 to page 129. $T_{1/2}$ can be regulated by adding a hardener to a gelatin as a binder, or by changing the condition for the lapse of time after application.

The rate of swelling is preferably 180 to 280% and more preferably 200 to 250%.

Here, the rate of swelling means a standard showing the magnitude of equilibrium swelling when the silver halide photographic light-sensitive material of the first embodiment of the present invention is immersed in 35° C. distilled water to swell the material, and it is given by the following equation:

$$\text{Rate of swelling (unit: \%)} = \left(\text{Total film thickness when swelled} \Big/ \text{Total film thickness when dried}\right) \times 100.$$

The above rate of swelling can be made to fall in the above range by regulating the amount of a gelatin hardener to be added.

The film thickness and swelling rate of the silver halide color light-sensitive material for movies according the second embodiment of the present invention each are preferably a smaller value for the purpose of reducing drying loads. The film thickness is preferably 12 μm or less, more preferably 11.5 μm or less, and still more preferably 10.8 μm or less and 8 μm or more. The swelling rate is preferably 200% or less, and more preferably 185% or less and 100% or more. Here, the film thickness means the total thickness of the photographic structural layers on the support. The swelling rate so-called here can be given by the following equation, provided that a film thickness obtained when the film is immersed in distilled water at 27° C. to swell the film over a sufficient period of time is defined as a maximum swelled film thickness:

Swelling rate=100×(Maximum swelled film thickness—Film thickness)÷Film thickness (%).

The swelling rate is allowed to fall in the above range by controlling the amount of a gelatin hardener to be added.

Although there is no particular limitation to the type of gelatin hardener, for example H-1, 46, 8, 14 described in JP-A-1-214845, page 17, compounds (H-1 to -76) represented by the formula (6) described in JP-A-2-214852, page 8, lower right; and compounds (H-1 to 54) represented by one of the formulae (VII to XII) described in U.S. Pat. No. 4,618,573, columns 13 to 23, can be preferably used.

As the silver halide color light-sensitive material for movies according to the second embodiment of the present invention, those which ensures that the maximum density of neutral gray consisting of the yellow color density, magenta color density and cyan color density obtained after developing is 3.3 or more, more preferably 3.3 or more and 4.5 or less, still more preferably 3.0 or more and 4.3 or less, and most preferably 3.5 or more and 4.1 or less.

Herein, the neutral gray can be obtained by performing exposure treatment so as to realize a transmissible neutral gray defined by International Illumination Association. The density can be measured using a densitometer known in the art, for example, an densitometer of Macbeth, X-rite (trade names).

In the second embodiment of the present invention, at least one light-insensitive hydrophilic colloidal layer preferably contains a solid fine-particle dispersion of a dye, and more preferably contains a solid fine-particle dispersion of a dye represented by the formula (I).

Herein, with respect to the second embodiment of the present invention, the explanations and preferable ranges given to the first embodiment of the present invention can be similarly applied to those in the second embodiment of the present invention, unless otherwise specified. Therefore, the explanations for such aspects are omitted, by making references to such explanations.

In the present invention, the ratio of the oil-soluble component to the hydrophilic binder in the photographic structural layer may be optionally set. A preferable ratio in the photographic structural layer other than the protective layer is 0.05 to 1.50, more preferably 0.10 to 1.40, and most preferably 0.20 to 1.30, in terms of mass ratio. The film strength, resistance to scratching or abrasion, and curling characteristics can be controlled by optimizing the ratio of each layer.

The support will be hereinafter explained.

In the present invention, as the support, a transparent support is preferable and a plastic film support is more preferable.

Examples of the plastic film support include films, for example, of a polyethylene terephthalate, polyethylene naphthalate, cellulose triacetate, cellulose acetate butylate, cellulose acetate propionate, polycarbonate, polystyrene or polyethylene.

Among these films, polyethylene terephthalate films are preferable and biaxially oriented (stretched) and thermally fixed polyethylene terephthalate films are particularly preferable in view of stability, toughness and the like.

The thickness of the support is generally 15 to 500 μm, particularly preferably 40 to 200 μm, in view of handling ability and usability for general purposes, and most preferably 85 to 150 μm, though no particular limitation is imposed on the thickness of the above support.

The transmission type support means those through which 90% or more visible light preferably transmits, and the support may contain silicon, alumina sol, chrome salt or zirconium salt which are made into a dye to the extent that it does not substantially inhibit the transmission of light.

The following surface treatment is generally carried out on the surface of the plastic film support, to bond the light-sensitive layer firmly with the surface. The surface on the side where a antistatic layer (backing layer) is formed is likewise surface-treated in general. Specifically, there are the following two methods:

(1) A method, in which surface activating treatment, such as chemical treatment, mechanical treatment, corona discharge treatment, flame treatment, ultraviolet treatment, high-frequency treatment, glow discharge treatment, activated plasma treatment, laser treatment, mixed acid treatment or ozone oxygen treatment, is carried out, and then a photographic emulsion (coating solution for the formation of a light-sensitive layer) is directly applied, to obtain adhesive force; and (2) A method, in which after the above surface treatment is once carried out, an undercoating layer is formed, and a photographic emulsion layer is applied onto the undercoating layer.

Among these methods, the method (2) is more effective and hence widely used. These surface treatments each are assumed to have the effects of: forming a polar group in some degree on the surface of the support which is originally hydrophobic, removing a thin layer which gives an adverse effect on the adhesion of the surface, and increasing the crosslinking density of the surface, thereby increasing the adhesive force. As a result, it is assumed that, for example, the affinity of components contained in a solution of the undercoating layer to the polar group is increased and the fastness of the bonded surface is increased, thereby improving adhesion between the undercoating layer and the surface of the support.

It is preferable that a light-insensitive layer containing conductive metal oxide particles (an antistatic layer) be formed, on the surface of the above plastic film support on the side provided with no light-sensitive layer.

As the binder for the above light-insensitive layer, an acrylic resin, vinyl resin, polyurethane resin or polyester resin is preferably used. The light-insensitive layer for use in the present invention is preferably film-hardened. As the hardener, an aziridine-series, triazine-series, vinylsulfone-series, aldehyde-series, cyanoacrylate-series, peptide-series, epoxy-series, melamine-series or the like is used. Among these, a melamine-series compound is particularly preferable with the view of securing to fix the conductive metal oxide particles firmly.

Examples of materials used for the conductive metal oxide particles may include ZnO, $TiO_2$, $SnO_2$, $Al_2O_3$, $In_2O_3$, MgO, BaO, $MoO_3$ and $V_2O_5$, composite oxides of these oxides, and metal oxides obtained by adding a different type of atom to each of these metal oxides.

As the metal oxide, $SnO_2$, ZnO, $Al_2O_3$, $TiO_2$, $In_2O_3$, MgO and $V_2O_5$ are preferable, $SnO_2$, ZnO, $In_2O_3$, $TiO_2$ and $V_2O_5$ are more preferable and $SnO_2$ and $V_2O_5$ are most preferable.

Examples of the metal oxide containing a small amount of a different type of atom may include those obtained by doping each of these metal oxides with generally 0.01 to 30 mol % (preferably 0.1 to 10 mol %) of a different element, specifically, by doping ZnO with Al or In, $TiO_2$ with Nb or Ta, $In_2O_3$ with Sn and $SnO_2$ with Sb, Nb or a halogen atom. When the amount of the different type of element to be added is too small, only insufficient conductivity can be imparted to the oxide or the composite oxide, whereas when the amount is too large, the blackening of the particle is increased, leading to the formation of a blackish antistatic layer. This shows that the oxides containing a different type of element in the amount out of the above range are unsuitable for the light-sensitive material. Therefore, as materials of the conductive metal oxide particle, metal oxides or composite oxides containing a mall amount of a different type of element are preferable. Those having an oxygen defect in a crystal structure are also preferable.

The conductive metal oxide particles generally have a ratio by volume of 50% or less to the total light-insensitive layers. A preferable ratio is 3 to 30%. The amount of the conductive metal oxide particles to be applied preferably follows the condition described in JP-A-10-62905.

When the volume ratio is too large, the surface of the processed color photograph is easily contaminated, whereas when the ratio is too small, the antistatic function is insufficiently performed.

It is more preferable that the particle diameter of the conductive metal oxide particle be as smaller as possible to decrease light scattering. However, it must be determined based on the ratio of the refractive index of the particle to that of the binder as a parameter, and it can be determined using the Mie's theory. The average particle diameter is generally 0.001 to 0.5 $\mu$m and preferably 0.003 to 0.2 $\mu$m. The average particle diameter so-called here is a value including not only a primary particle diameter but also a particle diameter of higher-order structure of the conductive metal oxide particles.

When the fine particle of the aforementioned metal oxide is added to a coating solution for forming an antistatic layer, it may be added as it is and dispersed. It is preferable to add the fine particle in the form of a dispersion solution in which the fine particle is dispersed in a solvent (including a dispersant and a binder according to the need) such as water.

The light-insensitive layer preferably contains the above hardened product of the above binder and a hardener, which product functions as the binder agent used to disperse and support the conductive metal oxide particle. In the present invention, it is preferable that both of the binder and the hardener which are soluble in water or in the state of a water dispersion, such as an emulsion, be used with the view of maintaining a better working environment and preventing air pollution. Also, the binder preferably has any group among a methylol group, hydroxyl group, carboxyl group and glycidyl group, to enable a crosslinking reaction with the hardener. A hydroxyl group and carboxyl group are preferable and a carboxyl group is particularly preferable. The content of the hydroxyl or carboxyl group in the binder is preferably 0.0001 to 1 equivalent/1 kg and particularly preferably 0.001 to 1 equivalent/1 kg.

Preferable resins used as the binder will be hereinafter explained.

Examples of acrylic resins may include homopolymers of any one monomer of acrylic acid, acrylates, such as alkyl acrylates; acrylamides; acrylonitriles, methacrylic acid; methacrylates, such as alkyl methacrylates; methacrylamides and methacrylonitriles, and copolymers obtained by polymerizing two or more of these monomers. Among these polymers or copolymers, homopolymers of any one monomer of acrylates, such as alkyl acrylates, and methacrylates, such as alkyl methacrylates, or copolymers obtained by polimerization of two or more of these monomers, are preferable. Examples of these homopolymers or copolymers may include homopolymers of any one monomer of acrylates and methacrylates having an alkyl group having 1 to 6 carbon atoms, or copolymers obtained by the polymerization of two or more of these monomers.

The above acrylic resin is preferably a polymer obtained by using the above composition as its major components and by partially using a monomer having any group of, for example, a methylol group, hydroxyl group, carboxyl group and glycidyl group so as to enable a crosslinking reaction with the hardener.

Preferable examples of the above vinyl resin include a polyvinyl alcohol, acid-denatured polyvinyl alcohol, polyvinyl formal, polyvinyl butyral, polyvinyl methyl ether, polyolefin, ethylene/butadiene copolymer, polyvinyl acetate, vinyl chloride/vinyl acetate copolymer, vinyl chloride/(meth)acrylate copolymer and ethylene/vinyl acetate-series copolymer (preferably an ethylene/vinyl acetate/(meth) acrylate copolymer). Among these, a polyvinyl alcohol, acid-denatured polyvinyl alcohol, polyvinyl formal, polyolefin, ethylene/butadiene copolymer and ethylene/vinyl acetate-series copolymer (preferably an ethylene/vinyl acetate/acrylate copolymer) are preferable.

In order for the above vinyl resin to be able to crosslink with the hardener, a polyvinyl alcohol, acid-denatured polyvinyl alcohol, polyvinyl formal, polyvinyl butyral, polyvinyl methyl ether and polyvinyl acetate are respectively formed as a polymer having a hydroxyl group by, for example, leaving a vinyl alcohol unit in the polymer; and other polymers are respectively formed by partially using a monomer having any one group, for example, of a methylol group, hydroxyl group, carboxyl group and glycidyl group.

Examples of the above polyurethane resin may include polyurethanes derived from any one of a polyhydroxy compound (e.g., ethylene glycol, propylene glycol, glycerol and trimethylol propane), an aliphatic polyester-series polyol obtained by a reaction between a polyhydroxy compound and a polybasic acid; a polyether polyol (e.g., poly (oxypropylene ether)polyol, poly(oxyethylene-propylene ether) polyol), a polycarbonate-series polyol, and a polyethylene terephthalate polyol; or those derived from a polyisocyanate and a mixture of the above.

In the case of the above polyurethane resin, for instance, a hydroxyl group that is left unreacted after the reaction between the polyol and the polyisocyanate is completed, may be utilized as a functional group which can run a crosslinking reaction with the hardener.

As the above polyester resin, polymers obtained by a reaction between a polyhydroxy compound (e.g., ethylene glycol, propylene glycol, glycerol and trimethylolpropane) and a polybasic acid are generally used.

In the case of the above polyester resin, for instance, a hydroxyl group or a carboxyl group that is left unreacted after the reaction between the polyol and the polybasic acid is completed, may be utilized as a functional group which can run a crosslinking reaction with the hardener. Of course, a third component having a functional group such as a hydroxyl group may be added.

Among the above polymers, acrylic resins and polyurethane resins are preferable and acrylic resins are particularly preferable.

Examples of the melamine compound preferably used as the hardener include compounds having two or more (preferably three or more) methylol groups and/or alkoxymethyl groups in a melamine molecule, melamine resins which are condensation polymers of the above compounds, and melamine/urea resins.

Examples of initial condensation products of melamine and formalin include, though not limited to, dimethylolmelamine, trimethylolmelamine, tetramethylolmelamine, pentamethylolmelamine and hexamethylolmelamine. Specific examples of commercially available products of these compounds may include, though not limited to, Sumitex Resins M-3, MW, MK and MC (trade names, manufactured by Sumitomo Chemical Co., Ltd.).

Examples of the above condensation polymer may include, though not limited to, a hexamethylolmelamine resin, trimethylolmelamine resin and trimethyloltrimethoxymethylmelamine resin. Examples of commercially available products may include, though not limited to, MA-1 and MA-204 (trade names, manufactured by Sumitomo Bakelite), BECKAMINE MA-S, BECKAMINE APM and BECKAMINE J-101 (trade names, manufactured by Dainippon Ink and Chemicals Inc.), Yuroid 344 (trade name, manufactured by Mitsui Toatsu Chemicals) and Oshika Resin M31 and Oshika Resin PWP-8 (trade names, manufactured by Oshika Shinko Co., Ltd.).

As the melamine compound, it is preferable that the functional group equivalence given by a value obtained by dividing its molecular weight by the number of functional groups in one molecule be 50 or more and 300 or less. Here, the functional group indicates a methylol group and/or an alkoxymethyl group. If this value exceeds 300, only small cured density is obtained and hence high mechanical strength is not obtained in some cases. Then, if the amount of the melamine compound is increased, the coatability is reduced. When the cured density is small, scratches tend to be caused. Also, if the level of curing is low, the force supporting the conductive metal oxide is also reduced. When the functional group equivalence is less than 50, the cured density is increased but the transparency is impaired and even if the amount of the melamine compound is reduced, the condition is not bettered in some cases.

The amount of an aqueous melamine compound to be added is generally 0.1 to 100 mass % and preferably 10 to 90 mass %, to the aforementioned polymer.

Matt agents, surfactants, lubricants and the like may further be used in the antistatic layer, according to the need.

Examples of the matt agent include oxides, such as silicon oxide, aluminum oxide and magnesium oxide, having a particle diameter of 0.001 to 10 $\mu$m, and polymers and copolymers, such as a poly(methyl methacrylate) and polystyrene.

Given as examples of the surfactant are known surfactants, such as anionic surfactants, cationic surfactants, amphoteric surfactants and nonionic surfactants.

Examples of the lubricants may include phosphates of higher alcohols having 8 to 22 carbon atoms or their amino salts; palmitic acid, stearic acid and behenic acid, and their esters; and silicone-series compounds.

The thickness of the aforementioned antistatic layer is preferably 0.01 to 1 $\mu$m and more preferably 0.01 to 0.2 $\mu$m. When the thickness is too thick, coating nonuniformity tends to be caused on the resultant product since it is hard to apply a coating material uniformly. On the other hand, when the thickness is too thin, there is the case where inferior antistatic ability and resistance to scratching are obtained.

It is preferable to dispose a surface layer on the above antistatic layer. The surface layer is provided primarily to improve lubricity and resistance to scratching, as well as to aid the ability to prevent the conductive metal oxide particles of the antistatic layer from desorbing.

Examples of materials for the above surface layer include (1) waxes, resins and rubber-like products comprising homopolymers or copolymers of 1-olefin-series unsaturated hydrocarbons, such as ethylene, propylene, 1-butene and 4-methyl-1-pentene (e.g., a polyethylene, polypropylene, poly-1-butene, poly-4-methyl-1-pentene, ethylene/propylene copolymer, ethylene/1-butene copolymer and propylene/1-butene copolymer), (2) rubber-like copolymers of two or more types of the above 1-olefin and a conjugated or non-conjugated diene (e.g., an ethylene/propylene/ethylidene norbornane copolymer, ethylene/propylene/1,5-hexadiene copolymer and isobutene/isoprene copolymer), (3) copolymers of a 1-olefin and a conjugated or non-conjugated diene (e.g., an ethylene/butadiene copolymer and ethylene/ethylidene norbornane copolymer), (4) copolymers of a 1-olefin, particularly, ethylene and vinyl acetate; and completely or partly saponified products of these copolymers, and (5) graft polymers obtained by grafting the above conjugated or non-conjugated diene or vinyl acetate on a homopolymer or copolymer of a 1-olefin; and completely or partly saponified products of these graft polymers. However, the materials for the surface layer are not limited to these compounds. The aforementioned compounds are described in JP-B-5-41656 ("JP-B" means examined Japanese patent publication).

Among these compounds, those which are polyolefins and having a carboxyl group and/or a carboxylate group are preferable. These polyolefins are generally used in the form of an aqueous solution or a water dispersion solution.

An aqueous methyl cellulose of which the degree of methyl group substitution is 2.5 or less may be added in the surface layer, and the amount of the methyl cellulose to be added is preferably 0.1 to 40 mass % to the total binding agents forming the surface layer. The above aqueous methyl cellulose is described in JP-A-1-210947.

The above surface layer may be formed by applying a coating solution (water dispersion or aqueous solution) containing the aforementioned binder and the like, onto the antistatic layer, by using a generally well-known coating method, such as a dip coating method, air knife coating method, curtain coating method, wire bar coating method, gravure coating method or extrusion coating method.

The thickness of the above surface layer is preferably 0.01 to 1 $\mu$m and more preferably 0.01 to 0.2 $\mu$m. When the thickness is too thick, coating nonuniformity of the product tends to be caused because it is hard to apply a coating material uniformly. When the thickness is too thin, there is the case where the antistatic ability and resistance to scratching are inferior.

The pH of a coating in the silver halide color photographic light-sensitive material of the present invention is preferably 4.6 to 6.4 and more preferably 5.5 to 6.5. When the pH of the coating is too high, in a sample long under the lapse of time, a cyan image and a magenta image are greatly sensitized by irradiation with safelight. On the contrary, when the pH of the coating is too low, the density of a yellow image largely changes with a change in the time elapsing since the light-sensitive material is exposed until it is developed. Either of the cases pose practical problems.

The pH of the coating in the silver halide color photographic light-sensitive material of the present invention means the pH of all photographic layers obtained by applying each coating solution to the support, and it does not always coincides with the pH of the individual coating solution. The pH of the coating can be measured by the following method as described in JP-A-61-245153. Specifically;

(1) 0.05 ml of pure water is added dropwise to the surface of the light-sensitive material on the side to which the silver halide emulsion is applied. Then;

(2) after the coating is allowed to stand for 3 minutes, the pH of the coating is measured using a surface pH measuring electrode (GS-165F, trade name, manufactured by Towa Denpa). The pH of the coating can be adjusted using an acid (e.g., sulfuric acid or citric acid) or an alkali (e.g., sodium hydroxide or potassium oxide), if necessary.

In the present invention, the first embodiment and the second embodiment can be properly combined, to give a more preferable embodiment of the invention.

The present invention ensures that the aforementioned conventional problems can be solved, and that the objects of the present invention can be attained.

According to the first embodiment of the present invention, a silver halide color photographic light-sensitive material, especially a silver halide color photographic light-sensitive material for movies, which gives a hue excellent in a magenta color image, brings about a quite high color density and is excellent in processing stability, can be provided.

Among the second embodiment of the present invention, according to the inventions of the said <6> and <12>, a silver halide color light-sensitive material for movies which has quite high sensitivity, is free from residual color after processing and can be processed more rapidly, as well as an image-formation method, can be provided.

Among the second embodiment of the present invention, according to the inventions of the said <7> to <12>, a silver halide color light-sensitive material for movies which has quite high image quality, especially, good graininess and high sharpness, good reciprocity property, high in development progress characteristics, and can be processed more rapidly, as well as an image-forming method, can be provided.

The present invention will be described in more detail based on examples given below, but the present invention is not meant to be limited by these examples.

EXAMPLES

Example 1-1

Preparation of a Support

A polyethylene terephthalate film support (thickness: 120 $\mu$m), provided with an undercoat on the side of the surface to which an emulsion was applied, and also provided with an acrylic resin layer which contained the following conductive polymer (0.05 g/m$^2$) and tin oxide fine particles (0.20 g/m$^2$) and which was applied to the side opposite to the surface to which the emulsion was applied, was prepared.

Conductive polymer

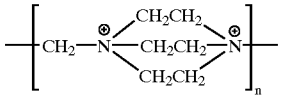

Preparation of a Solid Fine-particle Dispersion of a Dye)

A methanol wet cake of the aforementioned exemplified compound (IV-1) was weighed such that the net amount of the compound was 240 g and 48 g of the aforementioned exemplified compound (V-12) as a dispersing aid was weighed. To both compounds was added water such that the total amount was 4000 g. The mixture was crushed at a discharge rate of 0.5 1/min and a peripheral velocity of 10 m/s for 2 hours by using "a flow system sand grinder mill (UVM-2)" (manufactured by AIMEX K.K.) filled with 1.7 l of zirconia beads (diameter: 0.5 mm). Then, the dispersion was diluted such that the concentration of the compound was 3 mass % and the following compound of the formula (VI-2) was added in an amount of 3% in terms of mass ratio to the dye (called a dispersion 1-A). The average particle size of this dispersion was 0.45 $\mu$m.

Dispersions (1-A to 1-G) were prepared in the same manner as in the above, except for changing, as shown in Table 1, the type of dye and the heating condition as to whether heat treatment was performed or not after the solid fine-particle dispersion of dye was prepared. In the case of performing the heat treatment, the compound (VI-2) was added after the heat treatment was finished.

TABLE 1

Solid fine-particle dispersions used in Example 1-1

| Dispersion | Kind of dye | Heat treatment (temperature/time) |
|---|---|---|
| 1-A | IV-1 | Not conducted |
| 1-B | Dye for comparison | Not conducted |
| 1-C | Dye for comparison | 60° C.-5 days |
| 1-D | IV-1 | 90° C.-10 hours |
| 1-E | IV-1 | 60° C.-5 days |
| 1-F | I-1 | 90° C.-10 hours |
| 1-G | III-2 | 90° C.-10 hours |

Dye for comparison

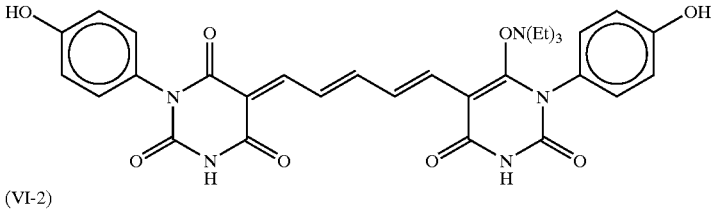

(VI-2)

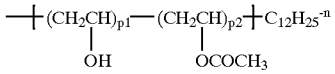

$p_1$ = 88 mol %
$p_2$ = 12 mol %
Degree of polymerization 300

Preparation of Sample 101

Each layer having the composition shown below was applied to a support by multilayer-coating, thereby producing a multilayer silver halide color photographic light-sensitive material as Sample 101. Coating solutions for each photographic constitutional layer were prepared as follows.

Preparation of a Coating Solution for a Sixth Layer 83.3 g of a magenta coupler (ExM), 1.5 g of an additive (Cpd-9), 0.1 g of an additive (Cpd-11) and 2.0 g of an additive (Cpd-13) were dissolved in 80 g of a solvent (Solv-1) and 80 ml of ethyl acetate. The solution was emulsified and dispersed in 1000 g of an aqueous 10% gelatin solution containing 40 ml of 10% sodium dodecylbenzene sulfonate, to prepare an emulsified dispersion 1-M.

Separately, a silver chlorobromide emulsion 1-G1 (a cubic, a mixture of a large-sized emulsion GL1 having an average particle size of 0.200 $\mu$m, an intermediate-sized emulsion GM1 having an average particle size of 0.136 $\mu$m and a small-sized emulsion GS1 having an average particle size of 0.102 $\mu$m which were mixed in a ratio of 3:5:2 (mol ratio of silver). The coefficients of variation in the distribution of particle size were 15%, 14% and 16% respectively. Each emulsion had the same halogen composition (Br/Cl=25/75)), was prepared. Various sensitizing dyes shown below had been added to each emulsion in the following amount per one mol of silver: a sensitizing dye D was added in an amount of $1.0\times10^{-4}$ mol to the large-sized emulsion GL1, $2.0\times10^{-4}$ mol to the intermediate-sized emulsion GM1 and $5.0\times10^{-4}$ mol to the small-sized emulsion GS1, a sensitizing dye E was added in an amount of $0.8\times10^{-4}$mol to GL1, $1.3\times10^{-4}$ mol to GM1 and $1.8\times10^{-4}$ mol to GS1, a sensitizing dye F was added in an amount of $1.2\times10^{-4}$ mol to GL1, $1.5\times10^{-4}$ mol to GM1 and $1.9\times10^{-4}$ mol to GS1, and a sensitizing dye G was added in an amount of $0.3\times10^{-4}$ mol to GL1, $0.6\times10^{-4}$ mol to GM1 and $1.0\times10^{-4}$ mol to GS1. Also, chemical ripening of each emulsion was carried out optimally by adding a sulfur sensitizer and a gold sensitizer.

The above emulsified dispersion 1-M and the silver chlorobromide emulsion 1-G1 were mixed and dissolved, to prepare a coating solution for a sixth layer such that the solution had the following composition. The amount of the emulsion to be applied shows an amount in terms of silver to be applied.

A coating solution for each of a first layer to a seventh layer excluding the sixth layer were prepared in the same manner as in the preparation of the coating solution for the sixth layer. As the gelatin hardener for each layer, a sodium salt of 1-oxy-3,5-dichloro-s-triazine was used.

As the silver chlorobromide emulsions of the light-sensitive emulsion layers, the following spectral sensitizing dyes were respectively used.

Blue Light-sensitive Emulsion Layer (Sensitizing dye A)

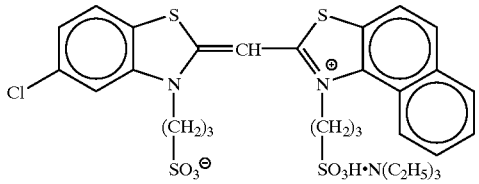

-continued (Sensitizing dye B)

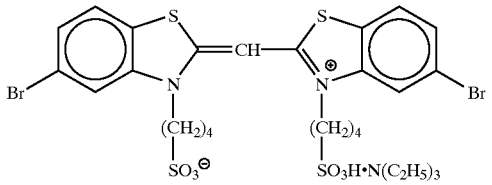

(Sensitizing dye C)

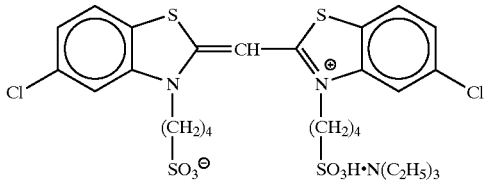

-continued (Sensitizing dye D)

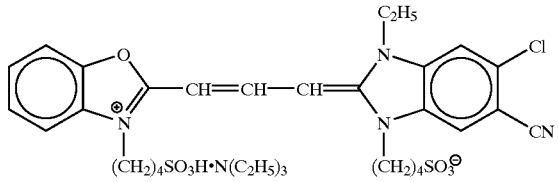

(The above sensitizing dyes were added to each emulsion in the following amount per one mol of silver halide: a sensitizing dye A was added in an amount of $3.5\times10^{-4}$ mol to the large-sized emulsion BL1, $4.6\times10^{-4}$ mol to the intermediate-sized emulsion BM1 and $5.3\times10^{-4}$ mol to the small-sized emulsion BS1, a sensitizing dye B was added in an amount of $2.4\times10^{-5}$ mol to BL1, $4.6\times10^{-5}$ mol to BM1 and $6.3\times10^{-5}$ mol to BS1, and a sensitizing dye C was added in an amount of $1.8\times10^{-4}$ mol to BL1, $2.7\times10^{-5}$ mol to BM1 and $3.7\times10^{-4}$ mol to BS1.)

Red Light-sensitive Emulsion Layer (Sensitizing dye E)

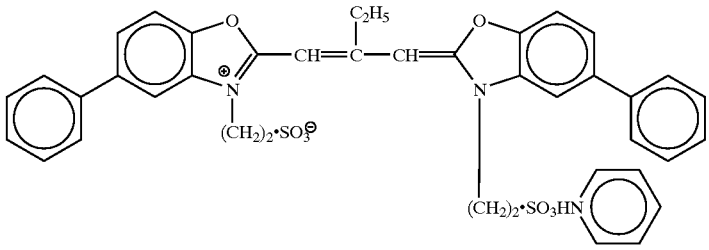

(Sensitizing dye F)

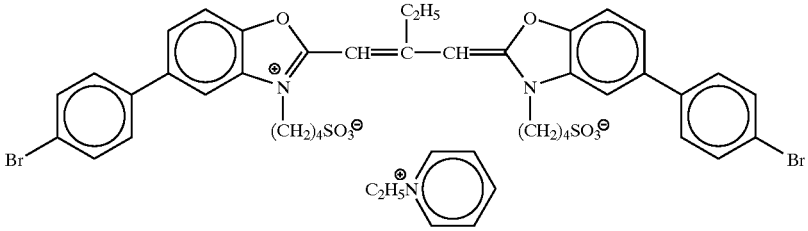

(Sensitizing dye G)

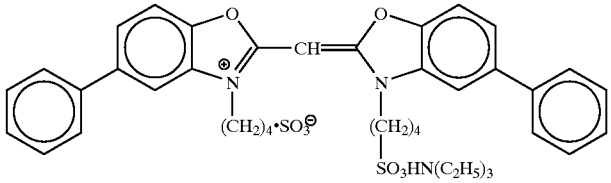

(The above sensitizing dyes were added to each emulsion in the following amount per one mol of silver halide: a sensitizing dye H was added in an amount of $2.1\times10^{-5}$ mol to the large-sized emulsion RL1, $3.3\times10^{-5}$ mol to the intermediate-sized emulsion RM1 and $4.6\times10^{-5}$ mol to the small-sized emulsion RS1, a sensitizing dye I was added in an amount of $1.5\times10^{-5}$ mol to RL1, $2.3\times10^{-5}$ mol to RM1 and $3.6\times10^{-5}$ mol to RS1, and a sensitizing dye J was added in an amount of $0.8\times10^{-5}$ mol to RL1, $1.4\times10^{-5}$ mol to RM1 and $2.1\times10^{-5}$mol to RS1.)

(Sensitizing dye H)

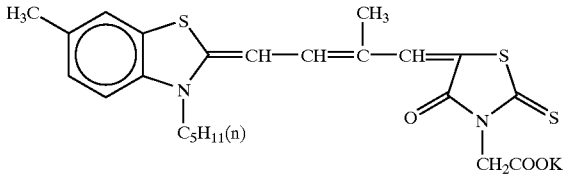

(Sensitizing dye I)

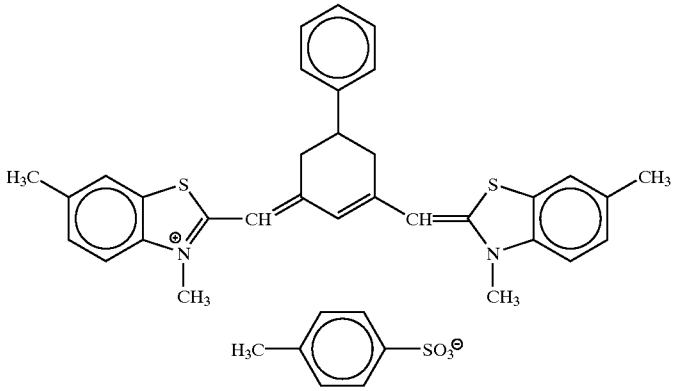

(Sensitizing dye J)

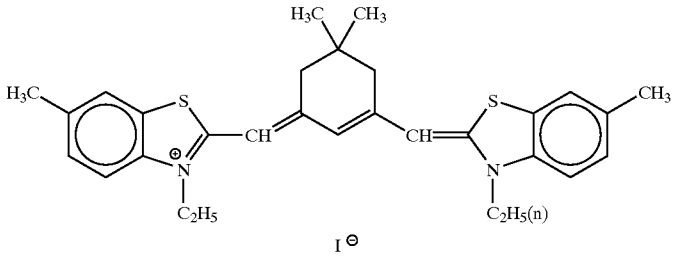

(These dyes each were used in the amount as aforementioned.)

Further, the following compound was added to the red light-sensitive emulsion layer in an amount of $9.0\times10^{-4}$ mol per one mol of silver halide.

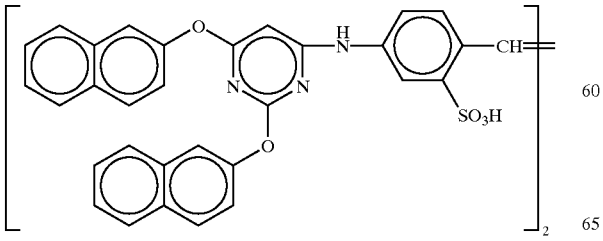

The following dye (numerals in the parenthesis show the amount to be applied) was added to the light-sensitive emulsion layers, to prevent irradiation.

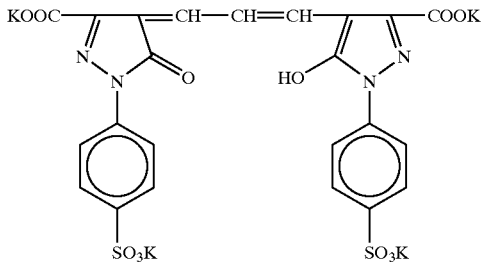

(0.040 g/m$^2$)

-continued

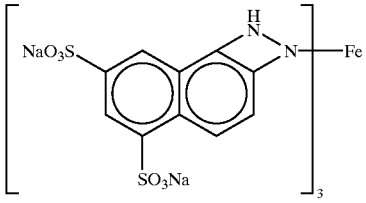

(0.094 g/m$^2$)

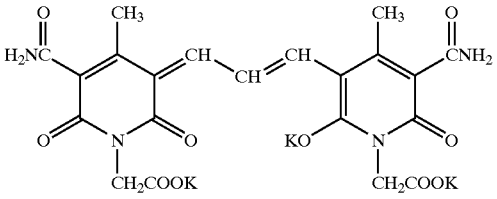

(0.018 g/m$^2$)

(Layer Constitution)

The composition of each layer is shown below. The numerals show the amount (g/m$^2$) to be applied. As the amount of the silver halide emulsion, an amount converted into that of silver is shown.

| Support<br>Polyethylene terephthalate film | |
|---|---|
| First layer (halation preventive layer) | |
| Gelatin | 0.70 |
| Dye 1-A (fine particle solid dispersion) | 0.11 |
| Second layer (blue light-sensitive emulsion layer) | |
| A silver chlorobromide emulsion 1-B1 (a cubic, average silver halide composition Br/Cl = 0.7 mol %: 99.3 mol %, a mixture of a gold and sulfur sensitized emulsion BL1 having and average particle size of 0.70 μm, an emulsion BM1 (the same as the emulsion BL1 except that the average particle diameter was 0.51 μm) and an emulsion BS1 (the same as the emulsion BL1 except that the average particle diameter was 0.41 μm) mixed in a ratio of 1:5:4 (mol ratio of silver).) | 0.49 |
| Gelatin | 2.10 |
| Yellow coupler (ExY) | 1.19 |
| (Cpd-1) | 0.0006 |
| (Cpd-2) | 0.03 |
| (Cpd-4) | 0.006 |
| (Cpd-5) | 0.019 |
| (Cpd-6) | 0.003 |
| Solvent (Solv-1) | 0.24 |
| Third Layer (Color-Mixing Inhibiting Layer) | |
| Gelatin | 0.47 |
| (Cpd-9) | 0.04 |
| (Cpd-3) | 0.03 |
| Solvent (Solv-1) | 0.06 |
| Solvent (Solv-4) | 0.04 |
| Solvent (Solv-5) | 0.002 |
| Fourth layer (red light-sensitive emulsion layer) | |
| A silver chlorobromide emulsion 1-R1 (a cubic, average silver halide composition Br/Cl = 25 mol %: 75 mol %, a mixture of a gold and sulfur sensitized emulsion RL1 having an average particle size of 0.232 μm, an emulsion RM1 (the same as the emulsion RL1 except that the average particle diameter was 0.154 μm) and an emulsion RS1 (the same as the emulsion RL1 except that the average particle diameter was 0.121 μm) mixed in a ratio of 2:6:2 (mol ratio of silver).) | 0.41 |
| Gelatin | 2.47 |
| Cyan coupler (ExC) | 0.71 |

-continued

| Support<br>Polyethylene terephthalate film | |
|---|---|
| (Cpd-7) | 0.06 |
| (Cpd-8) | 0.05 |
| (Cpd-10) | 0.03 |
| (Cpd-13) | 0.02 |
| Solvent (Solv-1) | 0.47 |
| Solvent (Solv-2) | 0.32 |
| Solvent (Solv-4) | 0.02 |
| Fifth Layer (Color-Mixing Inhibiting Layer) | |
| Gelatin | 0.47 |
| (Cpd-9) | 0.04 |
| (Cpd-3) | 0.03 |
| Solvent (Solv-1) | 0.06 |
| Solvent (Solv-4) | 0.04 |
| Solvent (Solv-5) | 0.002 |
| Sixth Layer (Green Light-Sensitive Emulsion Layer) | |
| The above-described silver chlorobromide emulsion 1-G1 | 0.55 |
| Gelatin | 1.48 |
| Magenta coupler (ExM) | 0.68 |
| (Cpd-9) | 0.014 |
| (Cpd-11) | 0.001 |
| (Cpd-13) | 0.019 |
| Solvent (Solv-1) | 0.65 |
| Seventh Layer (Protective Layer) | |
| Gelatin | 0.96 |
| Acryl-modified copolymer of polyvinyl alcohol (modification degree: 17%) | 0.02 |
| (Cpd-12) | 0.04 |

The compounds used here are shown below.

E x Y A mixture in 80:10:10 (molar ratio) of (1), (2), and (3)

(1)

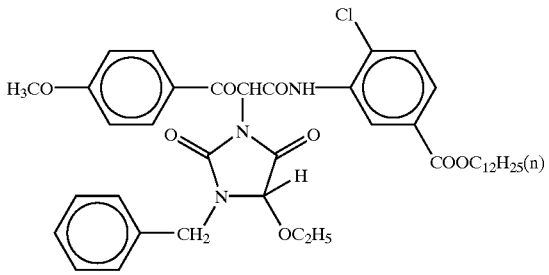

(2)

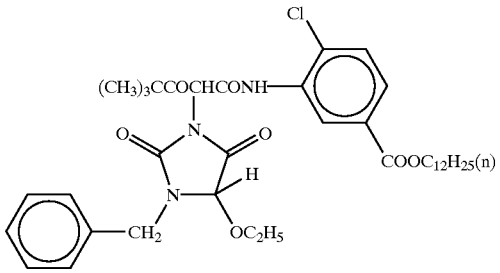

-continued
(3)
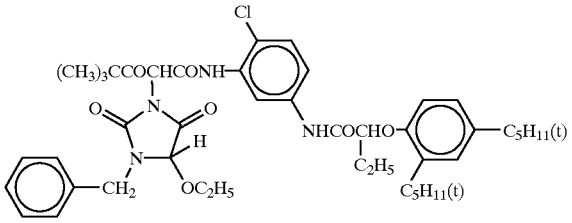
E x M
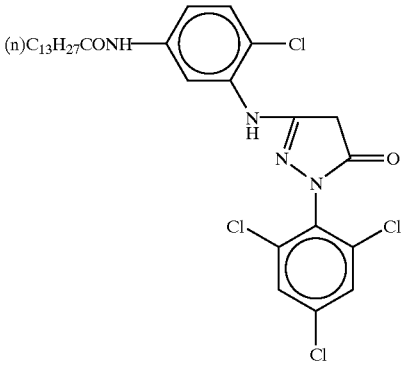
E x C Compounds in 40:40:20 (molar ratio) of (1), (2), and (3)
(1)
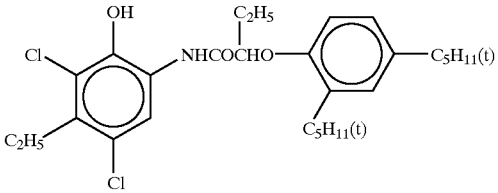
(2)
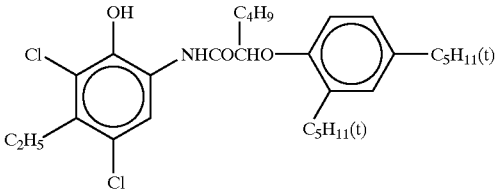
(3)
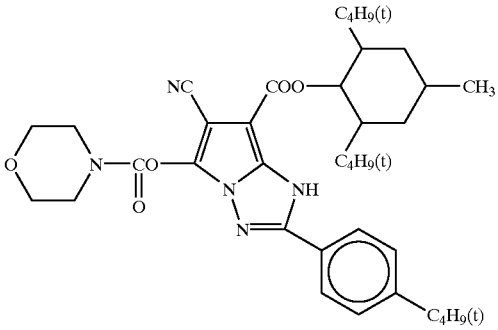
(Cpd-1)
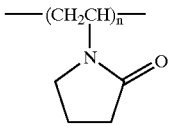
-continued
(Cpd-2)
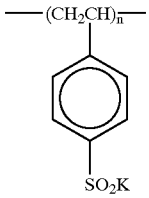
(Cpd-3)
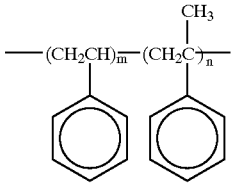
number–average
molecular weight 600
$m/n$ = 10/90
(Cpd-4)
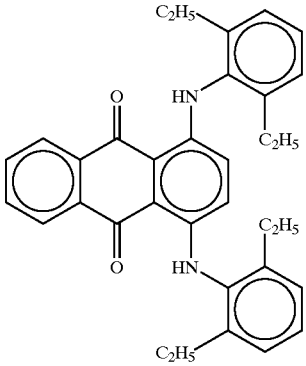
(Cpd-5)
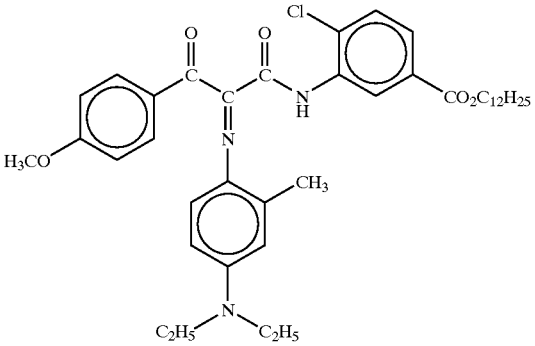
(Cpd-6)
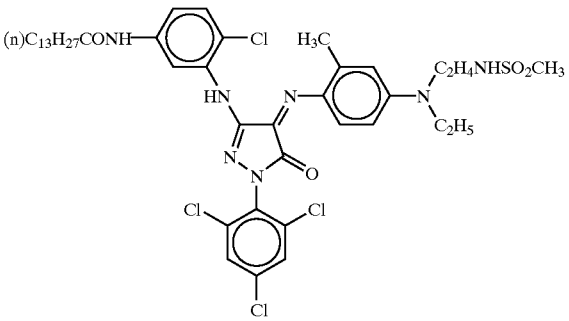

-continued (Cpd-7)

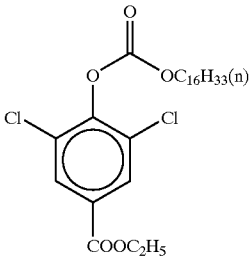

(Cpd-8)

average molecular weight about 60,000

(Cpd-9)

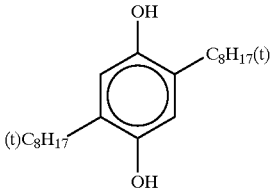

(Cpd-10)

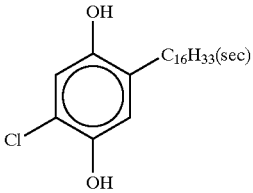

(Cpd-11)

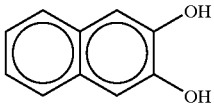

A mixture in 7:1 (weight ratio) of (Cpd-12)

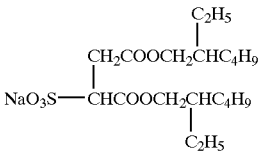

and

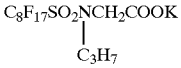

(Cpd-13)

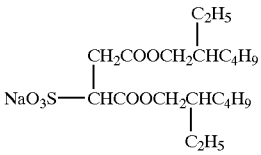

(Solv-1)

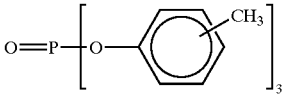

(Solv-2)

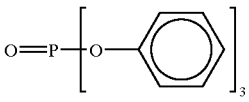

(Solv-3)

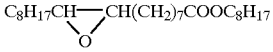

-continued (Solv-4)

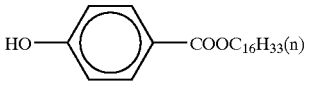

Preparation of Emulsion Particles

In the emulsions 1-R1 and 1-G1 used in the sample 101, only the halogen composition when the particle was formed was changed as shown in Table 2, to produce emulsions. Sensitizing dyes were added to each of these emulsions in the same amounts as in the cases of 1-R1 and 1-G1, and chemical ripening of each emulsion was carried out optimally by adding a sulfur sensitizer and a gold sensitizer.

TABLE 2

Halogen composition of emulsions used in Example 1-1

| Name of emulsion | Cl/Br (mol ratio) | Name of emulsion | Cl/Br (mol ratio) |
|---|---|---|---|
| 1-R1 | 75/25 | 1-G1 | 75/25 |
| 1-R2 | 90/10 | 1-G2 | 90/10 |
| 1-R3 | 97/3 | 1-G3 | 97/3 |
| 1-R4 | 99.5/0.5 | 1-G4 | 99.5/0.5 |

Production of Samples 102 to 128

In the sample 101, the type of dye solid dispersion and content of the dye used in the first layer were altered, the emulsion used in each layer and the ratio by mass of the high boiling point organic solvent to the coupler were altered, further a part or all of the magenta coupler ExM used in the sixth layer of the sample 101 was replaced by the magenta coupler for use in the present invention, and the position of each of the three types of emulsion layer relative to the first layer was altered, to produce samples 102 to 128.

In this case, the alteration in the content of the dye in the first layer was performed by fixing the amount of the dye to be applied and by altering the amount of the gelatin to be applied. The replacement of the coupler was performed in a manner as to replace the same mols as that of ExM of the sample 101. The content of each sample is shown in Tables 3 and 4.

TABLE 3

Contents of Samples and results of evaluations

| | | Dye solid fine particle dispersion | | | Magenta coupler according to the present invention | |
|---|---|---|---|---|---|---|
| Sample No. | Layer structure | Kind | Dye content (wt %) | Emulsion used | Kind | Using ratio (mol %) |
| 101 | B→R→G | 1-A | 16 | 1-R1, 1-G1 | ExM | 0 |
| 102 | B→R→G | 1-A | 16 | 1-R2, 1-G2 | ExM | 0 |
| 103 | B→R→G | 1-A | 16 | 1-R3, 1-G3 | ExM | 0 |
| 104 | B→R→G | 1-A | 16 | 1-R4, 1-G4 | ExM | 0 |
| 105 | B→R→G | 1-A | 16 | 1-R4, 1-G4 | M-30 | 100 |
| 106 | B→G→R | 1-A | 16 | 1-R4, 1-G4 | M-30 | 100 |
| 107 | G→B→R | 1-A | 16 | 1-R4, 1-G4 | M-30 | 100 |
| 108 | G→R→B | 1-A | 16 | 1-R4, 1-G4 | M-30 | 100 |
| 109 | B→R→G | 1-A | 16 | 1-R4, 1-G4 | M-30/ExM | 20 |
| 110 | B→R→G | 1-B | 16 | 1-R4, 1-G4 | M-30 | 100 |
| 111 | B→R→G | 1-C | 16 | 1-R4, 1-G4 | M-30 | 100 |
| 112 | B→R→G | 1-D | 16 | 1-R4, 1-G4 | M-30 | 100 |
| 113 | B→R→G | 1-D | 16 | 1-R4, 1-G4 | M-30 | 100 |

TABLE 3-continued

Contents of Samples and results of evaluations

| Sample No. | Layer structure | Dye solid fine particle dispersion Kind | Dye content (wt %) | Emulsion used | Magenta coupler according to the present invention Kind | Using ratio (mol %) |
|---|---|---|---|---|---|---|
| 114 | B→R→G | 1-D | 16 | 1-R4, 1-G4 | M-30 | 100 |
| 115 | B→R→G | 1-E | 16 | 1-R4, 1-G4 | M-30 | 100 |
| 116 | B→R→G | 1-F | 16 | 1-R4, 1-G4 | M-30 | 100 |
| 117 | B→R→G | 1-G | 16 | 1-R4, 1-G4 | M-30 | 100 |
| 118 | B→R→G | 1-D | 16 | 1-R1, 1-G1 | M-30 | 100 |
| 119 | B→R→G | 1-D | 16 | 1-R2, 1-G2 | M-30 | 100 |
| 120 | B→R→G | 1-D | 16 | 1-R3, 1-G4 | M-30 | 100 |
| 121 | B→R→G | 1-D | 16 | 1-R4, 1-G4 | M-30/ExM | 20 |
| 122 | B→R→G | 1-D | 35 | 1-R4, 1-G4 | M-30 | 100 |
| 123 | B→R→G | 1-D | 40 | 1-R4, 1-G4 | M-30 | 100 |
| 124 | B→R→G | 1-D | 16 | 1-R4, 1-G4 | M-21/ExM | 20 |
| 125 | B→R→G | 1-D | 16 | 1-R4, 1-G4 | M-21/ExM | 50 |
| 126 | B→R→G | 1-D | 16 | 1-R4, 1-G4 | M-47/ExM | 50 |
| 127 | B→R→G | 1-D | 16 | 1-R4, 1-G4 | M-47/ExM | 100 |
| 128 | B→R→G | 1-D | 16 | 1-R4, 1-G4 | M-46/ExM | 50 |

Note: In table, in the description of the column "layer structure", each of B, R, and G represents a blue light-sensitive emulsion layer, a red light-sensitive emulsion layer, and a green light-sensitive emulsion layer, respectively. The order is, from the left side, the second layer, the fourth layer, and the sixth layer. For example, the description "G→B→R" means, the sample has a green light-sensitive emulsion layer, a red light-sensitive emulsion layer, and a blue sensitive emulsion layer, as the second, fourth, and sixth layers, respectively.

Preparation of a Processing Solution

A processing process, according to the ECP-2 process published from Eastman Kodak as a standard method of processing a color positive film for movies was utilized with the modification that the sound development step was excluded from the ECP-2 process. Then, for the purpose of preparing a developing process condition placed in a running equilibrium state, all samples produced as above were respectively exposed to such an image that about 30% of the amount of silver to be applied would be developed, and then each sample which had been exposed was subjected to continuous processing (running test) performed according to the above processing process, until the amount of the replenisher solution in a color developing bath was twice the tank volume. ECP-2 process (excluding the sound developing step)

<Step>

| Name of steps | Process Temp. (° C.) | Process time (sec) | Replenished amount (ml per 35 mm × 30.48 m) |
|---|---|---|---|
| 1. Pre-bath | 27 ± 1 | 10–20 | 400 |
| 2. Washing | 27 ± 1 | Jet water washing | — |
| 3. Developing | 36.7 ± 0.1 | 180 | 690 |
| 4. Stop | 27 ± 1 | 40 | 770 |
| 5. Washing | 27 ± 3 | 40 | 1200 |
| 6. First fixing | 27 ± 1 | 40 | 200 |
| 7. Washing | 27 ± 3 | 40 | 1200 |
| 8. Bleach acceleration | 27 ± 1 | 20 | 200 |
| 9. Bleaching | 27 ± 1 | 40 | 200 |
| 10. Washing | 27 ± 3 | 40 | 1200 |

-continued

| Name of steps | Process Temp. (° C.) | Process time (sec) | Replenished amount (ml per 35 mm × 30.48 m) |
|---|---|---|---|
| 12. Second fixing | 27 ± 1 | 40 | 200 |
| 13. Washing | 27 ± 3 | 60 | 1200 |
| 14. Rinsing | 27 ± 3 | 10 | 400 |
| 15. Drying | | | |

<Formulation of Process Solutions>
Composition Per 1 l is Shown.

| Name of steps | Name of Chemicals | Tank solution | Replenishing solution |
|---|---|---|---|
| Pre-bath | VOLAX | 20 g | 20 g |
| | Sodium sulfate | 100 g | 100 g |
| | Sodium hydroxide | 1.0 g | 1.5 g |
| Developing | Kodak | | |
| | Anti-calcium No.4 | 1.0 ml | 1.4 ml |
| | Sodium sulfite | 4.35 g | 4.50 g |
| | CD-2 | 2.95 g | 6.00 g |
| | Sodium carbonate | 17.1 g | 18.0 g |
| | Sodium bromide | 1.72 g | 1.60 g |
| | Sodium hydroxide | — | 0.6 g |
| | Sulfuric acid (7N) | 0.62 ml | — |
| Stop | Sulfuric acid (7N) | 50 ml | 50 ml |
| Fixing (common to the first fixing and the second fixing) | Ammonium thiosulfate (58%) | 100 ml | 170 ml |
| | Sodium sulfite | 2.5 g | 16.0 g |
| | Sodium hydrogen sulfite | 10.3 g | 5.8 g |
| | Potassium iodide | 0.5 g | 0.7 g |
| Bleach accelerating | Sodium hydrogen-methasulfite | 3.3 g | 5.6 g |
| | Acetic acid | 5.0 ml | 7.0 ml |
| | PBA-1 (Kodak Persulfate Bleach Accelerator) | 3.3 g | 4.9 g |
| | EDTA-4Na | 0.5 g | 0.7 g |
| Bleaching | Gelatin | 0.35 g | 0.50 g |
| | Sodium persulfate | 33 g | 52 g |
| | Sodium chloride | 15 g | 20 g |
| | Sodium dihydrogen-phosphate | 7.0 g | 10.0 g |
| | Phosphoric acid (85%) | 2.5 ml | 2.5 ml |
| Rinsing | Kodak Stabilizer Additive | 0.14 ml | 0.17 ml |
| | Dearcide 702 | 0.7 ml | 0.7 ml |
| (Evaluation of processability) | | | |

After each sample was manufactured, it was allowed to stand in an environment (temperature: 35° C. and relative humidity: 60%) for 3 weeks. Each processed sample after the lapse of time was exposed using a sensitometer (FWH Model, manufactured by Fuji Photo Film Co., Ltd., color temperature of a light source: 3200 K) through yellow- and magenta-color correction filters and an optical wedge, which varied in optical density in steps of 0.2 per 5 mm, so as to obtain a neutral gray sensitometry image when it was processed in a process solution prior to a running test. Then, each sample was developed in each of the process solutions before and after the running test. As for each sample obtained after the development processing, the value of density relative to the logarithmic value of exposure amount was plotted to make the so-called sensitometry curve. The logarithmic value of exposure amount giving a magenta density of 1.0 on the sensitometry curve was defined as a sensitivity, and a difference in the sensitivity between the samples obtained before and after the running processing was determined as a value of the evaluation of processability. The smaller the value is, the higher the process stability of the light-sensitive material is rated.

(Evaluation of Hue and Developed Color Density)

Each sample was exposed using a sensitometer (FWH Model, manufactured by Fuji Photo Film Co., Ltd., color temperature of a light source: 3200 K) through a green filter and an optical wedge which varied in optical density in steps of 0.1 per 5 mm, and the exposed sample was then subjected to development using the process solution obtained after the aforementioned running test, to obtain a magenta color developed sample. The above sample was subjected to an X-rite 310 densitometer to measure developed color density. A B-density of a part giving a G density of 1.0 was defined as an evaluation value of the hue. The smaller the values is, the smaller the sub-absorption of a magenta color image is as well as the higher the color vividness to be given is rated.

The evaluation of the developed color density was made by measuring the density of a portion, where a maximum developed color density was obtained in the sample, by using an X-rite 310 densitometer in the same manner as in the evaluation of the hue. The evaluation value is expressed by a relative value when the density of the sample 101 was set to 1.00. The higher the value is, the more excellent the color-forming property is rated.

The content of each sample and the results of the above tests are shown in Table 4.

TABLE 4

Contents of samples and results of evaluations (continued)

| Sample No. | Ratio of high-boiling organic solvent to coupler (wt/wt) | Color density | Difference of sensitivity | Evaluated value of hue |
|---|---|---|---|---|
| 101 | 0.96 | 1.00 | 0.01 | 0.29 |
| 102 | 0.96 | 1.00 | 0.01 | 0.29 |
| 103 | 0.96 | 0.98 | 0.02 | 0.29 |
| 104 | 0.96 | 0.97 | 0.02 | 0.29 |
| 105 | 1.00 | 1.22 | 0.04 | 0.22 |
| 106 | 1.00 | 1.20 | 0.07 | 0.22 |
| 107 | 1.00 | 1.17 | 0.09 | 0.22 |
| 108 | 1.00 | 1.18 | 0.10 | 0.22 |
| 109 | 0.96 | 1.05 | 0.02 | 0.26 |
| 110 | 1.00 | 1.24 | 0.13 | 0.32 |
| 111 | 1.00 | 1.23 | 0.12 | 0.31 |
| 112 | 1.00 | 1.32 | 0.01 | 0.19 |
| 113 | 1.30 | 1.32 | 0.02 | 0.19 |
| 114 | 1.60 | 1.33 | 0.04 | 0.20 |
| 115 | 1.00 | 1.30 | 0.02 | 0.20 |
| 116 | 1.00 | 1.31 | 0.02 | 0.20 |
| 117 | 1.00 | 1.28 | 0.03 | 0.22 |
| 118 | 1.00 | 1.34 | 0.01 | 0.20 |
| 119 | 1.00 | 1.33 | 0.00 | 0.20 |
| 120 | 1.00 | 1.33 | 0.02 | 0.19 |
| 121 | 0.96 | 1.08 | 0.01 | 0.23 |
| 122 | 1.00 | 1.31 | 0.02 | 0.20 |
| 123 | 1.00 | 1.32 | 0.04 | 0.19 |
| 124 | 0.96 | 1.06 | 0.01 | 0.24 |
| 125 | 0.98 | 1.18 | 0.00 | 0.22 |
| 126 | 0.94 | 1.21 | 0.00 | 0.23 |
| 127 | 0.92 | 1.36 | 0.02 | 0.20 |
| 128 | 0.95 | 1.15 | 0.02 | 0.25 |

As the result of evaluation, it is apparent that the silver halide color photographic light-sensitive material using the magenta coupler according to the present invention was reduced in the sub-absorption of a magenta color image, giving a highly vivid color, and it made it possible to obtain high color density.

On the other hand, in the case of incorporating the dye solid dispersion of each of the comparative examples as found in the samples 110 and 111, and in the case of incorporating an emulsion other than the high silver chloride emulsion according to the present invention as found in the samples 118 and 119, the processing stability was impaired. Also as found in the samples 105 to 108, it is apparent that the layer structure had an important effect on the processing stability and the developed color density.

From the above results, a sample superior in processing stability could be obtained only in the case of using the silver halide color photographic light-sensitive material of the present invention.

It is to be noted that heat treatment of the dye solid dispersion brought about a better result as found in the samples such as the samples 112 and 115 using the dispersion 1-D or 1-E. Also, as found in the samples 112 to 114, the smaller the ratio of the high-boiling-point organic solvent to the coupler according to the present invention was, the better the obtained result was. Moreover, as found in the samples 122 and 123, the content of the dye in a layer containing the solid fine-particle dispersion of the dye had a slight effect on the processing stability.

Example 1-2

The same processing as in Example 1-1, except that the process conditions and the formulation of the process solution in the developing step were altered to those shown below, was prepared. The samples 101 to 128 manufactured in Example 1-1 were evaluated using this process solution in the same manner as in Example 1-1. The results are described in Table 5.

<Step>

| Name of steps | Process Temp. (° C.) | Process time (sec) | Replenished amount (ml per 35 mm × 30.48 m) |
|---|---|---|---|
| 3. Developing | 39.5 ± 0.1 | 90 | 690 |

<Formulation of process solutions>

| | | | |
|---|---|---|---|
| Developing | EDTA-2Na | 4.2 g | 5.9 g |
| | Sodium sulfite | 3.9 g | 4.05 g |
| | Disodium 4,5-dihydroxybenzene-1,3-disulfonate | 0.2 g | 0.41 g |
| | CD-2 | 3.20 g | 6.51 g |
| | Sodium carbonate | 18.1 g | 19.0 g |
| | Sodium bromide | 0.20 g | 0.18 g |
| | Sodium hydroxide | — | 0.6 g |
| | Sulfuric acid (7N) | 0.39 ml | — |

TABLE 5

Results of evaluations in Example 1-2

| Sample No. | Color density | Difference of sensitivity | Hue |
|---|---|---|---|
| 101 | 1.00 | 0.09 | 0.29 |
| 102 | 0.99 | 0.07 | 0.29 |
| 103 | 0.97 | 0.02 | 0.29 |
| 104 | 0.97 | 0.01 | 0.29 |
| 105 | 1.20 | 0.04 | 0.22 |
| 106 | 1.21 | 0.09 | 0.21 |

TABLE 5-continued

Results of evaluations in Example 1-2

| Sample No. | Color density | Difference of sensitivity | Hue |
|---|---|---|---|
| 107 | 1.13 | 0.16 | 0.21 |
| 108 | 1.14 | 0.17 | 0.22 |
| 109 | 1.03 | 0.15 | 0.25 |
| 110 | 1.35 | 0.21 | 0.40 |
| 111 | 1.37 | 0.22 | 0.42 |
| 112 | 1.30 | 0.02 | 0.19 |
| 113 | 1.20 | 0.04 | 0.21 |
| 114 | 1.18 | 0.06 | 0.22 |
| 115 | 1.30 | 0.02 | 0.20 |
| 116 | 1.29 | 0.02 | 0.20 |
| 117 | 1.29 | 0.03 | 0.22 |
| 118 | 1.32 | 0.10 | 0.21 |
| 119 | 1.32 | 0.08 | 0.20 |
| 120 | 1.33 | 0.01 | 0.20 |
| 121 | 1.08 | 0.01 | 0.23 |
| 122 | 1.32 | 0.04 | 0.20 |
| 123 | 1.31 | 0.04 | 0.20 |
| 124 | 1.07 | 0.00 | 0.24 |
| 125 | 1.18 | 0.02 | 0.22 |
| 126 | 1.22 | 0.01 | 0.23 |
| 127 | 1.35 | 0.01 | 0.19 |
| 128 | 1.13 | 0.02 | 0.25 |

As the result of evaluation, with respect to processing stability, the test made on the supposition of rapid processing brought about more remarkable results than the Example 1-1 performed on the supposition of standard processing. It is therefore understood that the effect of the present invention was exhibited more conspicuously in processings performed on the supposition of rapid processing. Especially in this processing system, a significant difference in the process stability was caused by a difference in halogen compositions of the silver halide emulsions (samples 101 to 104, 118 to 120, and 122) and it is therefore apparent that the high silver chloride emulsion according to the present invention contributes to the processing stability.

Also, here, the hue of each of the samples 110 and 111 was extremely inferior resultantly. This is because the dye introduced in the first layer of each of these samples was not removed completely. Namely, the fine-particle, solid dispersion of dye according to present invention is easily decolored and has excellent properties even in processing performed on the assumption of rapid processing.

Example 1-3

The same development processing as in Example 1-1, except that the process conditions and the formulation of the process solution in the developing step were altered to those shown below, was prepared. The samples 101 to 128 manufactured in Example 1-1 were evaluated using this process solution in the same manner as in Example 1-1. As a result, the similar effects were obtained.

<Step>

| Name of steps | Process Temp. (° C.) | Process time (sec) | Replenished amount (ml per 35 mm × 30.48 m) |
|---|---|---|---|
| 3. Developing | 40.0 ± 0.1 | 180 | 690 |

<Formulation of process solutions>

| | | | |
|---|---|---|---|
| Developing | Kodak | | |
| | Anti-calcium No.4 | 1.0 ml | 1.4 ml |
| | Sodium sulfite | 0.20 g | 0.20 g |
| | CD-3 | 4.00 g | 8.00 g |
| | Potassium carbonate | 22.3 g | 23.5 g |
| | Sodium bromide | 0.86 g | 0.80 g |
| | Potassium hydroxide | — 0.8 | g |
| | Sulfuric acid (7N) | 0.50 ml | — |

Example 2-1

(Preparation of Blue-sensitive Silver Halide Emulsion Particles Y01

1.0 g of sodium chloride was added to an aqueous 2% solution of a gelatin treated with lime, and the pH of the mixture was adjusted to 4.5 by addition of an acid. To this aqueous solution were added an aqueous solution containing 0.03 mols of silver nitrate and an aqueous solution containing sodium chloride and potassium bromide in an amount of 0.03 mols in total, at 40° C. with vigorous stirring. In succession, an aqueous solution (X-1) containing 0.005 mols of potassium bromide was added and then an aqueous solution containing 0.13 mols of silver nitrate and an aqueous solution containing 0.13 mols of sodium chloride were added. After the temperature was raised to 75° C., keeping the pAg at 7.0, an aqueous solution containing 0.9 mols of silver nitrate and an aqueous solution containing 0.9 mols of sodium chloride were added and further an iridium compound ($K_2IrCl_6$) was added such that the amount thereof would be $2\times10^{-7}$ mol/silver mol, to the total amount of silver, and these components were mixed. After five minutes, an aqueous solution containing 0.1 mols of silver nitrate and an aqueous solution containing 0.1 mols of sodium chloride were added to the mixture. After the resulting mixture was allowed to stand for 40 minutes, it was subjected to sedimentation water-washing performed at 35° C. and to desalting. Then 100 g of a gelatin treated with lime was added to the desalted mixture, which was then adjusted to pH 6.0 and pAg 7.0. Resultantly, tabular particles having the following characteristics were thus produced: principal plane: a {100} plane, projected-area-equivalent diameter (diameter of a circle whose area is equivalent to the projected area of an individual particle): 0.80 μm, average thickness: 0.15 μm, average aspect ratio: 4.5, side length of a cubic equivalent in volume of an individual particle: 0.39 μm, coefficient of variation: 0.20, and content of silver chloride: 96.5 mol %, respectively. Sensitizing dyes (A), (B) and (C) shown below were added to this emulsion particle in amounts of $3.5\times10^{-4}$ mols, $2.5\times10^{-5}$ mols and $1.8\times10^{-5}$ mols, respectively. Thereafter, a sulfur sensitization agent and a gold sensitization agent were added to carry out chemical ripening optimally.

Sensitizing dye (A)

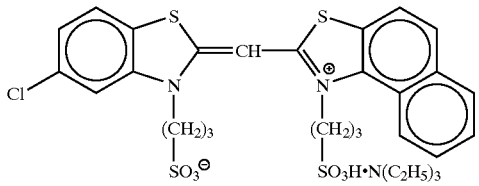

-continued

Sensitizing dye (B)

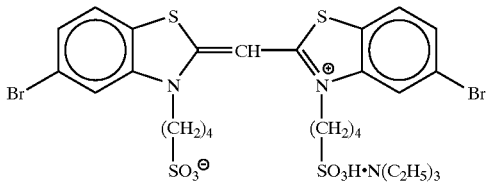

Sensitizing dye (C)

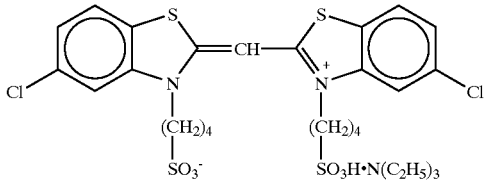

Preparation of Blue-sensitive Silver Halide Emulsion Particles Y11

The amount of potassium bromide in (X-1) was altered to 0.010 mols in the preparation of the above Y01, to prepare tabular particles having the following characteristics: projected area equivalent diameter: 0.60 μm, average thickness: 0.13 μm, average aspect ratio: 3.8, coefficient of variation: 0.19, and content of silver chloride: 96.5 mol %. The sensitizing dyes (A), (B) and (C) were added to this particle in amounts of $4.7\times10^{-4}$ mols, $4.6\times10^{-5}$ mols and $2.7\times10^{-4}$ mols, respectively, and chemical ripening was optimally carried out in the same manner as in the case of Y01. Other conditions except for these different points were the same as in the case of Y01.

Preparation of Blue-sensitive Silver Halide Particles Y21

The amount of potassium bromide in (X-1) was altered to 0.014 mols in the preparation of the above Y01, to prepare tabular particles having the following characteristics: projected area equivalent diameter: 0.40 μm, average thickness: 0.12 μm, average aspect ratio: 3.3, coefficient of variation: 0.18, and content of silver chloride: 96.5 mol %. The sensitizing dyes (A), (B) and (C) were added to this particle in amounts of $5.3\times10^{-4}$ mols, $6.3\times10^{-5}$ mols and $3.8\times10^{-4}$ mols, respectively, and chemical ripening was optimally carried out in the same manner as in the case of Y01. Other conditions except for these different points were the same as in the case of Y01.

Preparation of Blue-sensitive Silver Halide Emulsion Particles Y02 for Comparison In the preparation of the above tabular emulsion Y01, when sodium chloride which was added after the temperature was raised to 75° C., the mixed ratio of potassium bromide was increased with the lapse of time for addition, thereby producing tabular particles having a 60 mol % of silver chloride content. The shape and coefficient of variation of the particle were the same as those of Y01. Sensitization agents were added in the same manner as in the preparation of Y01. Chemical ripening was carried out so as to provide the same sensitivity as that of Y01. Other conditions except for these different points were the same as in the case of Y01.

Preparation of Blue-sensitive Silver Halide Particles Y12 and Y22 for Comparison In the preparation of the above Y02, the amount of potassium bromide in (X-1) was altered in the same manner as in the preparations of Y11 and Y21, to prepare blue-sensitive silver halide tabular particles Y12 and Y22 for comparison each having silver chloride in a content of 60 mol %. The shape and coefficient of variation of the particle of each of Y12 and Y22 were the same as those of each of Y11 and Y21 respectively.

A silver halide emulsion 2-Y1 was obtained by mixing Y01, Y11 and Y21 in a ratio of 1:3:6 in terms of silver mol ratio. Also, a silver halide emulsion 2-Y2 was obtained by mixing Y02, Y12 and Y22 in a ratio of 1:3:6 in terms of silver mol ratio in the same manner as in the preparation of 2-Y1.

| Emulsion | Halogen composition Br/Cl |
|---|---|
| 2-Y1 | 3.5/96.5 |
| 2-Y2 | 40/60 |

Preparation of Red-sensitive Silver Halide Emulsion Particles

Emulsion particles which composed a silver chlorobromide emulsion 2-R1 {cubic, a mixture of a large-sized emulsion particle R01 having an average particle size of 0.23 μm, an intermediate-sized emulsion particle R11 having an average particle size of 0.174 μm and a small-sized emulsion particle R21 having an average particle size of 0.121 μm mixed in a ratio of 2:3:5 (silver mol ratio), coefficient of variation in the distribution of particle size of each of these particles were 0.11, 0.12 and 0.13 respectively, and halogen composition of each of these particles Br/Cl= 40/60}, was prepared, by adding a mixture of silver nitrate, sodium chloride and potassium bromide, according to a control double jet method which was known in the art. $K_2IrCl_6$ was used such that the content of iridium was adjusted to $2\times10^{-7}$ mol/silver mol. The following sensitizing dyes were added to each emulsion particle in the following amount per one mol of silver: a red-sensitive sensitizing dye (D) shown below was added to the large-sized emulsion particle R01, the intermediate-sized emulsion particle R11 and the small-sized emulsion particle R21 in amounts of $2.1\times10^{-5}$ mol, $3.3\times10^{-5}$ mol and $4.5\times10^{-5}$ mol respectively, a sensitizing dye (E) was added in amounts of $1.8\times10^{-5}$ mol, $2.3\times10^{-5}$ mol and $3.6\times10^{-5}$ mol respectively, and further a sensitizing dye (F) was added in amounts of $0.8\times10^{-5}$ mol, $1.4\times10^{-5}$ mol and $2.1\times10^{-5}$ mol respectively. Chemical ripening of each emulsion was carried out optimally by adding a sulfur sensitizer and a gold sensitizer. Further, the following compound 1 was added to these silver halide emulsion particles R01, R11 and R21 in amounts of $9.0\times10^{-4}$ mol, $1.0\times10^{-3}$ mol and $1.4\times10^{-3}$ mol respectively, per mol of silver.

Also, as shown below, the halogen composition was changed and besides, the conditions were changed so as to obtain the same particle size and dispersibility appropriately, and a large emulsion particle, intermediate emulsion particle and small emulsion particle differing in size from each other were mixed, to prepare silver halide emulsions 2-R2 (a mixture of R02/R12/R22) and 2-R3 (a mixture of R03/R13/R23). The large-sized emulsion particle, intermediate-sized emulsion particle and small-sized emulsion particle respectively having the same particle size and coefficient of variation as in the case of 2-R1 were obtained. Chemical ripening was carried out so as to obtain the same result as in the case of the above red-sensitive emulsion.

| Emulsion | Halogen composition Br/Cl |
|---|---|
| 2-R1 | 40/60 |
| 2-R2 | 3.5/96.5 |
| 2-R3 | 0.5/99.5 |

Sensitizing dye (D)

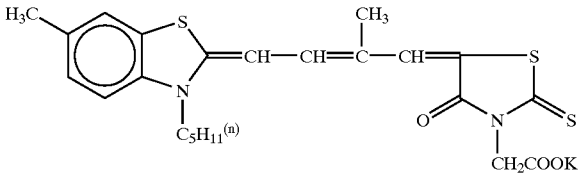

Sensitizing dye (E)

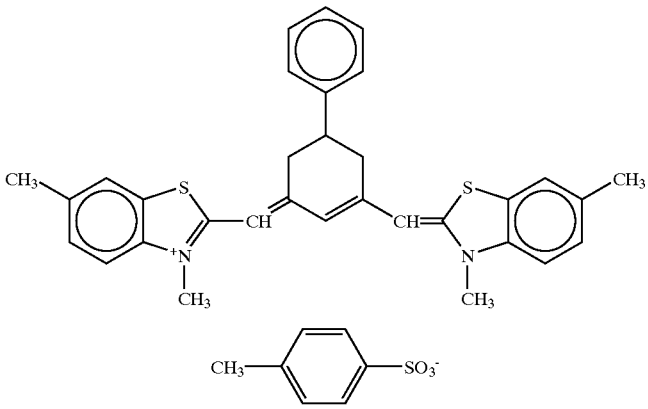

Sensitizing dye (F)

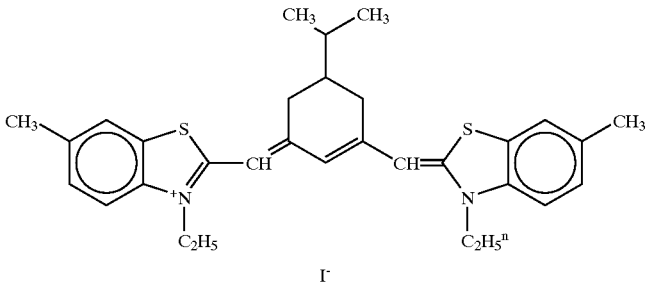

(Compound 1)

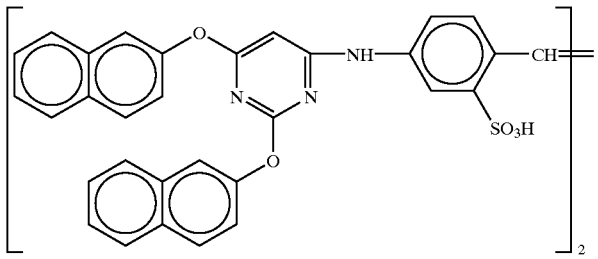

Preparations of Green-sensitive Silver Halide Emulsion Particles

Emulsion particles which composed a silver chlorobromide emulsion 2-G1 {cubic, a mixture of a large-sized emulsion particle G01 having an average particle size of 0.20 μm, an intermediate-sized emulsion particle G11 having an average particle size of 0.146 μm and a small-sized emulsion particle G21 having an average particle size of 0.102 μm mixed in a ratio of 1:3:6 (silver mol ratio), coefficients of variation in the distribution of particle size of each of these particles were 0.11, 0.12 and 0.10 respectively, and halogen composition of each of these particles Br/Cl=

40/60}, was prepared. $K_2IrCl_6$ was used such that the content of iridium was adjusted to $2\times10^{-7}$ mol/silver mol. The following sensitizing dyes were added to each emulsion particle in the following amount per one mol of silver: a green-sensitive sensitizing dye (G) was added to the large-sized emulsion particle, the intermediate-sized emulsion particle and the small-sized emulsion particle in amounts of $2.1\times10^{-4}$ mol, $3.0\times10^{-4}$ mol and $3.5\times10^{-4}$ mol respectively, a sensitizing dye (H) was added in amounts of $0.8\times10^{-4}$ mol, $1.3\times10^{-4}$ mol and $1.7\times10^{-4}$ mol respectively, a sensitizing dye (I) was added in amounts of $1.2\times10^{-4}$ mol, $1.4\times10^{-4}$ mol and $1.9\times10^{-4}$ mol respectively, and a sensitizing dye (J) was added in amounts of $0.3\times10^{-4}$ mol, $0.6\times10^{-4}$ mol and $0.9\times10^{-4}$ mol respectively. Chemical ripening of each emulsion was carried out optimally by adding a sulfur sensitizer and a gold sensitizer.

Also, as shown below, silver halide emulsions 2-G2 (a mixture of G02/G12/G22) and 2-G3 (a mixture of G03/G13/G23) were prepared in the same manner as in the preparation of the above emulsion, except that only the halogen composition was changed. The large-sized emulsion particle, intermediate-sized emulsion particle and small-sized emulsion particle respectively having the same particle size and coefficient of variation as in the case of 2-G1 were obtained. Chemical ripening was carried out so as to obtain the same result as in the case of the above green-sensitive emulsion particles.

| Emulsion | Halogen composition Br/Cl |
|---|---|
| 2-G1 | 40/60 |
| 2-G2 | 3.5/96.5 |
| 2-G3 | 0.5/99.5 |

Sensitizing dye (G)

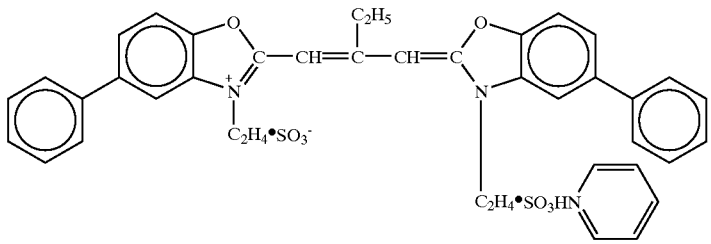

Sensitizing dye (H)

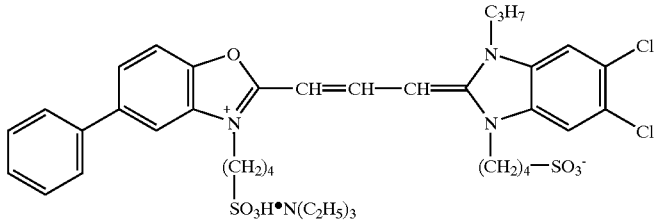

Sensitizing dye (I)

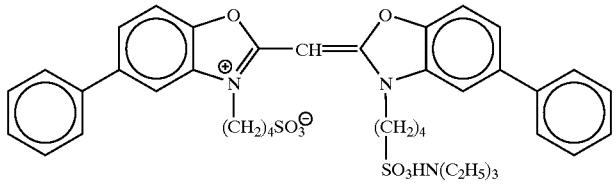

Sensitizing dye (J)

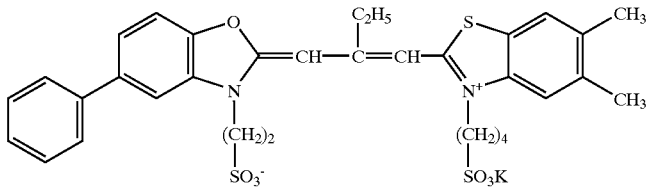

Preparation of Emulsified Dispersion 2-Y for a Yellow Light-sensitive Layer

Materials having the following components were dissolved and mixed together, and the resultant mixture was then emulsified and dispersed in 1000 g of an aqueous 10% gelatin solution containing 80 ml of 10% sodium dodecylbenzenesulfonate, to prepare an emulsion dispersion 2-Y.

| | |
|---|---|
| Yellow coupler (ExY) | 116.0 g |
| Additive 1 | 8.8 g |
| Additive 2 | 9.0 g |
| Additive 3 | 4.8 g |
| Additive 4 | 10.0 g |
| Solvent 1 | 79.0 g |
| Solvent 2 | 44.0 g |
| Solvent 3 | 9.0 g |
| Solvent 4 | 4.0 g |
| Ethyl acetate | 150.0 ml |

ExY A mixture in 80:10:10 (molar ratio) of (1), (2), and (3)

(1)

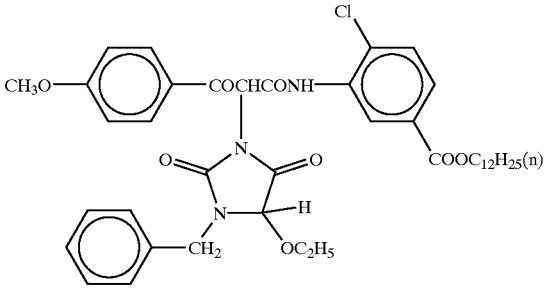

(2)

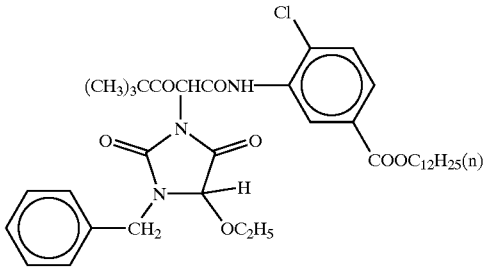

(3)

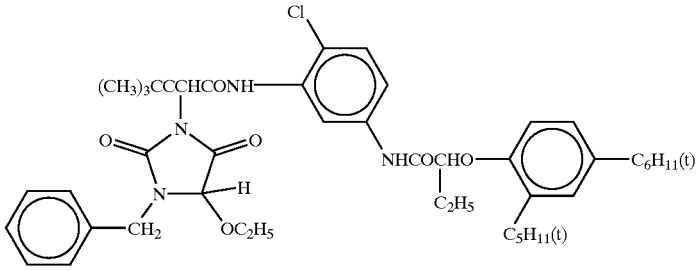

Additive 1

A mixture in 2:1:7 (weight ratio) of (1), (2), and (3)

(1)

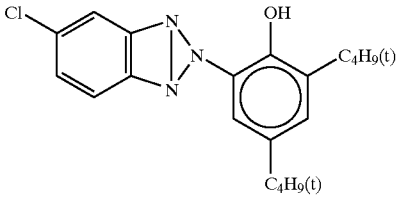

-continued
(2)
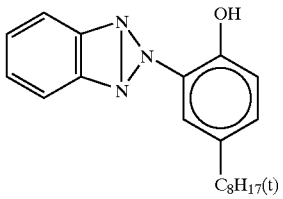
(3)
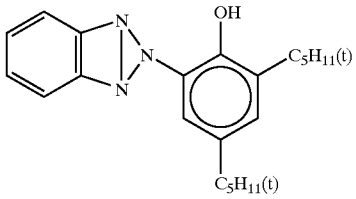
(Additive 2)
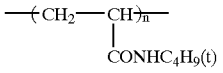
average molecular weight about 60,000
(Additive 3)
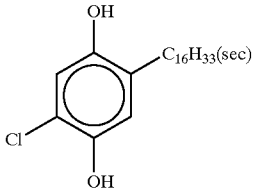
(Additive 4)
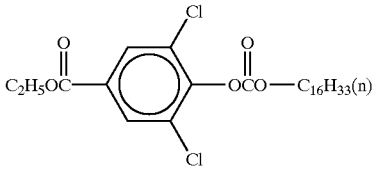
(Solvent 1)
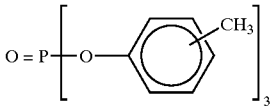
(Solvent 2)
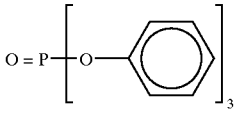
(Solvent 3)
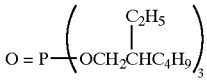

-continued (Solvent 4)

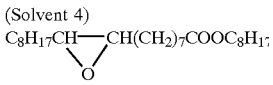

Preparation of an Emulsion Dispersion 2-M for a Magenta Light-sensitive Layer, and an Emulsion Dispersion 2-C for a Cyan Light-sensitive Layer Emulsion dispersions 2-M and 2-C for a magenta and a cyan light-sensitive layer respectively were prepared in the same manner as in the preparation of the emulsion dispersion 2-Y, by using the magenta coupler (ExM) and the cyan coupler (ExC), except that the aforementioned yellow coupler (ExY) was changed to the magenta coupler (ExM) and the cyan coupler (ExC) in the same mass amounts respectively.

(ExM)

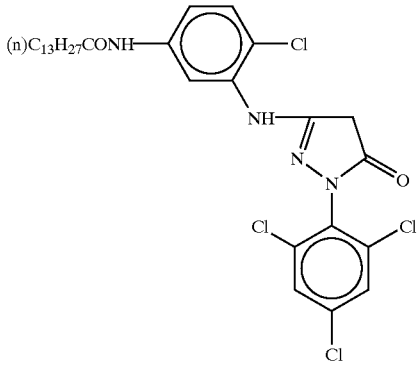

(ExC) Compounds in 40:40:20 (molar ratio) of (1), (2), and (3)

(1)

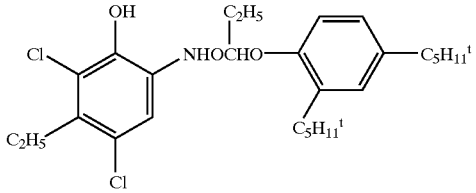

-continued (2)

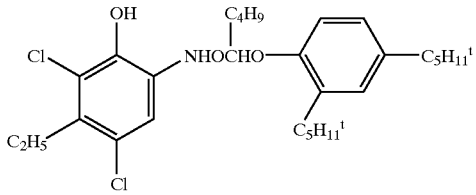

(3)

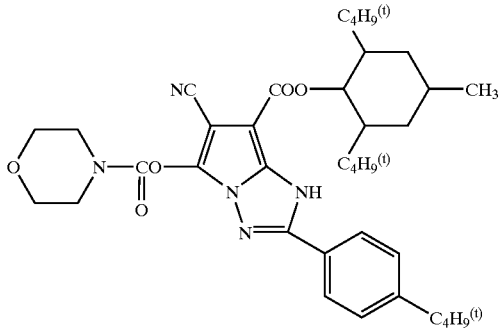

Preparation of a Dispersion of Fine Particles of Solid Dye

A methanol wet cake of Dye 1 shown below was weighed such that the net amount of the compound was 240 g, and 48 g of the compound 2 shown below, as a dispersing aid, was weighed. To the mixture of both compounds was added water such that the total amount was 4000 g. The resultant mixture was crushed at a discharge rate of 0.5 l/min and a peripheral velocity of 10 m/s for 2 hours, by using "a flow system sand grinder mill (UVM-2)" (trade name, manufactured by AIMEX K.K.) filled with 1.7 l of zirconia beads (diameter: 0.5 mm). Then, the dispersion was diluted such that the concentration of the compound was 3 mass %. After that, heat treatment was performed at 90° C. for 10 hours. Thus the preparation of a dispersion 2-A was finished in this manner. The average particle size of this dispersion was 0.45 μm.

Dye 1

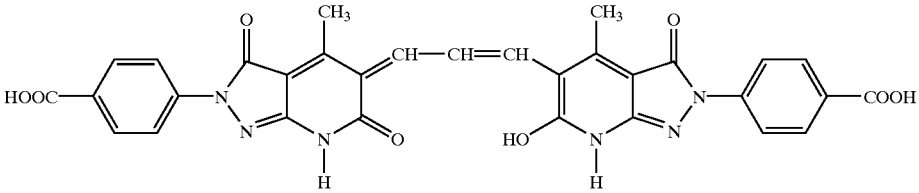

Compound 2

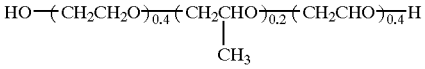

average molecular weight 11400

Preparation of a Coating Solution for a Yellow Light-sensitive Emulsion Layer

The following emulsion and materials were dissolved and mixed in the following proportions, to produce a coating solution for a yellow light-sensitive emulsion layer. The numerals mean to express in the unit of g/m$^2$. The amount of the emulsion to be applied is in terms of that of silver.

| | |
|---|---|
| Silver halide emulsion (2-Y1) | 0.49 |
| Yellow coupler (ExY) | 1.18 |
| Additive 1 | 0.09 |
| Additive 2 | 0.09 |
| Additive 3 | 0.05 |
| Additive 4 | 0.10 |
| Solvent 1 | 0.80 |
| Solvent 2 | 0.45 |
| Solvent 3 | 0.09 |
| Solvent 4 | 0.04 |
| Gelatin | 2.10 |
| Compound 3 | 0.0005 |
| Compound 4 | 0.03 |
| Compound 5 | 0.04 |

(Compound 3)

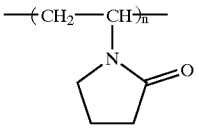

(Compound 4)

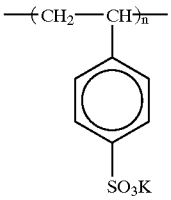

(Compound 5)

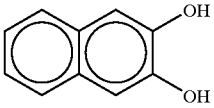

Preparation of a Coating Solution for a Magenta Light-sensitive Emulsion Layer

The emulsion and materials having the following compositions were dissolved and mixed in the same manner as in the preparation of the coating solution for a yellow light-sensitive emulsion layer, to prepare a coating solution for a magenta light-sensitive emulsion layer.

| | |
|---|---|
| Silver halide emulsion (2-G2) | 0.55 |
| Magenta coupler (ExM) | 0.68 |
| Additive 1 | 0.05 |
| Additive 2 | 0.05 |
| Additive 3 | 0.03 |
| Additive 4 | 0.06 |
| &olvent 1 | 0.46 |
| Solvent 2 | 0.26 |
| Solvent 3 | 0.05 |
| Solvent 4 | 0.02 |
| Gelatin | 1.28 |

Preparation of a Coating Solution for a Cyan Light-sensitive Emulsion Layer

The emulsion and materials having the following compositions were dissolved and mixed in the same manner as in the preparation of the coating solution for a yellow light-sensitive emulsion layer, to prepare a coating solution for a cyan light-sensitive emulsion layer.

| | |
|---|---|
| Silver halide emulsion (2-R2) | 0.46 |
| Cyan coupler (ExC) | 0.72 |
| Additive 1 | 0.055 |
| Additive 2 | 0.056 |
| Additive 3 | 0.03 |
| Additive 4 | 0.06 |
| Solvent 1 | 0.49 |
| Solvent 2 | 0.27 |
| Solvent 3 | 0.056 |
| Solvent 4 | 0.025 |
| Gelatin | 2.45 |

Production of a Halation Preventive Layer

The solid, fine-particle dispersion of dye 2-A prepared in the above manner and a gelatin were mixed and dissolved in such amounts that the dispersion 2-A and the gelatin were applied in amounts of 0.11 g/m$^2$ and 0.70 g/m$^2$, respectively, to produce a coating solution for a halation preventive layer.

Production of an Intermediate Layer

The following gelatin and chemicals were dissolved and mixed, to produce a coating solution for an intermediate layer.

| | |
|---|---|
| Gelatin | 0.67 |
| Compound 6 | 0.04 |
| Compound 7 | 0.02 |
| Solvent 5 | 0.01 |

(Compound 6)

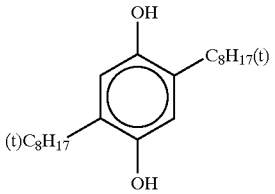

(Compound 7)

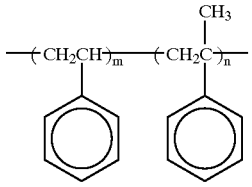

number-average
molecular weight 600
m/n = 10/90

(Solvent 5)

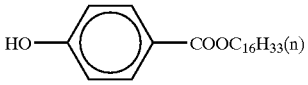

Production of a Protective Layer

The following gelatin and chemicals were dissolved and mixed to produce a costing solution for a protective layer.

| | |
|---|---|
| Gelatin | 0.96 |
| Acryl modified copolymer of polyvinyl alcohol (Degree of modification: 17%) | 0.02 |
| Compound 8 | 0.04 |
| Compound 9 | 0.013 |

(Compound 8)
A mixture in 7:1 (weight ratio) of

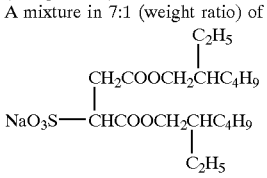

and

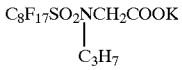

(Compound 9)

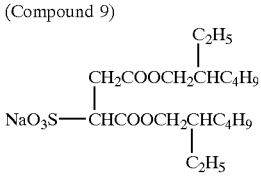

As the hardener for each layer, sodium 1-oxy-3,5-dichloro-s-triazine was used. Also, the following dyes 2 to 5 were added to each of the emulsion layers for the purpose of preventing irradiation.

(Dye 2)

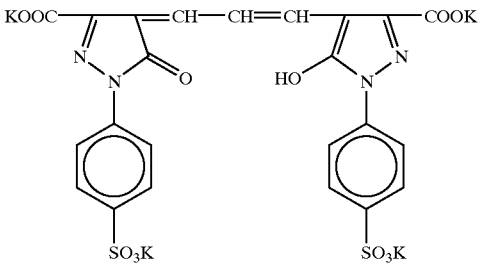

(0.060 g/m$^2$)

(Dye 3)

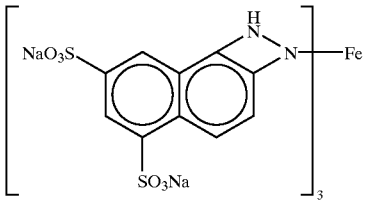

(0.094 g/m$^2$)

(Dye 4)

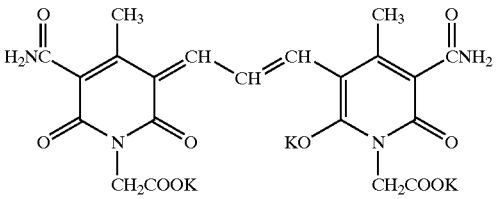

(0.018 g/m$^2$)

-continued (Dye 5)

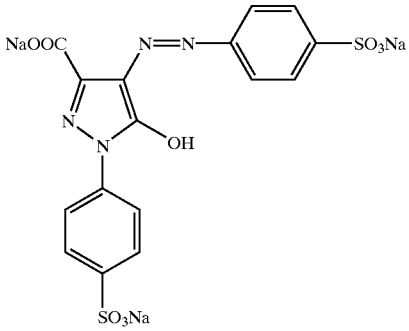

(0.015 g/m$^2$)

Production of a Support

An acrylic resin layer containing the following conductive polymer (0.05 g/m$^2$) and tin oxide fine particle (0.20 g/m$^2$) was applied to one surface of biaxially oriented (stretched) polyethylene terephthalate support with a thickness of 120 $\mu$m.

Conductive polymer

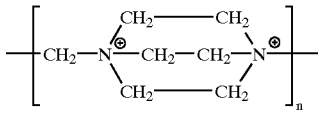

Preparation of a Coated Sample 9

The coating solutions prepared as aforementioned were applied, with a co-extrusion manner, onto the polyethylene terephthalate support on the side opposite to the surface to which the acrylic layer resin was applied, so as to provide the following coated structure, with a halation preventive structure disposed as the lowest layer, and then the resultant coated support was dried, to produce a coated sample 9.

Protective layer
Magenta light-sensitive layer
Intermediate layer
Cyan light-sensitive layer
Intermediate layer
Yellow light-sensitive layer
Halation preventive layer
Polyethylene terephthalate support Preparation of Other Coated Samples The type of silver halide emulsion was altered to those shown in Table 6, as well as the amount of applied silver was altered by means of the amount of applied silver halide, the film thickness was altered by means of the amount of the gelatin, and the swelling ratio was altered by means of the amount of hardener, sodium 1-oxy-3,5-dichloro-s-triazine, to properly adjust to the values shown in Table 6 to produce other samples. In this case, the amount of silver halide to be applied was altered in a manner that the mass ratio among the silver halide emulsions to be used in the yellow light-sensitive emulsion layer, the magenta light-sensitive emulsion layer and the cyan light-sensitive emulsion layer was kept unchanged from that of the coated sample 9.

Evaluation of Film Thickness and Swelling Rate

The cross-section of each coated sample produced in the above manner was observed using a scanning type electron microscope (SEM), to measure the film thickness. Also, the swelled film thickness when each sample was sufficiently swelled in pure water at 27° C. was measured by a chopper bar method. The swelling rate was calculated from the equation described in this specification. The amount of applied silver, film thickness and swelling rate of each coated sample are shown in Table 6.

TABLE 6

| Coated sample | Silver chloride content (mol %/Ag-mol) Y layer | M layer | C layer | All layers | Amount of coated silver ($g/m^2$) | Film thickness ($\mu m$) | Swelling rate (%) |
|---|---|---|---|---|---|---|---|
| 1 | 60(2-Y2) | 60(2-G1) | 60(2-R1) | 60 | 2.10 | 14 | 250 |
| 2 | " | " | " | " | 1.85 | " | " |
| 3 | " | " | " | " | 1.50 | " | " |
| 4 | " | " | " | " | " | " | 180 |
| 5 | " | " | " | " | " | 10.5 | " |
| 6 | 96.5(2-Y1) | 96.5(2-G2) | 96.5(2-R2) | 96.5 | 1.85 | " | " |
| 7 | " | " | " | " | 1.50 | 14 | 250 |
| 8 | " | " | " | " | " | " | 180 |
| 9 | " | " | " | " | " | 10.5 | " |
| 10 | " | 99.5(2-G3) | 99.5(2-R3) | 98.5 | " | " | " |
| 11 | " | " | " | " | " | " | 150 |
| 12 | " | " | " | " | 1.35 | " | " |

Y layer: Yellow-light-sensitive emulsion layer, G layer: magenta-light-sensitive emulsion layer, R layer: cyan-light-sensitive emulsion layer
The parenthesis after the values of silver chloride content for each layer represents the name of the silver halide emulsion used.

Preparation of a Processing Solution

A simple processing process, according to the ECP-2 process published from Eastman Kodak as a standard method of processing a color positive film for movies, was utilized with the modification that the sound developing step and a fixing step prior to a bleach accelerating step were excluded from the ECP-2 process. All samples produced as above were respectively exposed to such an image that about 30% of the amount of silver to be applied was developed. Each sample which had been exposed was subjected to continuous processing (running test) performed according to the above processing process until the amount of the replenisher to a color-developing bath reached twice the tank volume, thereby preparing the development processing condition in a running equilibrium. ECP-2 process <Step>

| Name of steps | Process Temp. (° C.) | Process time (sec) | Replenished amount (ml per 35 mm × 30.48 m) |
|---|---|---|---|
| 1. Pre-bath | 27 ± 1 | 10–20 | 400 |
| 2. Washing | 27 ± 1 | Jet water washing | — |
| 3. Developing | 36.7 ± 0.1 | 180 | 690 |
| 4. Stop | 27 ± 1 | 40 | 770 |
| 5. Washing | 27 ± 3 | 40 | 1200 |
| 6. Bleach accelerating | 27 ± 1 | 20 | 200 |
| 7. Bleaching | 27 ± 1 | 40 | 200 |
| 9. Washing | 27 ± 3 | 40 | 1200 |
| 10. Fixing | 27 ± 1 | 40 | 200 |
| 11. Washing | 27 ± 3 | 60 | 1200 |
| 12. Rinsing | 27 ± 3 | 10 | 400 |
| 13. Drying | | | |

Formulation of Process Solutions

Composition Per 1 l is Shown.

| Name of steps | Name of Chemicals | Tank solution | Replenishing solution |
|---|---|---|---|
| Pre-bath | VOLAX (trade name) | 20 g | 20 g |
| | Sodium sulfate | 100 g | 100 g |
| | Sodium hydroxide | 1.0 g | 1.5 g |
| Developing | Kodak Anti-calcium No.4 (trade name) | 1.0 ml | 1.4 ml |
| | Sodium sulfite | 4.35 g | 4.50 g |
| | D-3 | 2.95 g | 6.00 g |
| | Sodium carbonate | 17.1 g | 18.0 g |
| | Sodium bromide | 1.72 g | 1.60 g |
| | Sodium hydroxide | — | 0.6 g |
| | Sulfuric acid (7N) | 0.62 ml | — |
| Stop | Sulfuric acid (7N) | 50 ml | 50 ml |
| Fixing | Ammonium thiosulfate (58%) | 100 ml | 170 ml |
| | Sodium sulfite | 2.5 g | 16.0 g |
| | Sodium hydrogen sulfite | 10.3 g | 5.8 g |
| | Potassium iodide | 0.5 g | 0.7 g |
| Bleach accelerating | Sodium hydrogen-methasulfite | 3.3 g | 5.6 g |
| | Acetic acid | 5.0 ml | 7.0 ml |
| | PBA-1 | 3.3 g | 4.9 g |
| | (Kodak Persulfate Bleach Accelerator, trade name) EDTA-4Na | 0.5 g | 0.7 g |
| Bleaching | Gelatin | 0.35 g | 0.50 g |
| | Sodium persulfate | 33 g | 52 g |
| | Sodium chloride | 15 g | 20 g |
| | Sodium dihydrogen-phosphate | 7.0 g | 10.0 g |
| | Phosphoric acid (85%) | 2.5 ml | 2.5 ml |
| Rinsing | Kodak Stabilizer Additive | 0.14 ml | 0.17 ml |
| | Dearcide 702 (trade name) | 0.7 ml | 0.7 ml |

In the above, D-3 used in the developing step is a developing agent, and Dearcide 702 used in the rinsing step is a mildewproof agent.

Evaluation of Photographic Sensitivity

Each sample was exposed using a sensitometer (FW Model, manufactured by Fuji Photo Film Co., Ltd., color temperature of a light source: 3200 K), through a yellow and a magenta color correction filters and an optical wedge, so as to obtain a neutral gray sensitometry image. Then, each sample was subjected to development processing, using the process solutions prepared in the above manner, at the color-developing process time of 180 seconds (standard time). The photographic sensitivity was evaluated using the coated sample 5 as a standard, on the basis of the value obtained by multiplying, by 100, the reciprocal of the ratio of exposure amount allowing the developed color density of each of yellow, magenta and cyan to be higher than the fog density by 1.0. The higher the value is, the higher the sensitivity is.

A value of visible density measured by an X-rite 310 densitometer (manufactured by X-rite) at the maximum density portion of the coated sample when the sample was processed in the condition that the color developing process time was 120 seconds, was described as the maximum density (Dmax).

Evaluation of the Development Progress Characteristics

In the above evaluation of photographic sensitivity, photographic sensitivity when the sample was processed at the color-developing process time of 120 seconds was found. A difference between the exposure amount, giving the photographic sensitivity obtained at the color-developing process time of 180 seconds, and the exposure amount, giving the photographic sensitivity obtained at the color-developing process time of 120 seconds, was measured; and an evaluation was made based on a relative value of the difference when the difference in the coated sample 5 was defined as 100.

Evaluation of Fixing Ability

Using a fixing solution made of the process solution prepared as aforementioned, the time taken since the start of fixing until the silver halide was fixed, using the unexposed portion of the prepared coated sample, was rated based on the transmission optical density of the film, and it is expressed as a relative value obtained when the case of the coated sample 5 was defined as 100.

Evaluation of Drying Characteristics

For the coated sample after its washing was finished, the dry condition of the coated sample, when 40° C. dry air was allowed to blow against the coated sample for a fixed time (30 seconds), was rated according to the following functional evaluation.

◎: Dried sufficiently.

○: Slightly humid but no problem was occurred.

Δ: Moisture left.

X: Insufficiently dried.

Evaluation of Remaining Color

The evaluation of remaining color was made by the following functionally evaluating. That is, the coated sample, which was developed in the condition that the color-developing time was 120 seconds in the aforementioned color-developing process solution and which was processed in the washing step in which the processing time for washing was changed from 60 minutes to 40 minutes. The resultant remaining color was classified, according to the following standards.

◎: No remaining color was observed at all.

○: Remaining color was observed but no problem was occurred.

Δ: Much remaining color was observed, but within a practically allowable level.

X: So much remaining color was observed, and it was not allowable.

The results are shown in Table 7.

TABLE 7

| | | Photographic speed | | | Development progress characteristics | | | | | Residual |
|---|---|---|---|---|---|---|---|---|---|---|
| Coated sample | Maximum density | Yellow layer | Magenta layer | Cyan layer | Yellow layer | Magenta layer | Cyan layer | Fixing characteristics | Drying characteristics | color characteristics |
| 1 | 4.0 | 118 | 116 | 111 | 195 | 187 | 210 | 135 | x | x |
| 2 | 4.0 | 114 | 109 | 105 | 152 | 165 | 158 | 121 | x | x |
| 3 | 4.0 | 101 | 98 | 94 | 130 | 125 | 125 | 103 | x | Δ |
| 4 | 4.0 | 105 | 104 | 105 | 100 | 98 | 96 | 96 | Δ | Δ |
| 5 | 4.0 | 100 | 100 | 100 | 100 | 100 | 100 | 100 | ○ | ○ |
| 6 | 4.0 | 110 | 111 | 106 | 76 | 69 | 73 | 84 | ○ | Δ |
| 7 | 4.0 | 103 | 98 | 97 | 63 | 62 | 66 | 82 | x | Δ |
| 8 | 4.0 | 102 | 103 | 105 | 42 | 44 | 44 | 76 | Δ | Δ |
| 9 | 4.0 | 100 | 100 | 100 | 43 | 44 | 45 | 77 | ○ | ◎ |
| 10 | 4.0 | 100 | 100 | 100 | 32 | 33 | 32 | 72 | ○ | ◎ |
| 11 | 4.0 | 99 | 96 | 98 | 35 | 34 | 34 | 73 | ◎ | ○ |
| 12 | 3.7 | 95 | 94 | 95 | 21 | 29 | 28 | 65 | ◎ | ○ |

As shown in Table 7, it is identified that, when the silver halide composition, amount of the applied silver, film thickness and swelling rate of a light-sensitive material respectively fell in the range according to the second embodiment of the present invention, the light-sensitive material was excellent in development progress characteristics very much, and at the same time, it was excellent in fixing characteristics and drying characteristics, and it was almost free from the remaining color. It is also identified that the light-sensitive material had rapid processing suitability, and the processing time in each of the developing, fixing, washing and drying steps could be significantly reduced than that in the conventional process.

Example 2-2

Preparation of Blue-sensitive Silver Halide Tabular Particles

An emulsion was prepared in the same manner as in the preparation of the emulsion 2-Y1, except that the iridium compound ($K_2IrCl_6$) was altered in its amount to be used, as shown in Table 8, in the preparation of Y01, Y11 and Y21 in Example 2-1, so that the resultant emulsion would differ only in the content of the iridium compound. The particle size, aspect ratio and dispersibility of the thus-obtained emulsion particles were the same as those of the silver halide particles contained in the emulsion 2-Y1 of Example 2-1.

Preparation of Blue-sensitive Silver Halide Cubic Particles

Emulsion particles which composed a silver chlorobromide emulsion {cubic, a mixture of a large-sized emulsion particle Y03 having an average particle size of 0.7 μm, an intermediate-sized emulsion particle Y13 having an average particle size of 0.5 μm and a small-sized emulsion particle Y23 having an average particle size of 0.36 μm mixed in a ratio of 1:5:4 (silver mol ratio) coefficient of variation in the distribution of particle size of each of these particles were 9%, 10% and 12% respectively, and halogen compositions of each of these particles Br/Cl=1.5/98.5}, was prepared by adding a mixture of silver nitrate, sodium chloride and potassium bromide, according to a controled double jet method which was known in the art. An iridium compound was added such that the content of iridium would be the value as shown in Table 8. To these emulsion particles, were added the sensitizing dyes used in Example 2-1, to perform spectral sensitization. Chemical ripening of each of these emulsions was carried out optimally by adding a sulfur sensitizer and a gold sensitizer such that these emulsions were ripened in the same degree as in the ripening of Y01, Y11 or Y21 employed in Example 2-1.

Thus, each emulsion differing only in the content of the iridium compound was prepared, as shown in Table 8.

Preparation of Red- and Green-sensitive Silver Halide Emulsion Particles

Red light-sensitive emulsion particles and green light-sensitive emulsion particles were prepared in the same manner as in Example 2-1, except that in the preparation of the blue-sensitive silver halide emulsion, the amount of the iridium compound to be added was altered in the same manner as in the case of the blue light-sensitive emulsion used in the same coated sample.

Preparation of Coated Samples

A dye dispersion of the solid dispersed dye prepared in Example 2-1 but not heat-treated was prepared, and the solid dispersed dye was altered as shown in Table 8. Also, the emulsion particle was changed to each of emulsions of which the amount of an iridium compound was shown. Also, using tabular particles or cubic particles as the blue light-sensitive emulsion particles, coated samples were prepared as shown in Table 8.

Evaluation of Photographic Sensitivity

In the evaluation of photographic sensitivity in Example 2-1, the processing temperature was raised by 1° C. and the processing time was changed to 140 seconds in the developing step, to evaluate the sensitivity of the coated sample. The photographic sensitivity was evaluated based on the reciprocal of the ratio of exposure amount to give the developed color density to be higher than the fog density by 1.0. The evaluation was made based on a relative value of the sensitivity when the sensitivity of the coated sample 17 was defined as 100.

Evaluation of Reciprocity Characteristics

In the above evaluation of photographic sensitivity, the exposure time was set to 1 second or 1/1000 second, to carry out exposure and development processing, respectively. Exposure amount was controlled so as to be the same at each intensity. A variation in gradation between the above exposure steps differing in exposure time was evaluated according to the following standard.

○: A variation in gradation was less, and good.

Δ: A small variation in gradation was observed within an allowable extent.

X: A large unallowable variation in gradation was observed.

Evaluation of Graininess

In the exposure performed in Example 2-1, the density of the optical wedge was controlled such that the density would be 1.0, to carry out uniform exposure, and development processing was performed in the same manner as in the evaluation of photographic sensitivity. The developed sample was projected by expanding it by a factor of 300, to observe the expanded sample, and functionally evaluated according to the following standard.

○: No significant granule was observed and no problem was observed.

Δ: Some granules were observed within a practically allowable level.

X: Inferior in graininess and not-reached the allowable level.

Evaluation of Sharpness

The evaluation of sharpness was made for a magenta color image and a cyan color image, each of which has a large influence on the sense of sight. Each sample was exposed through a green filter, a red filter and a wedge for measuring sharpness, and developed in the same manner as in the evaluation of photographic sensitivity, to make evaluation by CTF measurement. The sharpness was rated based on space frequency (number/mm) giving an CTF of 0.8. The larger the value is, the higher the sharpness is.

Evaluation of the Development Progress Property

In the evaluation of photographic sensitivity, photographic sensitivity (evaluation based on the density of (fogging density+1.0) in the same manner as above) obtained in each of the 100 second-development and 140 second-development was found. A difference between the exposure amount to give the photographic sensitivity obtained in the 140 second-development and the exposure amount to give the photographic sensitivity obtained in the 100 second-development was found. An evaluation was made based on a relative value of the difference when the difference of the coated sample 17 was defined as 100.

The results are shown in Table 8.

TABLE 8

| Coated sample | Shape of yellow-color-forming layer emulsion | Ir content (mol/Ag-mol) | Solid dispersed dye | Coated amount of Ag ($g/m^2$) | Film thickness ($\mu m$) | Swelling rate (%) | Sensitivity | Reciprocal characteristics | Dmax | Development progress characteristics (Yellow layer) | Granularity | Sharpness Magenta layer | Sharpness Cyan layer |
|---|---|---|---|---|---|---|---|---|---|---|---|---|---|
| 13 | Tabular grain | — | Exist (heated) | 1.50 | 10.5 | 180 | 111 | x | 4.0 | 136 | ○ | 12 | 11 |
| 14 | Tabular grain | $1.0 \times 10^{-9}$ | Exist (heated) | 1.50 | 10.5 | 180 | 108 | Δ | 4.0 | 121 | ○ | 12 | 11 |
| 15 | Tabular grain | $5.0 \times 10^{-9}$ | Exist (heated) | 1.50 | 10.5 | 180 | 105 | Δ | 4.0 | 116 | ○ | 12 | 11 |
| 16 | Tabular grain | $4.0 \times 10^{-8}$ | Exist (heated) | 1.50 | 10.5 | 180 | 103 | ○ | 4.0 | 106 | ○ | 12 | 11 |
| 17 | Tabular grain | $2.0 \times 10^{-7}$ | Exist (heated) | 1.50 | 10.5 | 180 | 100 | ○ | 4.0 | 100 | ○ | 12 | 11 |
| 18 | Tabular grain | $1.0 \times 10^{-6}$ | Exist (heated) | 1.50 | 10.5 | 180 | 98 | ○ | 4.0 | 95 | ○ | 12 | 11 |
| 19 | Tabular grain | $9.0 \times 10^{-6}$ | Exist (heated) | 1.50 | 10.5 | 180 | 95 | Δ | 3.6 | 98 | ○ | 12 | 11 |
| 20 | Tabular grain | $2.0 \times 10^{-7}$ | — | 1.50 | 10.5 | 180 | 125 | ○ | 4.0 | 100 | ○ | 2 | 2 |
| 21 | Tabular grain | $2.0 \times 10^{-7}$ | Exist (not heated) | 1.50 | 10.5 | 180 | 110 | ○ | 4.0 | 100 | ○ | 7 | 9 |
| 22 | Cubic grain | $5.0 \times 10^{-9}$ | Exist (heated) | 1.50 | 10.5 | 180 | 103 | Δ | 4.0 | 141 | Δ | 12 | 11 |
| 23 | Cubic grain | $2.0 \times 10^{-7}$ | Exist (heated) | 1.50 | 10.5 | 180 | 98 | ○ | 4.0 | 121 | Δ | 12 | 11 |
| 24 | Cubic grain | $9.0 \times 10^{-6}$ | Exist (heated) | 1.50 | 10.5 | 180 | 93 | Δ | 3.6 | 118 | Δ | 12 | 11 |

As is apparent from Table 8, it is found that the reciprocity characteristics was good and the development progress property was very high, when the content of an iridium compound was $1.0\times10^{-8}$ mol or more and $5.0\times10^{-6}$ mol or less. It is also understood that inclusion of the solid fine-particle dispersion of dye prepared through the heat-treating step performed at 40° C. or more made the sharpness high, and also the use of the tabular particles in the yellow emulsion layer brought about good graininess, very high development progress characteristics and rapid processing suitability, and the resultant light-sensitive material made it possible to reduce processing time similarly in Example 2-1.

Having described our invention as related to the present embodiments, it is our intention that the invention not be limited by any of the details of the description, unless otherwise specified, but rather be construed broadly within its spirit and scope as set out in the accompanying claims.

What we claim is:

1. A silver halide color photographic light-sensitive material comprising at least one yellow color-forming light-sensitive silver halide emulsion layer, at least one cyan color-forming light-sensitive silver halide emulsion layer, and at least one magenta color-forming light-sensitive silver halide emulsion layer, and at least one non-light-sensitive hydrophilic colloidal layer, on a support, wherein at least one layer of said magenta color-forming silver halide emulsion layer contains at least one magenta dye-forming coupler selected from compounds represented by the following formula (M-I), a silver halide emulsion in the magenta color-forming silver halide emulsion layer containing the compound represented by formula (M-I) comprises a high silver chloride emulsion having a 98 mol % or more of silver chloride content, and, wherein at least one layer of said non-light-sensitive hydrophilic colloidal layer contains a solid fine-particle dispersion of a dye represented by the following formula (I), and the magenta color-forming silver halide emulsion layer containing the compound represented by formula (M-I) is a light-sensitive silver halide emulsion layer most apart from the non-light-sensitive hydrophilic colloidal layer containing the solid fine-particle dispersion of the dye represented by formula (I), among all the light-sensitive silver halide emulsion layers;

formula (M-I)

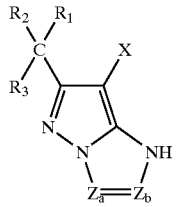

wherein, in formula (M-I), $Z_a$ and $Z_b$ each represent $=C(R_4)-$ or $=N-$, $R_1$, $R_2$, $R_3$ and $R_4$ each represent a hydrogen atom or a substituent, X represents a hydrogen atom or a group capable of being split-off upon a coupling reaction with an oxidized product of a color-developing agent;

$$D\text{-}(X)_y \qquad \text{formula (I)}$$

wherein, in formula (I), D represents a group to give a compound having a chromophore, X represents a dissociable hydrogen or a group having a dissociable hydrogen, and y is an integer from 1 to 7, wherein the hydrophilic colloidal layer containing the solid fine particle dispersion of the dye represented by the formula (I) is disposed between the support and a silver halide emulsion layer closest to the support.

2. The silver halide color photographic light-sensitive material as claimed in claim 1, wherein the dye is a dye represented by the following formula (II) or (III);

formula (II)

$$A^1{=}L^1{-}(L^2{=}L^3)_m{-}Q$$

wherein, in formula (II), $A^1$ represents an acidic nucleus, Q represents an aryl group or a heterocyclic group, $L^1$, $L^2$ and $L^3$ each represent a methine group, and m is 0, 1 or 2, provided that the compound represented by formula (II) possesses 1 to 7 groups selected from the group consisting of a carboxylic acid group, a sulfonamido group, a sulfamoyl group, sulfonylcarbonyl group, an acylsulfamoyl group and a phenolic hydroxyl group as the group having a dissociable hydrogen in its molecule, and an enol group of an oxonol dye as a dissociable hydrogen;

formula (III)

$$A^1{=}L^1{-}(L^2{=}L^3)_n{-}A^2$$

wherein, in formula (III), $A^1$ and $A^2$ each represent an acidic nucleus, $L^1$, $L^2$ and $L^3$ each represent a methine group, and n is 1 or 2, provided that the compound represented by formula (III) possesses 1 to 7 groups selected from the group consisting of a carboxylic acid group, a sulfonamido group, a sulfamoyl group, a sulfonylcarbonyl group, an acylsulfamoyl group and a phenolic hydroxyl group as the group having a dissociable hydrogen in its molecule, and an enol group of an oxonol dye as a dissociable hydrogen.

3. The silver halide color photographic light-sensitive material as claimed in claim 1, wherein the dye is a dye represented by the following formula (IV);

formula (IV)

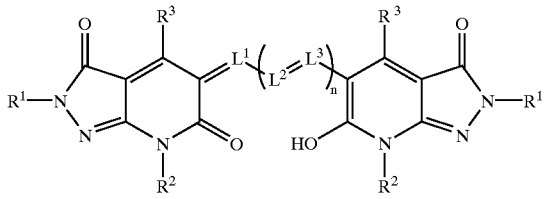

wherein, in the formula (IV), $R^1$ represents a hydrogen atom, an alkyl group, an aryl group or a heterocyclic group, $R^2$ represents a hydrogen atom, an alkyl group, an aryl group, a heterocyclic group, $—COR^4$ or $—SO_2R^4$, $R^3$ represents a hydrogen atom, a cyano group, a hydroxyl group, a carboxyl group, an alkyl group, an aryl group, $—CO_2R^4$, $—OR^4$, $—NR^5R^6$, $—CONR^5R^6$, $—NR^5COR^4$, $—NR^5SO_2R^4$ $—NR^5CONR^5R^6$ (in which $R^4$ represents an alkyl group or an aryl group and $R^5$ and $R^6$ respectively represent a hydrogen atom, an alkyl group or an aryl group), $L^1$, $L^2$ and $L^3$ respectively represent a methine group, and n denotes 1 or 2.

4. The silver halide color photographic light-sensitive material as claimed in claim 1, wherein the solid fine-particle dispersion of the dye is prepared through a heat treating step carried out at 40° C. or higher.

5. The silver halide color photographic light-sensitive material as claimed in claim 1, wherein the magenta color-forming silver halide emulsion layer containing at least one magenta dye-forming coupler selected from the compounds represented by formula (M-I) contains a high-boiling point organic solvent and a coupler, and the content of the high-boiling point organic solvent in the magenta color-forming silver halide emulsion layer is 1.5 or less in terms of mass ratio to the total amount of the coupler.

6. The silver halide color photographic light-sensitive material as claimed in claim 1, wherein the content of said dye in the non-color-forming hydrophilic colloidal layer containing the solid fine-particle dispersion of the dye is 35 mass % or less, to the hydrophilic colloid.

7. The silver halide color photographic light-sensitive material as claimed in claim 1, wherein the total amount of silver in all layers of the light-sensitive material is 1.7 $g/m^2$ or less.

8. The silver halide color photographic light-sensitive material as claimed in claim 1, wherein two or more types of emulsions differing in at least one feature among particle size, distribution of particle size, halogen composition, shape of particle or sensitivity are mixed and used as the silver halide emulsion in the magenta color-forming silver halide emulsion layer.

9. The silver halide color photographic light-sensitive material as claimed in claim 8, wherein three or more emulsions differing in at least one feature among particle size, distribution of particle size, halogen composition, shape of particle or sensitivity are mixed and used as the silver halide emulsion in the magenta color-forming silver halide emulsion layer.

10. The silver halide color photographic light-sensitive material as claimed in claim 1, wherein the silver halide particles of the silver halide emulsion in the magenta color-forming silver halide emulsion layer have a cubic, octahedron or tetradecahedron form.

11. The silver halide color photographic light-sensitive material as claimed in claim 5, wherein the amount of the high-boiling point organic solvent used in the emulsion layer contained in the coupler represented by the formula (M-I) is 1.2 to 0.15 in terms of mass ratio to the total amount of the coupler contained in the emulsion layer.

12. The silver halide color photographic light-sensitive material as claimed in claim 1, wherein the molecular weight of the magenta dye-forming coupler represented by formula (M-I) is 600 or less.

* * * * *